US005857612A

United States Patent [19]

Smith et al.

[11] Patent Number: 5,857,612

[45] Date of Patent: Jan. 12, 1999

[54] DOUBLE PANEL BOXES

[75] Inventors: Jeffrey A. Smith, Clark; Richard N. Beneroff, Chatham; Eric Kim, Secaucus, all of N.J.

[73] Assignee: Motion Design, Inc., Linden, N.J.

[21] Appl. No.: 987,112

[22] Filed: Dec. 8, 1997

Related U.S. Application Data

[63] Continuation-in-part of Ser. No. 604,674, Feb. 21, 1996, Pat. No. 5,769,309, and a continuation-in-part of Ser. No. 896,775, Jul. 18, 1997.

[51] Int. Cl.[6] ..... B65D 5/28

[52] U.S. Cl. ..... 229/167; 229/120.04; 229/120.05; 229/120.17

[58] Field of Search ..... 229/120.04, 120.05, 229/120.17, 185.1, 127, 142, 152, 153, 167, 168; 206/485, 564, 587, 591

[56] References Cited

U.S. PATENT DOCUMENTS

| | | | |
|---|---|---|---|
| 2,321,145 | 6/1943 | Jones | 229/167 X |
| 2,450,941 | 10/1948 | Crane | 229/120.04 |
| 2,614,746 | 10/1952 | Frankenstein | 229/167 |
| 2,693,309 | 11/1954 | Giroux et al. | 229/120.04 |
| 2,939,622 | 6/1960 | D'Ippolito | 206/485 |
| 3,002,672 | 10/1961 | Kotowick | 229/167 X |
| 3,764,004 | 10/1973 | Forbes, Jr. | 206/45.14 |
| 3,968,923 | 7/1976 | Bell et al. | 229/167 |
| 4,187,976 | 2/1980 | Mather . | |
| 4,236,662 | 12/1980 | Roccaforte . | |
| 4,341,339 | 7/1982 | Zore | 229/167 X |
| 4,396,145 | 8/1983 | Ditton | 229/120.04 X |
| 4,438,848 | 3/1984 | Montealegre et al. | 206/588 |
| 5,029,709 | 7/1991 | Faulstick | 229/167 X |
| 5,240,176 | 8/1993 | Akers | 229/155 |
| 5,372,259 | 12/1994 | Suzuki et al. | 206/586 |
| 5,540,330 | 7/1996 | Lo Duca | 206/446 |
| 5,769,309 | 6/1998 | Beneroff et al. | 229/167 |

*Primary Examiner*—Gary E. Elkins
*Attorney, Agent, or Firm*—Kenyon & Kenyon

[57] ABSTRACT

A box includes a plurality of outer panels collectively bounding an accommodation space for accommodating at least one item. At least some of the outer side panels have integrally formed inner side panels. The inner side panels may be automatically distanced from their respective outer side panels by moving the outer side panels from a collapsed flat position to an erected position. Certain panels of the box may be folded back on adjacent panels.

The space between two panels may be utilized. For example it may be a display space, a compartment accessible through an opening panel, or a storage space for a dispenser pack. Opening or closing a panel on the box, or another action on the box, may trigger various functions of the box components or contents.

15 Claims, 63 Drawing Sheets

FIG. 11
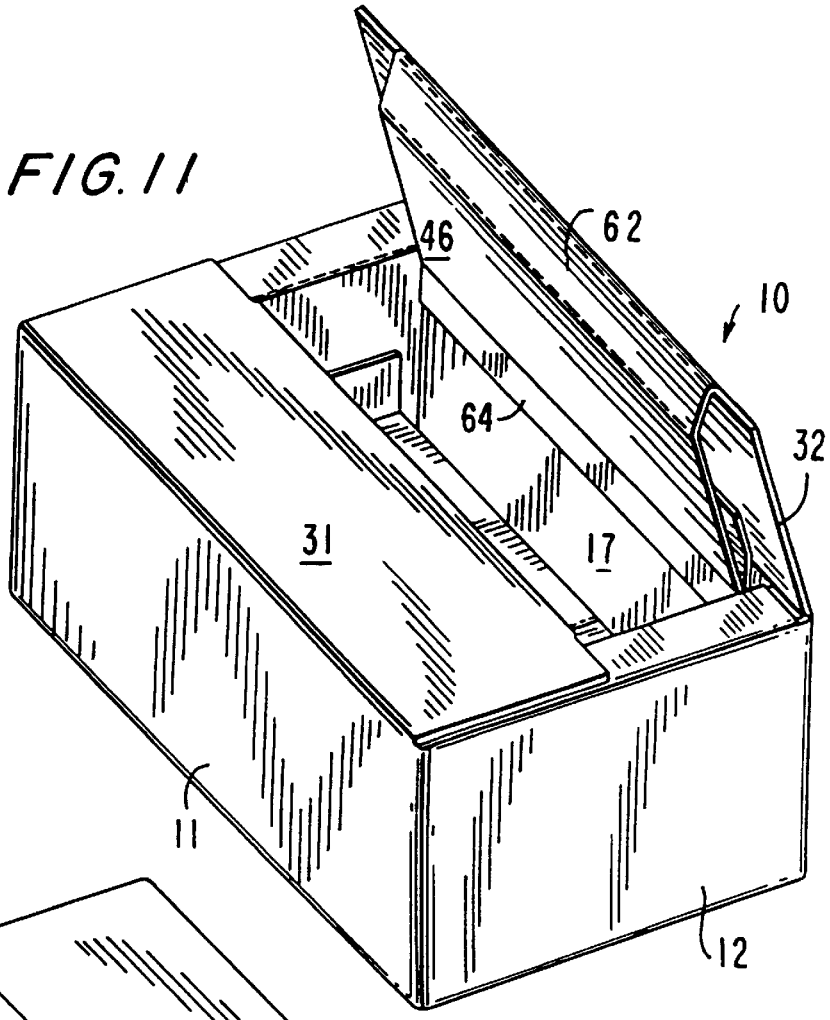
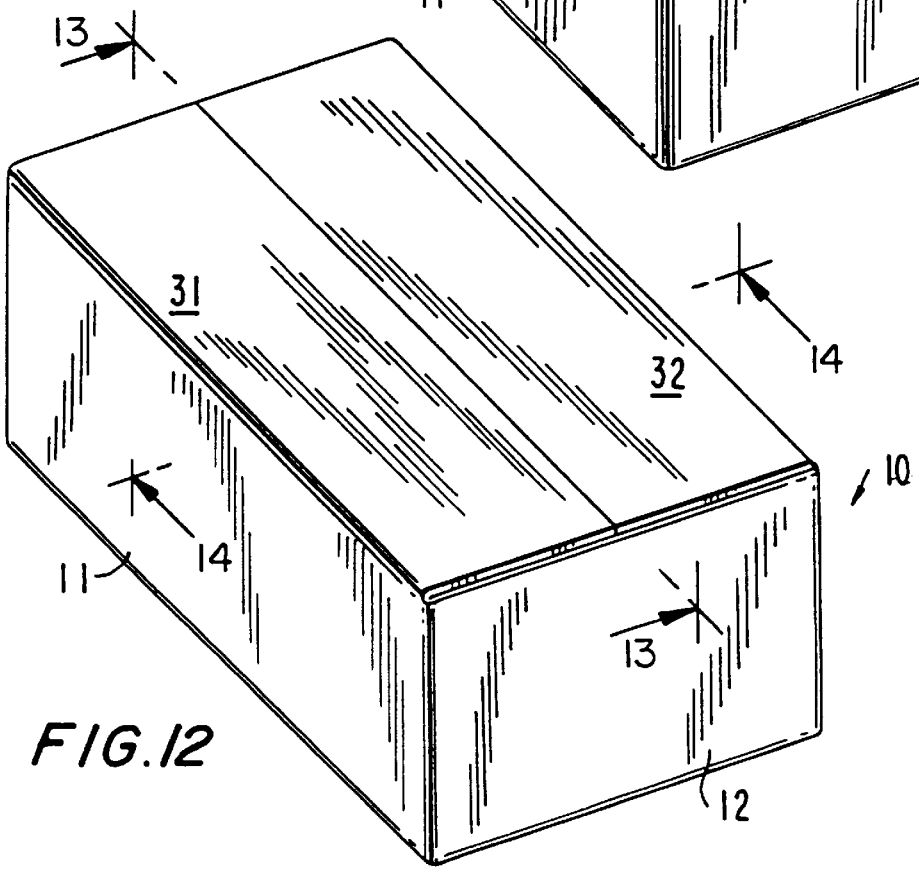
FIG. 12

FIG. 42
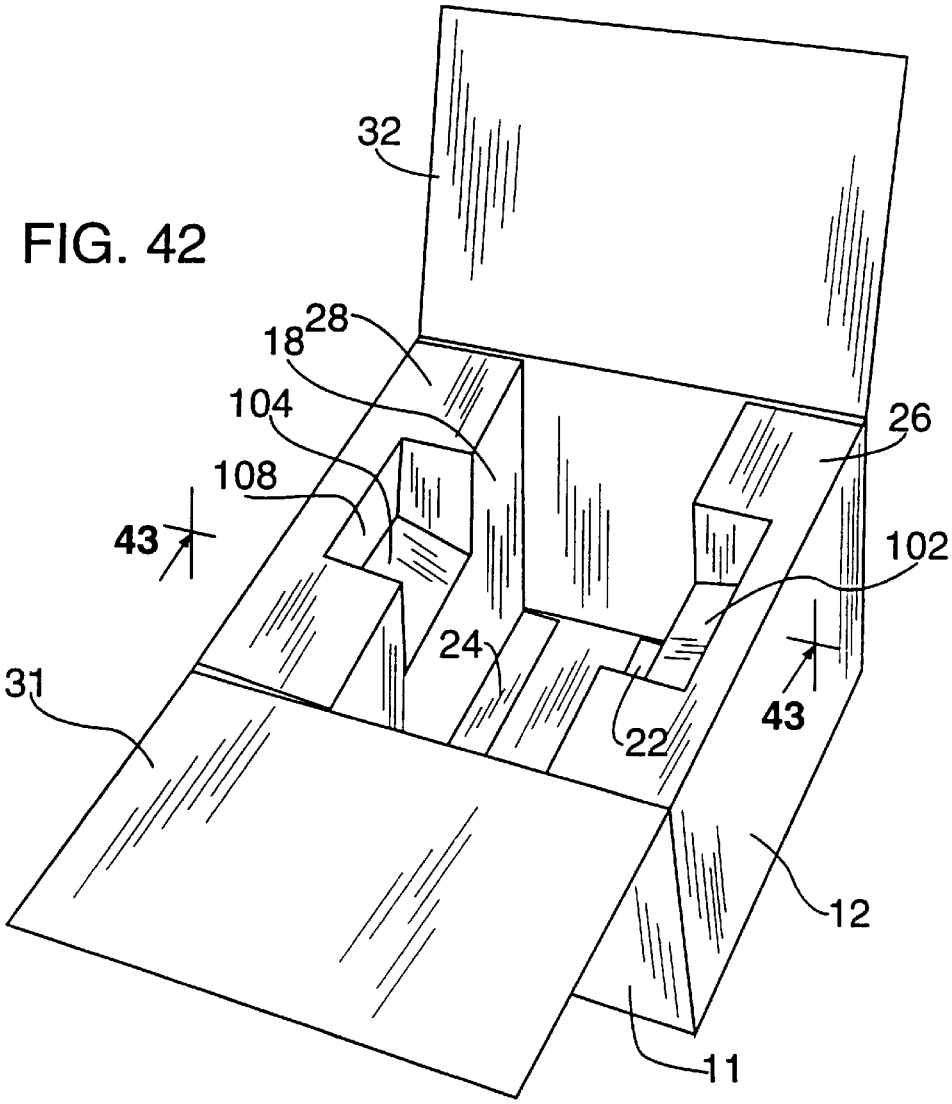
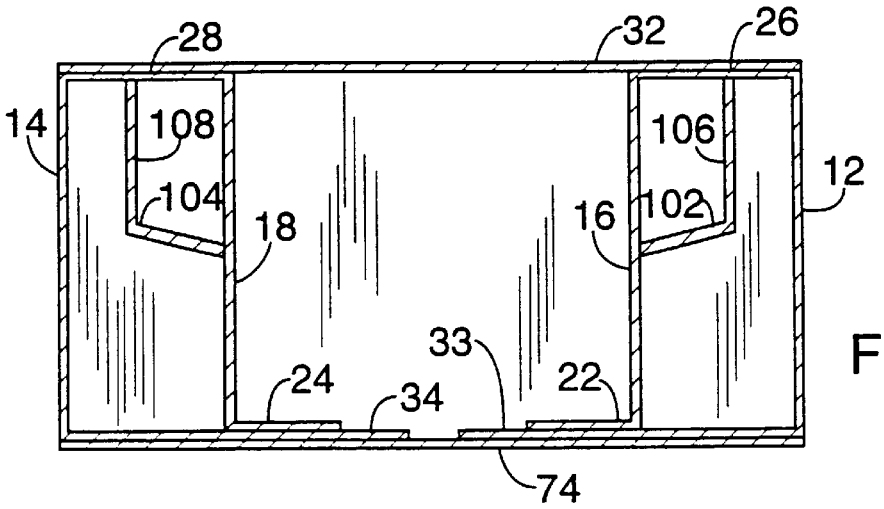
FIG. 43

34
14
161
74
21
15
71
11
25
13
27
23
17
73
71
25
32
72

DOUBLE PANEL BOXES

This application is a continuation-in-part of U.S. patent application Ser. No. 08/604,674, filed Feb. 21, 1996, and U.S. patent application Ser. No. 08/896,775, filed Jul. 18, 1997.

BACKGROUND OF THE INVENTION

The present invention relates to packaging in general, and more particularly to packaging boxes for accommodating various items or goods, especially during transportation and/or for display.

Various packaging boxes and shipping containers are known, among them ones that are especially equipped in one way or another for the shipping of items or goods in a protective manner. For instance, sensitive items such as electronic equipment are oftentimes shipped in regular parallelepiped corrugated cardboard boxes, but, in order to protect the items from potentially damaging shocks and vibrations while in transit, the items are often supported on blocks or specially molded formations of foamed polyurethane that hold the items at a distance from the panels forming the box and suppress the transmission to the items of any impacts, shocks, vibrations and/or other forces to which the box itself may be subjected.

Protecting items in this manner contributes to the cost of the packaging material and operation and thus to the cost of the item. Various other techniques have been proposed to achieve similar protection in a less expensive way, such as using box-shaped cardboard inserts to keep the item at a distance from the box panels, foamed polyurethane pellets or beads, or the so-called bubble-wrap sheets. All of these approaches, however, have certain drawbacks, be it their cost or the inadequacy of their supporting or cushioning action, or the failure by packing personnel to find or use the appropriate protective materials.

SUMMARY OF THE INVENTION

Accordingly, it is a general object of the present invention to avoid the disadvantages of the prior art.

An object of the present invention is to provide a double panel box which has the double panel construction as an integral part of the box. For example, embodiments according to the invention have the advantage of providing a double panel construction that is a permanent part of the box for as long as the box is being used.

Another object of the present invention is to construct the double panel box to be relatively simple in construction, inexpensive to manufacture, easy to use, and yet reliable in operation. For example, embodiments according to the invention do not require any special handling in order to put the double panel features into effect.

Thus, in accordance with embodiments of the invention, a box is provided with one or more inner panels, each being distanced, by at least one distancing flap, from a respective outer panel in a direction toward the accommodation space of the box. This thus forms a double panel construction.

The double panel construction provides a protective cushioning effect, keeping the items in the box distanced from the outer panels. The double panel provides a buffer for absorbing shock and/or vibration.

The double panel construction also has additional uses such as for facilitating display of the goods. For example, a cutout may be provided in an inner panel to support goods on display.

A particular advantage of the double panel arrangement according to embodiments of the invention is that the inner panel and distancing flap arrangement, by virtue of being integral parts of the box, cannot be either lost or misplaced, or inserted into the accommodation space in an improper orientation.

Another particular advantage of the double panel arrangement according to embodiments of the invention is that a box having the double panel construction may be constructed from a single flat sheet of material, properly cut, folded, and fastened (e.g., glued or stapled) in accordance with the invention. In addition, once the box is cut, folded, and fastened, it can be folded in a manner such that it can lie substantially flat, can be readily erected in a simple manner, and can be repeatably and easily collapsed flat and erected. That is, for example, after the box is cut, folded, and fastened, with the closing panels in a open position, the distancing flaps can be oriented parallel to their adjacent outer panels, such that the distancing flaps and corresponding inner panels lie flat against their adjacent outer panels. In this manner, the box can be collapsed flat without the need for any ungluing or unstapling. When the box is erected, the distancing flaps can be moved to a position in which they are then substantially perpendicular to their adjacent outer panels and the respective inner panels correspondingly can be moved toward the center of the box to a distanced position in which they are then displaced from their respective adjacent outer panels. In this manner, the box is fully erected. The process can be reversed and repeated, allowing the box to be repeatedly collapsed flat and erected, without the need for any ungluing or unstapling or additional gluing or stapling.

In an embodiment of the invention, inner panels and distancing flaps may be provided, for example, integrally with at least first and second outer side panels that face one another across the accommodation space. Inner panels and distancing flaps may also be provided integrally with third and fourth outer side panels that also face one another across the accommodation space, the first through fourth outer side panels forming a square or rectangular perimeter around the accommodation space. In this embodiment, each of the sides of the box has a double panel construction.

When the box comprises first through fourth outer side panels as described above, the top and bottom open ends may each be provided with at least one closing panel for closing, in whole or in part, at least one of the open ends. In this situation, one or more additional inner panels and distancing flaps, similar to those previously described, may be provided on one or more of the closing panels. Each of the top and bottom open ends may have a pair of closing panels, one of which is integral with one of the outer side panels of the unit and the other with that of the outer side panel of the unit that faces the same, the paired sections complementing each other when in their closed positions with the box being in its erected condition. Inner panels and distancing flaps may be associated with each closing panel.

In another embodiment, there may be provided two pairs of partitioning flaps, each partitioning flap integral with one of the closing panels and forming an extension thereof. One pair of partitioning flaps adjoins the corresponding region of the other pair of partitioning flaps when the closing panels are in their closed positions. The partitioning flaps may have respective slots so that the slots of each of the pairs of partitioning flaps receive associated solid portions of the partitioning flaps of the other pair when said partitioning flaps extend into and across the accommodation space in a closed condition of the box to partition the accommodation space into a plurality of compartments.

A double panel construction may be provided on the top or bottom of the box with or without having a double panel construction on one or more of the sides of the box. In one example, two closing panels on the top of the box are each provided with an associated inner panel and distancing flap. In another example, one closing panel on the bottom of the box is provided with an associated inner panel and distancing flap. Such a construction may be useful for cushioning food items such as cereals or cookies. In another example, one closing panel on the top of the box and one closing panel on the bottom of the box are each provided with an associated inner panel and distancing flap. Many other variations are conceivable within the scope of the invention.

In another application of a double panel construction in accordance with an embodiment of the invention, a double panel box may be provided in the form of an open-end double panel box cap. For shipping large items, for example, a tall box sleeve with open ends is provided, the ends being closable by box caps. In accordance with embodiments of the present invention, the side panels and/or the end closing panels of the box cap may each be provided with an associated inner panel and distancing flap. In this manner integral cushioning is provided at the ends of the assembled package, and in some applications additional inserts are unnecessary.

An inner panel in accordance with the invention may be parallel to the outer panel with which it is associated, or it may be at an angle therewith. The inner panel may have one section, or it may have one or more bend lines separating it into more than one inner panel section.

In accordance with further embodiments of the invention, one or more cutouts may be provided in the inner panel. The material at the cutout may be folded to provide a buttress flap and a buttress connecting flap for providing further support for the inner panel. The material at the cutout may additionally or alternatively be used as supporting flaps for supporting the goods to be shipped. Such a construction is useful for shipping items of a particular shape, for example circuit boards. Alternatively, the material at the cutout may be taken away in its entirety, such that the cutout area itself, as bounded by the remainder of the inner panel, provides support for the goods to be shipped.

In many of the embodiments according to the invention, the inner panel and/or the distancing flap is connected to an outer closing panel such that the inner panel is moved to its distanced position in which it is displaced from an adjacent outer panel when the closing panel is closed.

In other embodiments, an inner side panel may be provided with two distancing flaps that connect that inner side panel to an outer side panel, so that the inner side panel is moved to its distanced position when one or more of the distancing flaps is folded relative to the outer panel. As with other arrangements, more than one such inner panel may be provided in accordance with this arrangement.

In some embodiments, the inner side panels may be automatically distanced from their respective outer side panels by moving the outer side panels from a collapsed flat position to an erected position. This may be due to the outer closing panels themselves being automatically moved to create a bottom of the box when the outer side panels are moved from a collapsed flat position to an erected condition.

In some embodiments, certain panels of the box may be folded back on adjacent panels. Thus, a fold back panel may be folded back on the inside of an outer closing panel so that material can extend from the fold back panel to form the inner panel and distancing flap. The material may also be used to form a fold back panel against an outer side panel.

The space between two panels may be utilized. For example it may be a display space, a compartment accessible through an opening panel, or a space that is delimited to act as a placeholder for subsequent use. The space may be one of a plurality of spaces, the combination of which or ordered access to which performs, functions, or conveys information more efficiently or effectively than a single space or compartment.

Opening or closing a panel on the box, or another action on or input received by the box, or a component or compartment of the box, may trigger various responses by the box, its components, and/or its contents. Thus, the box may comprise a "receiving system", which may be the box itself or one or more components or contents of the box. The receiving system is capable of sensing, transducing and/or otherwise receiving an operator, user, or environmentally defined or determined input, and storing and/or responding to that input. The source of the input may be the external environment of the receiving system, and may be, for example, the external environment of the box, or one or more compartments or contents of the box in which the receiving system is located. The input may take any of a number of suitable forms. For example, it may take the form of an exchange and/or transfer of matter, energy or information between the input source and the receiving system, including but not limited to exchanges and/or transfers of atoms, molecules, groups of molecules, photons, electrons, or other subatomic particles, mechanical, acoustical, thermal, chemical, electrical, electronic, optical, magnetic, optoelectronic, electromechanical, electrochemical, photochemical, or electromagnetic energy. The exchange and/or transfer of matter, energy or information is also meant to include the exchange and/or transfer of any property, component or attribute of the input source and/or receiving system. The receiving system may serve to detect conditions of the input source and/or of the receiving system, such as velocity, pressure, temperature, and the like. The information detected serves as the input.

When the receiving system senses, transduces and/or otherwise receives the input, it may store and/or respond to that input. Possible responses include changing properties and/or emitting an output. The properties that may change include but are not limited to temperature, mass, size, shape, volume, quantity, luminosity, pressure, shock, humidity, vibration, material state, structure, color, porosity, taste, scent, texture, essence, sound, appearance, tendency, electrical state, entropy, productivity, behavior, influence, absorption, activity, insulation, durability, strength, moderation, adaptation, adjoining, maturation, association, motion, and/or stability. The properties that may change also include the system's resistance to, receptivity of, responsiveness to, or sensitivity to, any of the above listed properties.

When the response is the emission of an output, the output may be from an output source of the receiving system into an "output system", which may be the box itself, one or more components or contents of the box, or the external environment of the box. The output may take the form of an exchange and/or transfer of matter, energy or information between the output source and the output system, including but not limited to the types of exchanges and/or transfers listed above. The output source, for example, may be a signaling device, and the output may be a signal, e.g., an emitted light, sound, odor, magnetic field, or the like. The output may effect a change in properties of the output system, e.g., a change in any of the properties listed above with respect to the receiving system.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 11 is a front perspective view of another embodiment of a packaging box according to the present invention, in its partially open condition;

FIG. 12 is a front perspective view showing the packaging box of FIG. 11 in a fully closed condition;

FIG. 42 is a front perspective view of another embodiment of a packaging box according to the present invention;

FIG. 43 is a cross-sectional view taken through the packaging box of FIG. 42, in a closed condition, in the plane indicated by and in the direction of the arrows 43—43 of FIG. 42;

DETAILED DESCRIPTION OF THE ILLUSTRATED EMBODIMENTS

Figure 1:
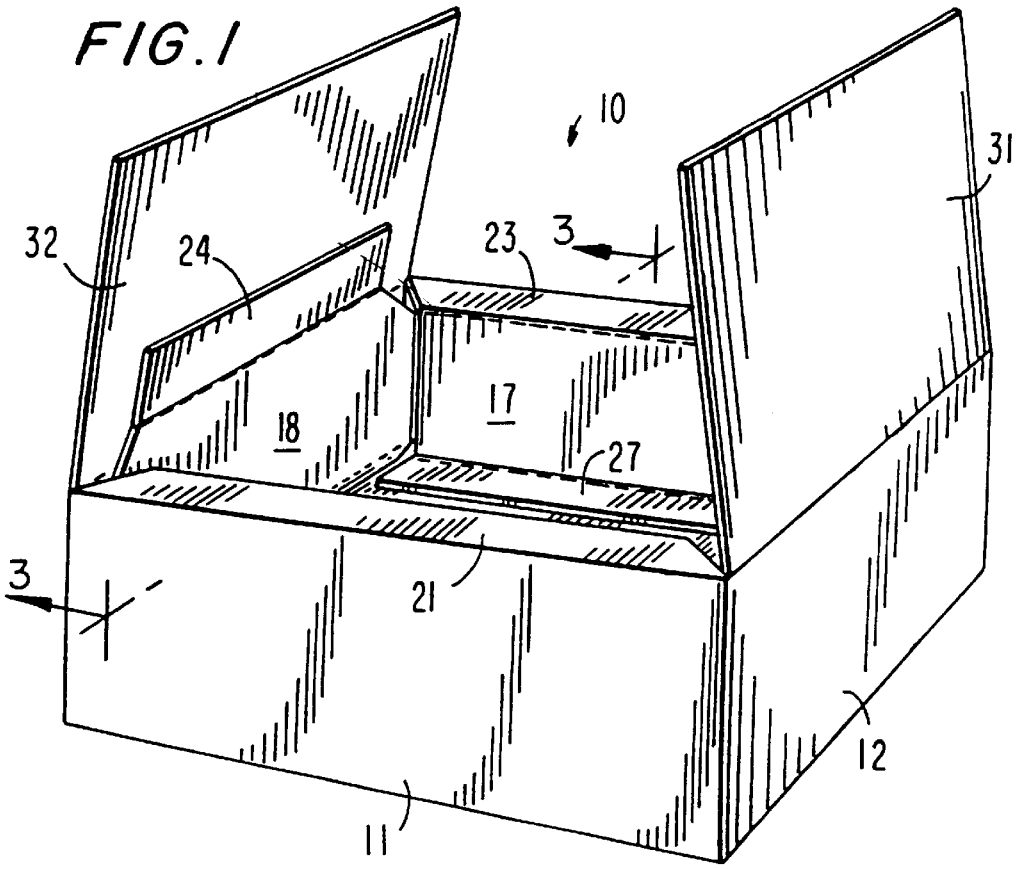
FIG. 1 is a front perspective view of a packaging box provided with a double panel construction according to the present invention, in its partially open condition.
Figure 2:
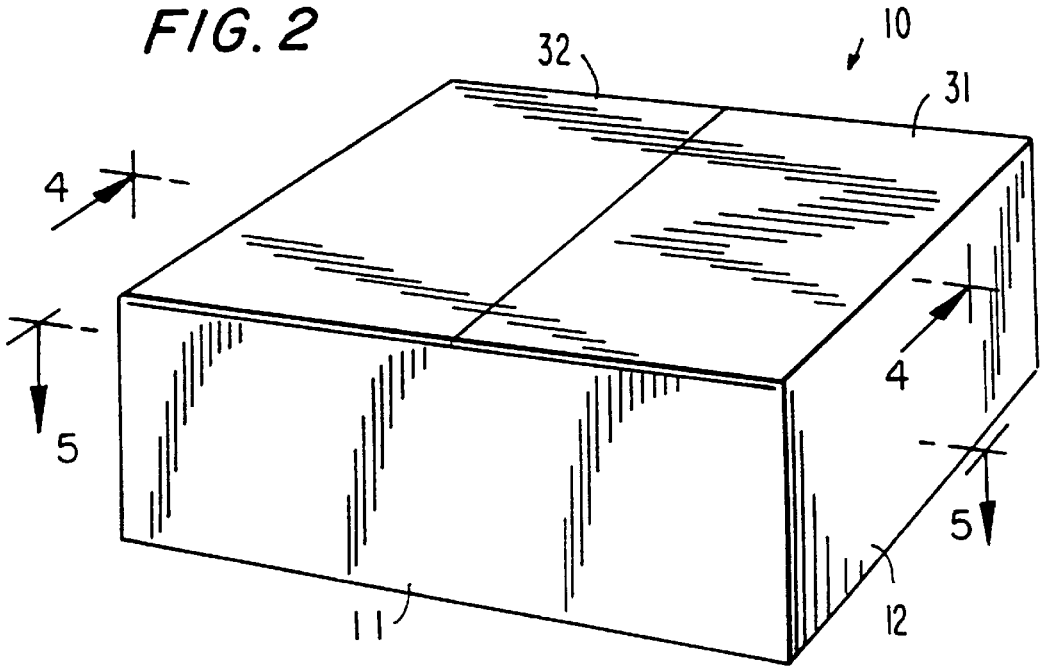
FIG. 2 is a front perspective view showing the packaging box of FIG. 1 in a fully closed condition.
Figure 3:
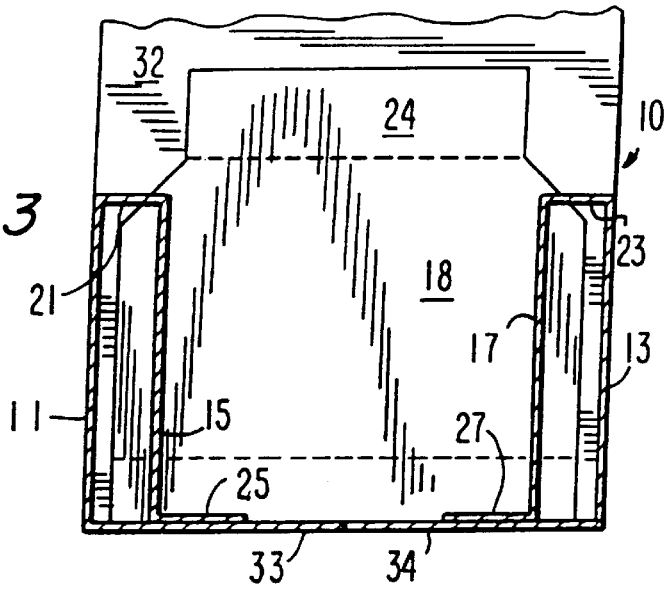
FIG. 3 is a cross-sectional view taken through the packaging box of FIG. 1 in the plane indicated by and in the direction of the arrows 3—3 in FIG. 1.
Figure 4:
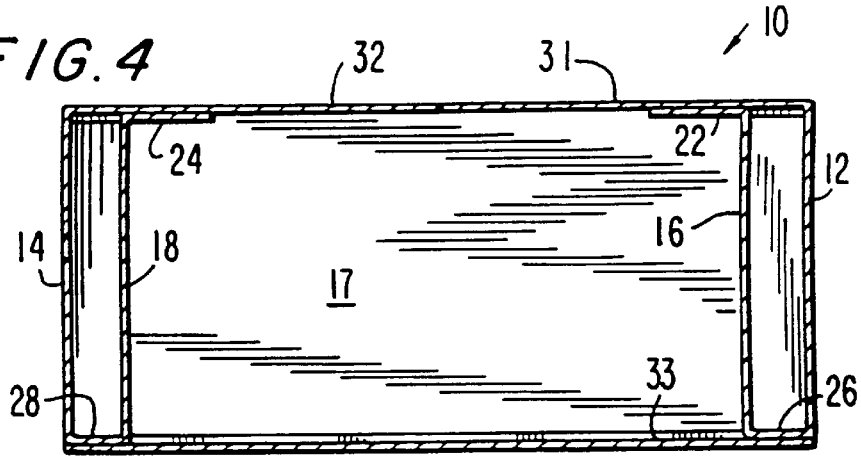
FIG. 4 is a cross-sectional view taken through the packaging box of FIG. 1 in the plane indicated by and in the direction of the arrows 4—4 in FIG. 2.
Figure 5:
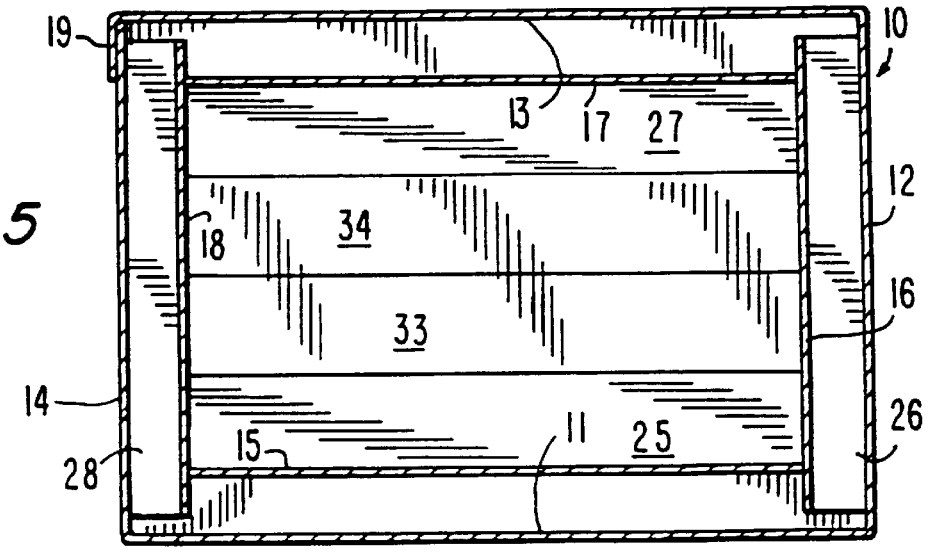
FIG. 5 is a cross-sectional view taken through the packaging box of FIG. 1 in the plane indicated by and in the direction of the arrows 5—5 in FIG. 2.

Reference is now made to the drawings in detail, in which the same reference numerals are being used therein as well as throughout this description to identify the same or similar but corresponding parts. Thus, for instance, the reference numeral 10 is used in the various figures for identifying a box incorporating a double panel feature of the present invention, in its entirety, regardless of the structural details of such a box 10.

FIGS. 1 to 6 show a box 10 of the present invention including, like many conventional boxes do, a plurality of outer side panels 11 to 14, including a front side panel 11, a back side panel 13, two side panels 12 and 14 interconnecting the front and back side panels 11 and 13, and respective top and bottom outer closing panels 31 to 34. The outer closing panels 31 to 34 span the spaces between the outer side panels 11 to 14 in a closed condition of the box illustrated, for instance, in FIG. 2. In the illustrated example of the box 10, the outer closing panels are constituted by a pair of top outer closing panels 31 and 32 and a pair of bottom outer closing panels 33 and 34, respectively. It may also be noted that there is further provided a connecting flap 19 that is integral with the outer side panel 13. In the assembled condition of the box 10, the connecting flap 19 overlaps and is joined (for instance glued or stapled) to the outer side panel 14.

The double panel box 10 of FIGS. 1 to 5 is further provided with respective inner side panels 15 to 18 that correspond to the outer side panels 11 to 14, respectively, in that order. The inner side panels 15 to 18 are joined to the outer side panels 15 to 18 in a manner yet to be described, and are spaced from them in the erected condition of the box 10. The doubling of at least the side panels by providing the inner side panels 15 to 18 in addition to the outer side panels 11 to 14 and causing them to be spaced from the latter in the erected condition of the box 10 provides additional protection for the goods to be transported in the box 10.

Figure 6:
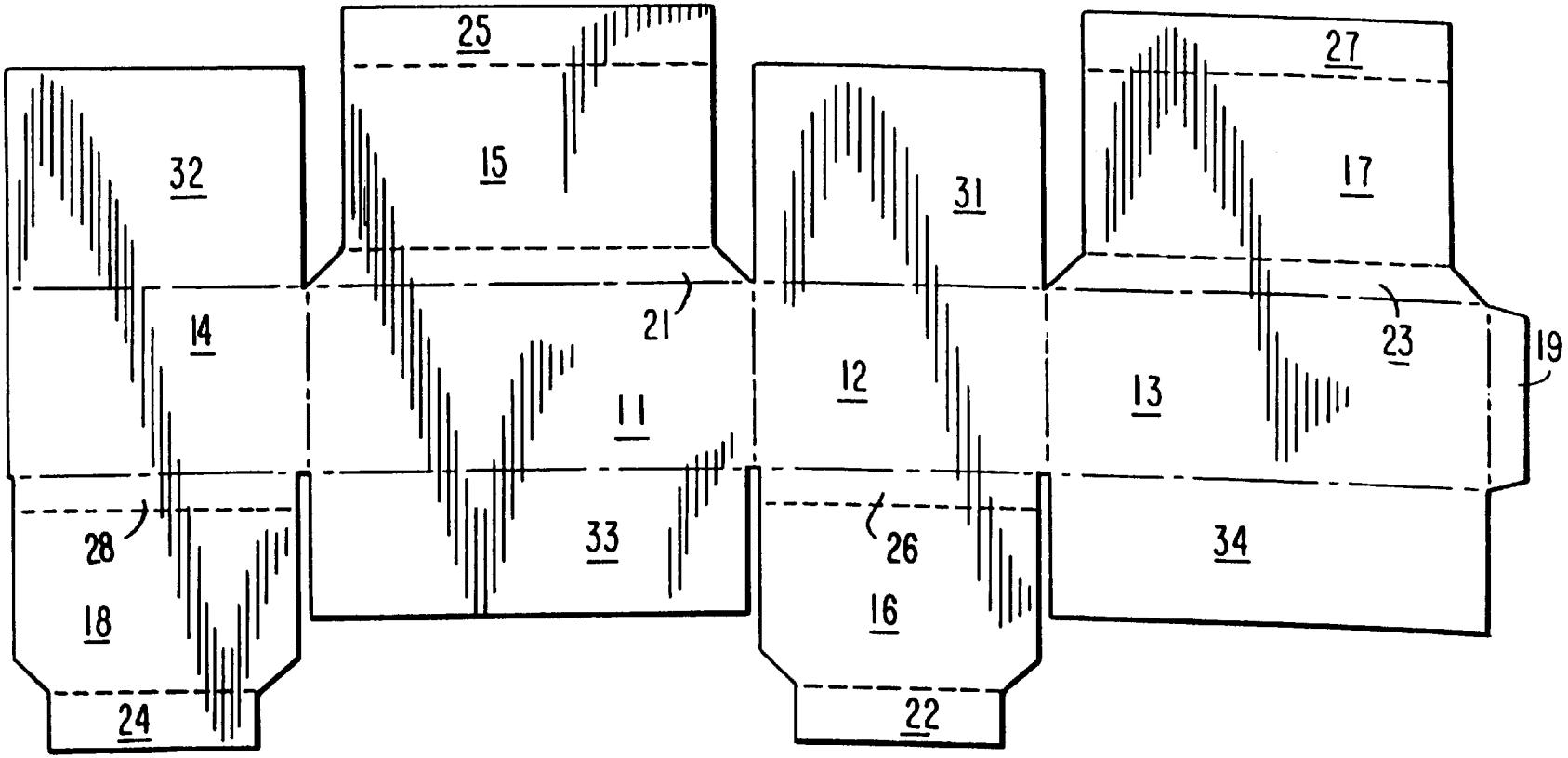
FIG. 6 is a view of a preform from which the packaging box of FIGS. 1–5 can be formed by folding and connecting the respective associated portions thereof.
Figure 7:
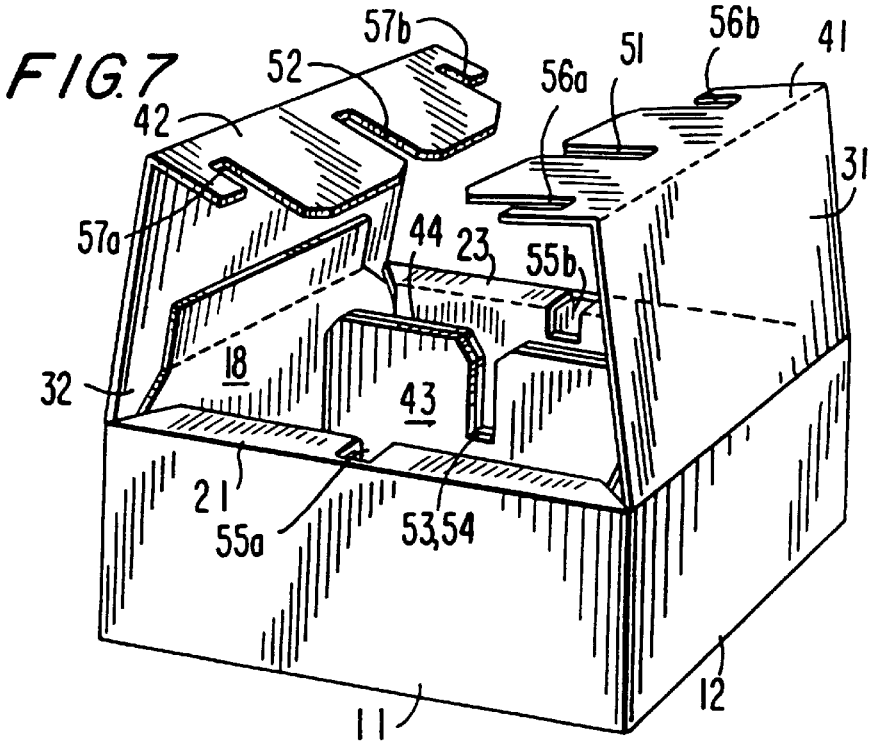
FIG. 7 is a front perspective view of another embodiment of a packaging box according to the present invention, in its partially open condition.

The inner side panels 15 to 18 are, in the erected condition of the box, spaced from the associated outer side panels 11 to 14 by distancing flaps and/or connecting flaps 21 to 28. The distancing flaps and connecting flaps, like the outer and inner side panels 11 to 18 and outer closing panels 31 to 34, are integral parts of a single preform made of corrugated board or any other conventional box-forming material. The preform for the box of FIGS. 1 to 5 is shown in FIG. 6. It will be appreciated that, in the erected condition of the cushioning box 10, all of such distancing and connecting flaps 21 to 28 are permanently joined to the adjacent and associated ones of the panels 11 to 18 and/or 31 to 34, either by being integral therewith as the side distancing flaps 21, 23, 26 and 28 are bilaterally, and the connecting flaps 22, 24, 25 and 27 are on one side, or by being glued, stapled or otherwise attached thereto as the connecting flaps 22, 24, 25 and 27 may be to the closing panels 31 to 34, respectively. On the other hand, in some instances it is not necessary to so permanently connect some of the flaps 22, 24, 25 or 27. It will also be appreciated that any and all of the connecting flaps 22, 24, 25 or 27 may be folded in a direction opposite to that illustrated so as to have their ends braced against the associated side panels 12, 14, 11, 13, respectively.

The distancing and connecting flaps 21 to 28 keep the inner side panels 15 to 18 at a distance from their associated outer side panel counterparts 11 to 14 in the illustrated erected condition of the box 10. As a result of this, the goods or items in the box 10 may be braced against the inner side panels 15 to 18 without any additional protective or cushioning measures having to be taken, and yet be fully protected not only from the effects of vibrations and minor shocks to which the box 10 may be subjected as it is being handled during transportation from one location to another, for instance, but also from relatively large shocks and impacts and even from concentrated impacts that may penetrate and damage one or more of the outer panels 11 to 14 but stop short of reaching or piercing the associated inner panel 15 to 18.

Figure 8:
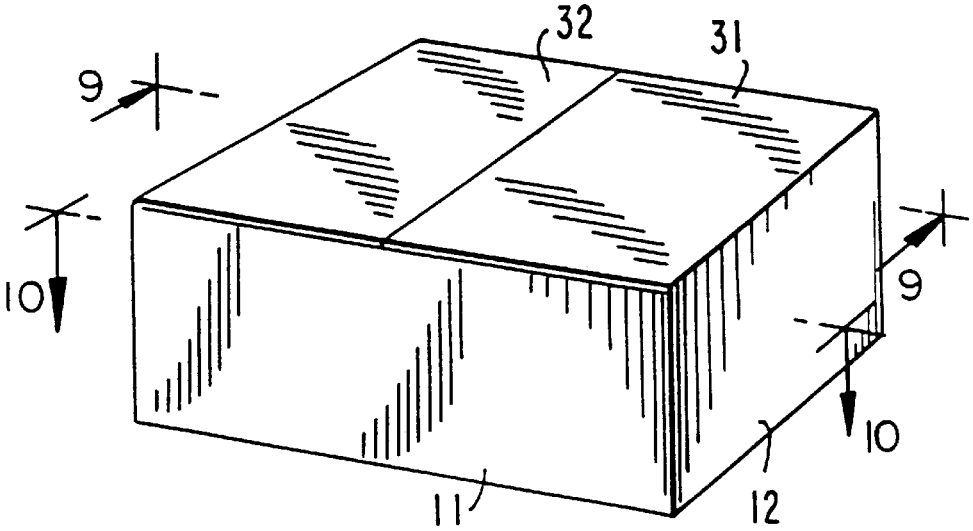
FIG. 8 is a front perspective view showing the packaging box of FIG. 7 in a fully closed condition.
Figure 9:
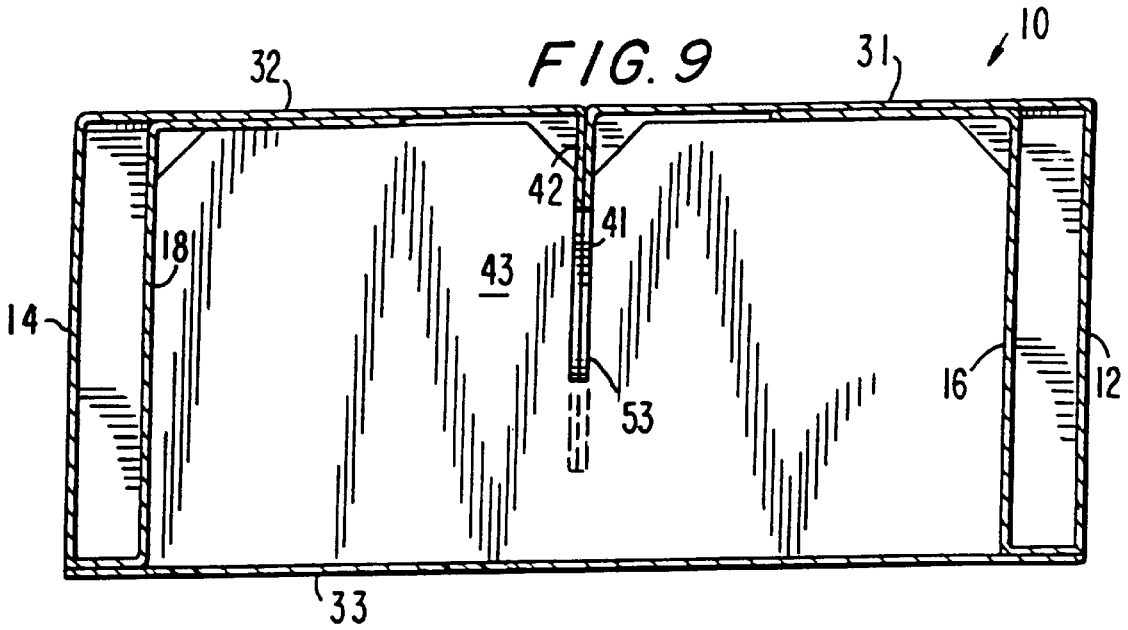
FIG. 9 is a cross-sectional view taken through the packaging box of FIG. 7 in the plane indicated by and in the direction of the arrows 9—9 of FIG. 8.
Figure 10:
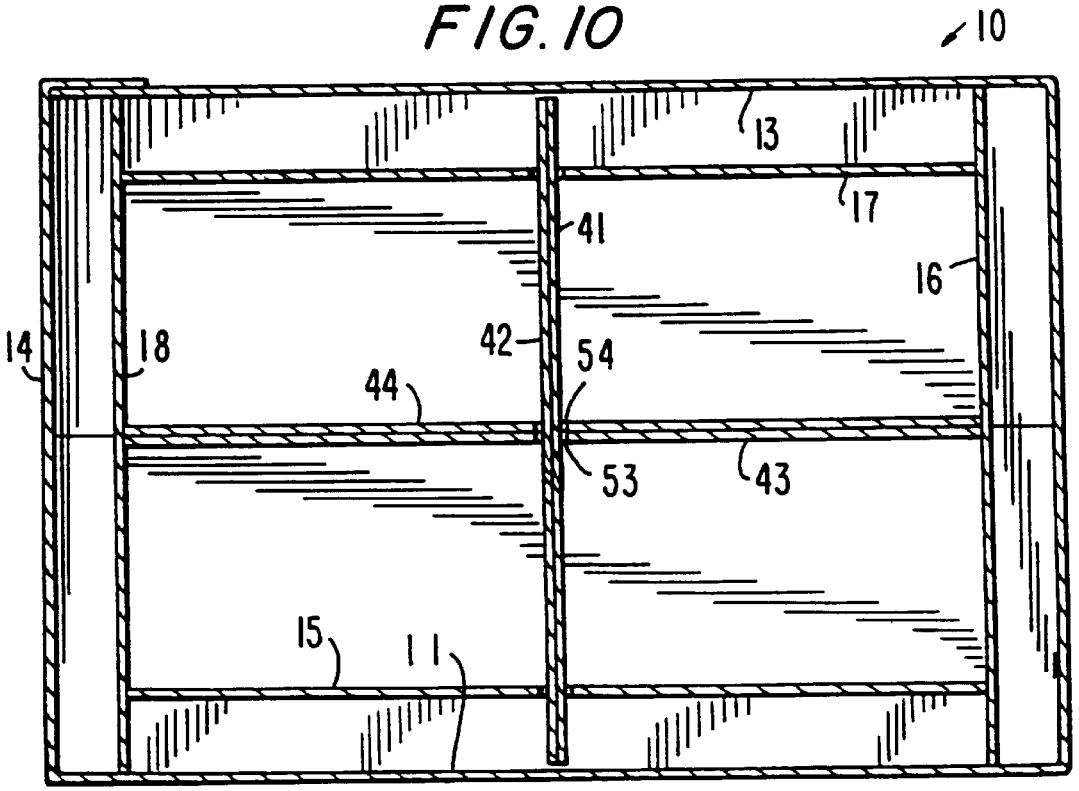
FIG. 10 is a cross-sectional view taken through the packaging box of FIG. 7 in the plane indicated by and in the direction of the arrows 10—10 in FIG. 8.
Figure 13:
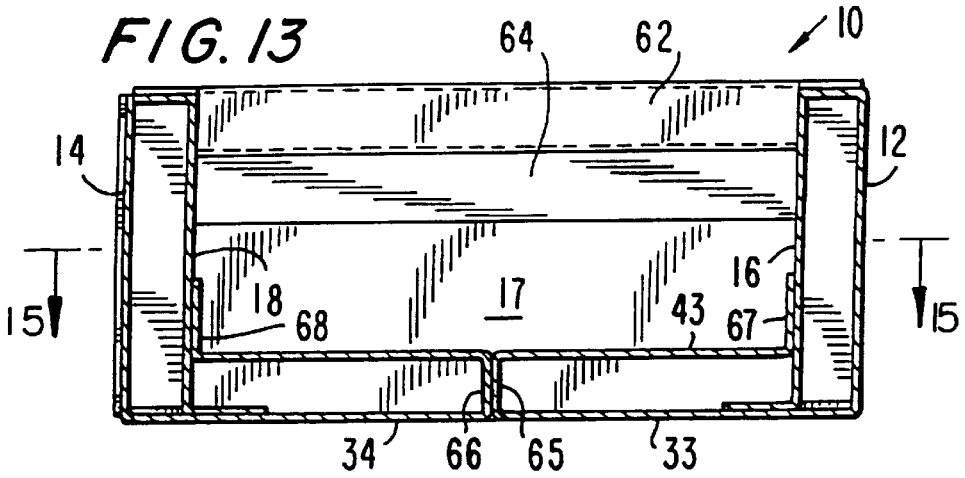
FIG. 13 is a cross-sectional view taken through the packaging box of FIG. 11 in the plane indicated by and in the direction of the arrows 13—13 of FIG. 12.
Figure 14:
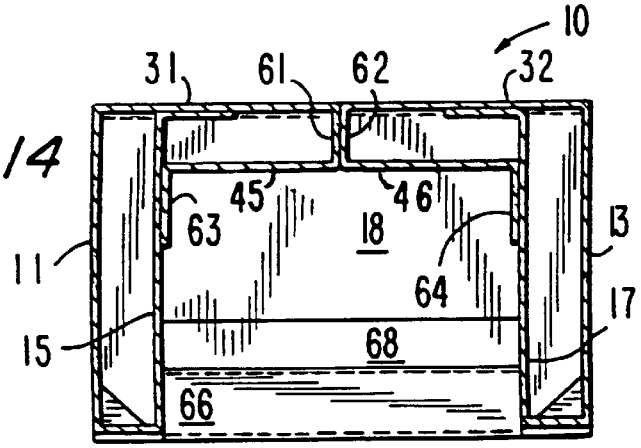
FIG. 14 is a cross-sectional view taken through the packaging box of FIG. 11 in the plane indicated by and in the direction of the arrows 14—14 in FIG. 12.
Figure 15:
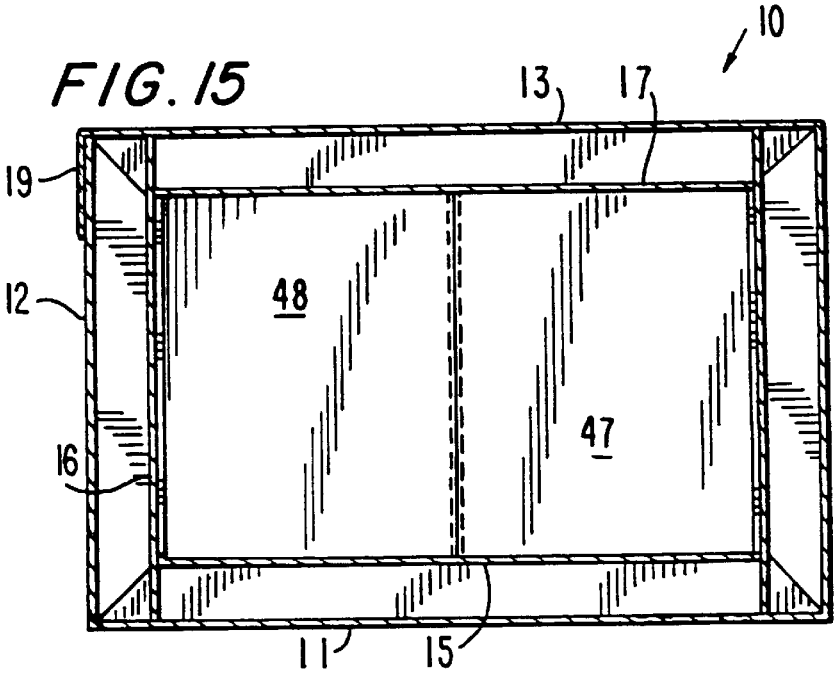
FIG. 15 is a cross-sectional view taken through the packaging box of FIG. 11 in the plane indicated by and in the direction of the arrows 15—15 in FIG. 13.

These advantages are also obtained in the box 10 that is illustrated in FIGS. 7 to 10. This box is similar to that illustrated in FIGS. 1 to 5, except that in addition to the double panel structure constituted by the full panels 11 to 18, the half-panels 31 to 34, and the distancing and connecting flaps 21 to 28, the box structure of FIGS. 7 to 10 also includes a partitioning or compartmentalization feature. In particular, partitioning flaps 41 to 44 are provided that adjoin and are of one piece with the top and bottom closing panels. The partitioning flaps 41 to 44 are preferably dimensioned to span substantially the entire distance between the top and bottom closing panels 31 to 34 in the fully closed condition of the box 10 that is shown in FIGS. 8 to 10 of the drawing, and are provided with respective accommodating slots 51 to 54. The slots 51 to 54 extend over substantially one half of the width of the associated partitioning flap 41 to 44, but a different length distribution among the slots 51 to 54 is conceivable and may even be preferred in certain circumstances.

In a closed condition of the box 10, the partitioning flaps 41 to 44 are interlocked and thus held in position without freedom of movement in any direction other than the box-opening one, and even that one only when accompanied by deformation of the flexible material of the flaps 41 to 44, in that respective portions of the flaps 41 to 44 are received and confined in the associated ones of the accommodation slots 53, 54 or 51, 52. It may be seen that the partitioning walls 41 to 44 subdivide the interior of the box 10 into respective separate compartments each for accommodating one or more of the goods or items to be transported, stored, put on display or otherwise handled while in the box 10, with such separately accommodated goods or items being prevented by the partitioning flaps 41 to 44 from bumping against or otherwise coming in contact with the goods or items contained in the other such compartments.

If desired, the positional stability of the partitioning flaps 41 and 42 (and, similarly, of the flaps 43 and 44 as well) may be increased by anchoring their respective outer margins in the closed condition of the box 10 to the double panels 11, 15 and 13, 17 (or, in the case of the partitioning flaps 43 and 44, to the double panels 12, 16 and 14, 18). To this end, respective cutouts 55*a* and 55*b* (and/or similar non-illustrated additional cutouts) are provided in the distancing flaps 21 and 23 (and/or 26 and 28, if necessary) and the inner panels 15 and 17 (and/or 16 and 18) for receiving the corresponding portions of the partitioning flaps 41 and 42 (or 43 and 44).

Moreover, to further increase the security of such anchoring, the partitioning flaps 41 and 42 are shown to be provided with respective auxiliary accommodation slots 56*a*, 56*b* and 57*a*, 57*b*, respectively, that flank the slots 51 and 52 and, in the closed condition of the box 10, receive corresponding portions of the inner panels 15 and 17, respectively. A similar additional anchoring feature could also be implemented with respect to the partitioning flaps 43 and 44 and the associated inner panels 16 and 18, but this, like the aforementioned primary anchoring feature, has not been illustrated because it ought to be clear without specific illustration.

FIGS. 11 to 15 of the drawings illustrate, in addition to features shown in and described above in conjunction with FIGS. 1 to 6, an additional double panel feature in accordance with the present invention. More particularly, while the goods are well protected from all sides in the box constructions illustrated in FIGS. 1 to 10, they may still be vulnerable to some extent to external influences or forces directed against the top or bottom panels of the box 10. In the box structure illustrated in FIGS. 11 to 15, additional protection is provided in the same, relatively simple manner by giving the top and bottom walls of the box 10 a double panel construction. In this case, as shown in FIGS. 11 and 13 to 15, inner panels in the form of closing panel inner panels 45 to 48 are being used for doubling the respective top and bottom panels of the box 10. To this end, the closing panel inner panels 45 to 48 are connected to and separated from the associated ones of the top and bottom outer closing panels 31 to 34 by respective distancing flaps in the form of closing panel distancing flaps 61, 62, 65 and 66 integral therewith, and are provided with respective connecting flaps 63, 64, 67 and 68. Without further detailed discussion, it should be clear at this point that the distancing flaps 61, 62, 65 and 66 perform the same function with respect to the outer panels 31 to 34 and inner panels 45 to 48 as their counterparts 21, 23, 26 and 28 do with respect to the inner and outer panels 11 to 14 and 15 to 18.

Figure 16:
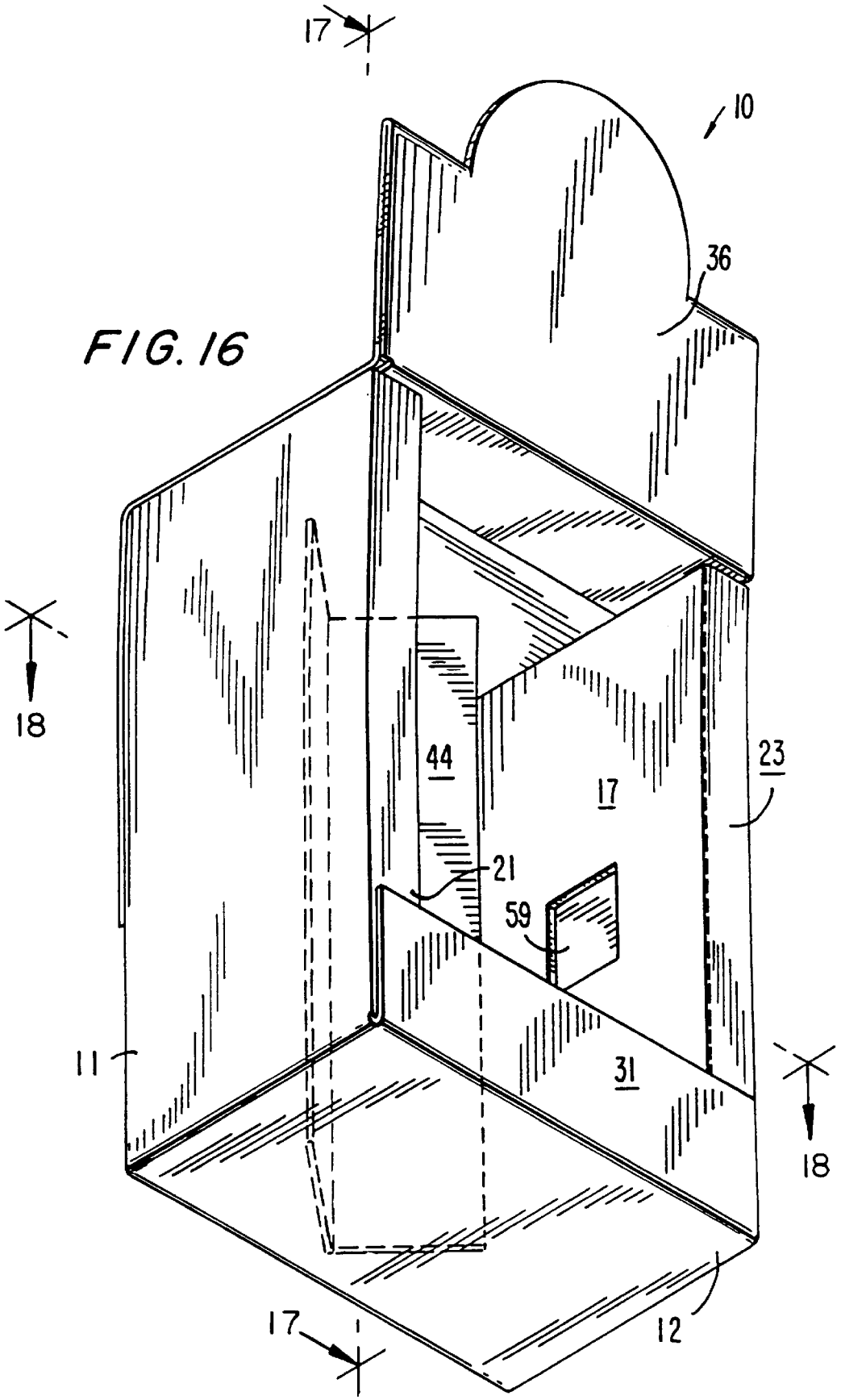
FIG. 16 is a perspective view, partially from below, of another embodiment of a packaging box of the present invention, in its display condition.
Figure 18A:
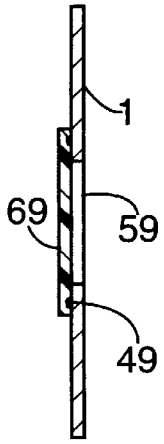
FIG. 18A is a sectional view of a modified panel or flap of the box of the present invention.
Figure 17:
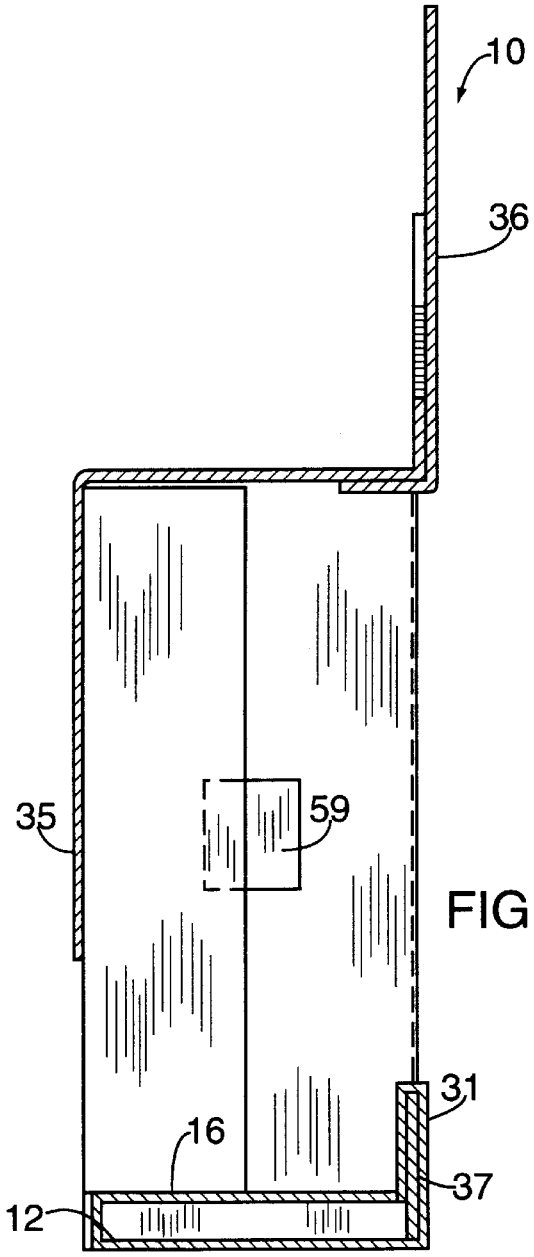
FIG. 17 is a cross-sectional view taken through the packaging box of FIG. 16 in the plane indicated by and in the direction of the arrows 17—17 in FIG. 16.
Figure 18:
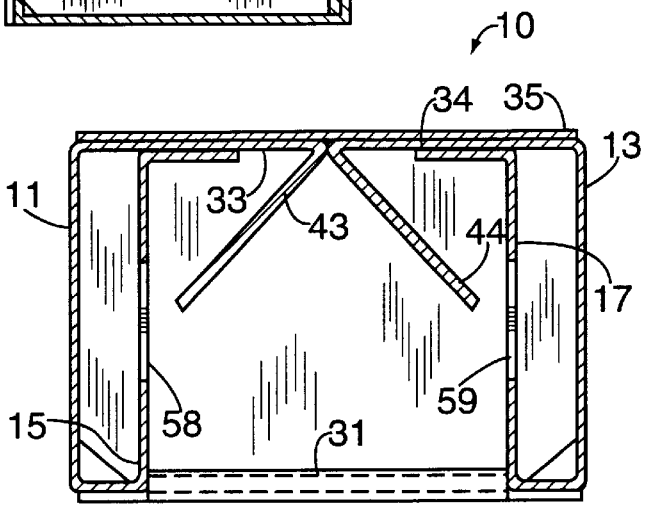
FIG. 18 is a cross-sectional view taken through the packaging box of FIG. 16 in the plane indicated by and in the direction of the arrows 18—18 in FIG. 16.

FIGS. 16 to 18 illustrate a box 10 that is particularly suited for use in displaying goods or items, preferably those that have been transported to a retail establishment in the box 10. In this construction of the box, only three side walls of the box 10 (or the side and bottom walls of the box 10 as considered in its display position) are shown to be doubled. Instead of being used for either partitioning or for wall doubling, the flaps 43 and 44 are being used in this instance as spacers or back supports for the items on display (not shown).

As also shown, the back wall may have two adjacent panels for the purposes of stability. Thus, an additional full panel 35 is glued or otherwise permanently secured to the outer closing panels 33 and 34 at their back, as considered in the illustrated position. Furthermore, the partial panel 32 (or, in its absence, as shown, the reinforcing member or panel 35 which in this instance is extended forward and then upward) may have secured thereto another panel 36 that may carry advertising or other matter and may be positioned in the manner shown in FIGS. 16 and 17 so as not to interfere with free access to the goods on display.

On the other hand, the outer closing panel 31 may be folded, either on itself or, as shown, around a reinforcing strip 37, to also be out of the way as far as access to the goods is concerned, while still providing a rim or barrier that prevents the bottommost goods on display from accidentally sliding or inadvertently being pulled out of the confines of the box 10 in which they are being presented to view. FIGS. 16 to 18 also reveal that cutouts 58 and 59 may be provided at substantially corresponding locations of the inner panels 15 and 17 to facilitate the handling of the box 10 at the display location and/or to provide additional support for the goods on display.

In the aforementioned embodiments, each panel and flap is illustrated as being of a one-piece construction, that is, of a single piece of corrugated board or like box-forming material. In a variant construction, one or more of such panels or flaps, and preferably an opposed pair, is or are formed with cutouts, each cutout being overlain with a taut membrane, preferably a synthetic plastic film that is adhered, fused, or otherwise connected around the periphery of the respective cutout.

Thus, as shown in FIG. 18A, a representative panel or flap 1 is formed with a cutout 59, preferably rectangular, which is overlain by a flexible taut membrane 69 that is glued about its periphery to the panel/flap 1 by an adhesive 49. When two or more such membranes are situated within the packaging box, an item therein engages these membranes, thereby further protecting the item from impacts and shocks of the kind encountered during transport and handling of the box.

Figure 19:
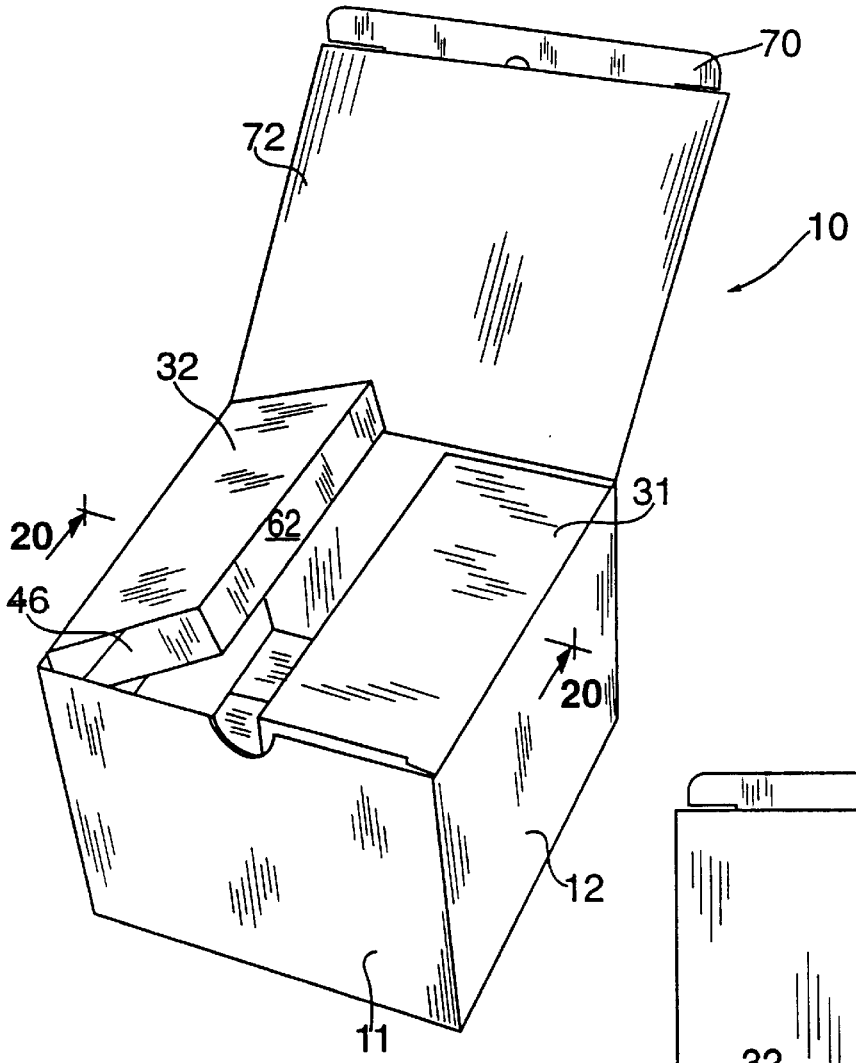
FIG. 19 is a front perspective view of another embodiment of a packaging box according to the present invention.
Figure 20:
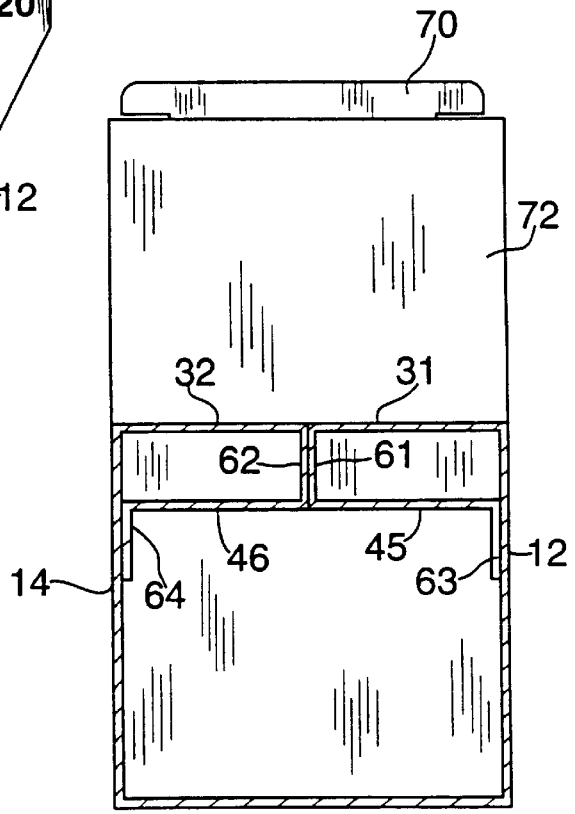
FIG. 20 is a cross-sectional view taken through the packaging box of FIG. 19, in a partially closed condition, in the plane indicated by and in the direction of the arrows 20—20 of FIG. 19.

Many variations within the scope of the invention are conceivable. For example, FIGS. 19 and 20 show an alternate embodiment of the box 10 in which only the top of the box has the double panel feature. The two outer closing panels 31 and 32 are each provided with associated closing panel inner panels 45 and 46, respectively. Distancing flap 61 is connected to outer closing panel 31 and to closing panel inner panel 45, and distancing flap 62 is connected to outer closing panel 32 and to closing panel inner panel 46. The closing panel inner panels 45, 46 are connected to adjacent outer side panels 12, 14 by connecting flaps 63, 64, respectively. The double panel construction operates in a similar manner to that previously described in that when the outer closing panels 31, 32 are folded to the closed position, the inner panels 45, 46 are moved toward the center of the box to a distanced position in which they are displaced from the adjacent outer closing panels 31, 32. It should be noted that a further outer panel 72 is provided in the illustrated box, with a locking tab 70, for further closing off the top of the box.

Figure 21:
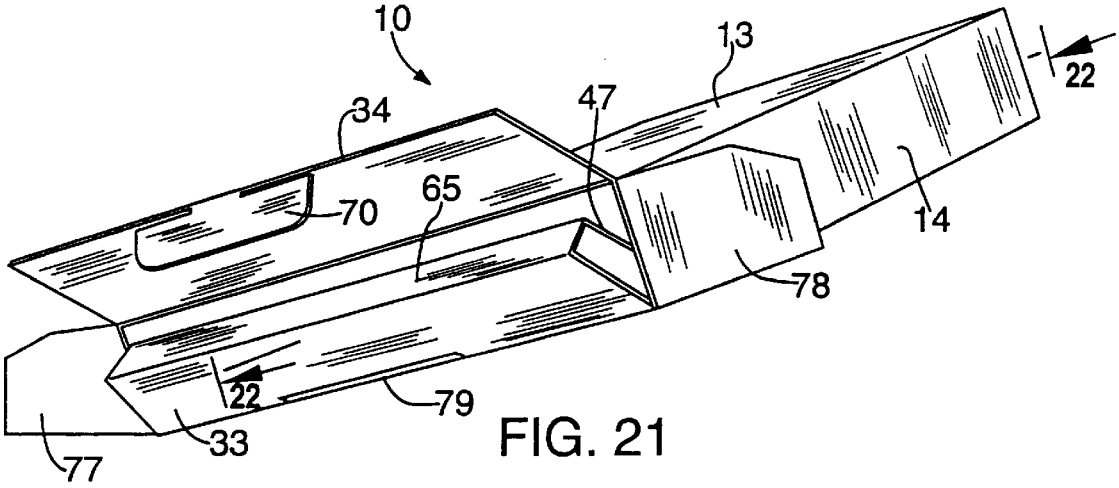
FIG. 21 is a bottom perspective view of another embodiment of a packaging box according to the present invention.
Figure 22:
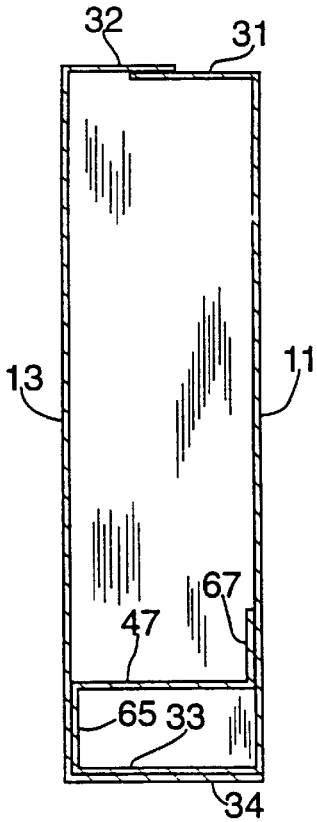
FIG. 22 is a cross-sectional view taken through the packaging box of FIG. 21, in a closed condition, in the plane indicated by and in the direction of the arrows 22—22 of FIG. 21.

FIGS. 21 and 22 show an alternate embodiment of the box 10 in which only the bottom of the box has the double panel feature. In this case, outer closing panel 33 itself substantially extends across the bottom of the box and is alone provided with an associated closing panel inner panel 47. Distancing flap 65 is connected to the outer closing panel 33 and to the closing panel inner panel 47. The closing panel inner panel 47 is connected to the adjacent outer side panel 11 by connecting flap 67, which is, for example, glued to outer side panel 11. (The glue area is shown by a dark strip in the preform view in FIG. 24.) Again, this double panel construction operates in a similar manner to that previously described in that when the outer closing panel 33 is folded to the closed position, the inner panel 47 is moved toward the center of the box to a distanced position in which it is displaced from the adjacent outer closing panel 33. This embodiment may be useful for cushioning food items such as cereals or cookies. It should be noted that the illustrated box has closing flaps 75 to 78. The closing flaps 77, 78 as well as outer closing panel 34, which has a locking tab 70 for inserting into slot 79, are provided for further closing off the bottom of the box.

Figure 23:
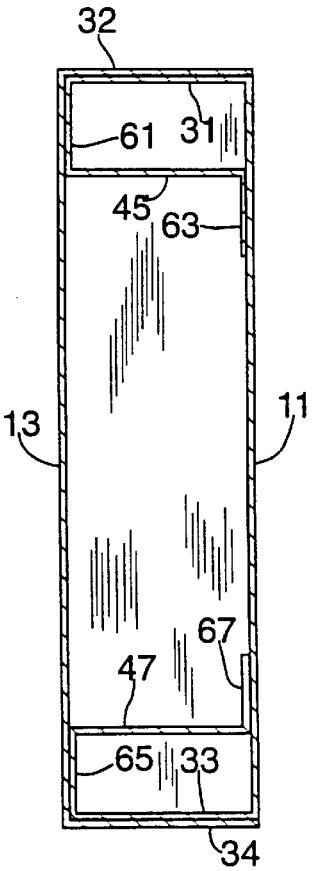
FIG. 23 is a cross-sectional view similar to that shown in FIG. 22, but showing an alternative embodiment.

FIG. 23 shows a box similar to that shown in FIG. 22, except that it has not only a double panel on the bottom of the box but also a double panel on the top of the box. The double panel at the bottom of the box is the same as in FIG. 22. At the top of the box, closing panel 31 is provided with an associated closing panel inner panel 45. Distancing flap 61 is connected to the outer closing panel 31 and to the closing panel inner panel 45. The closing panel inner panel 45 is connected to the adjacent outer side panel 11 by connecting flap 63. Again, this construction operates in a similar manner to that previously described in that when the outer closing panel 31 is folded to the closed position, the inner panel 45 is moved toward the center of the box to a distanced position in which it is displaced from the adjacent outer closing panel 31.

Figure 24:
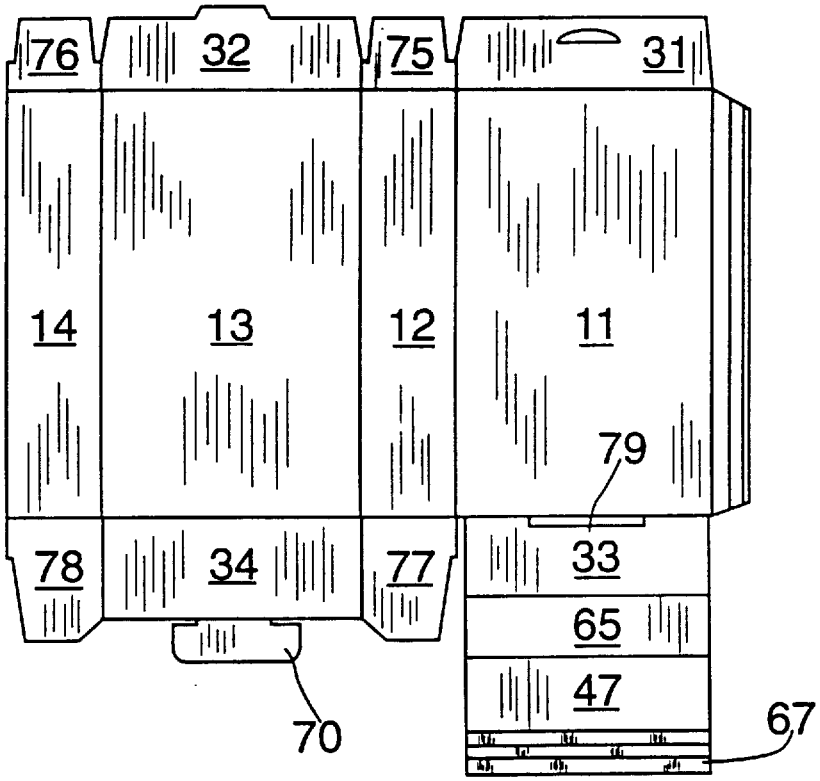
FIG. 24 is a view of a preform from which the packaging box of FIG. 21 can be formed by folding and connecting the respective associated portions thereof.

FIG. 24 shows a preform from which the packaging box of FIG. 21 can be formed by folding and connecting the respective associated portions. As shown, the box can be constructed from a single flat sheet. The portions 33, 65, 47, and 67 are folded with respect to each other to form the double wall construction, with the connecting flap being glued, for example, to side panel 11. FIG. 24 also shows an example of the type of conventional flaps 31, 32, 75, 76 that can be used to close the top of the box.

Figure 25:
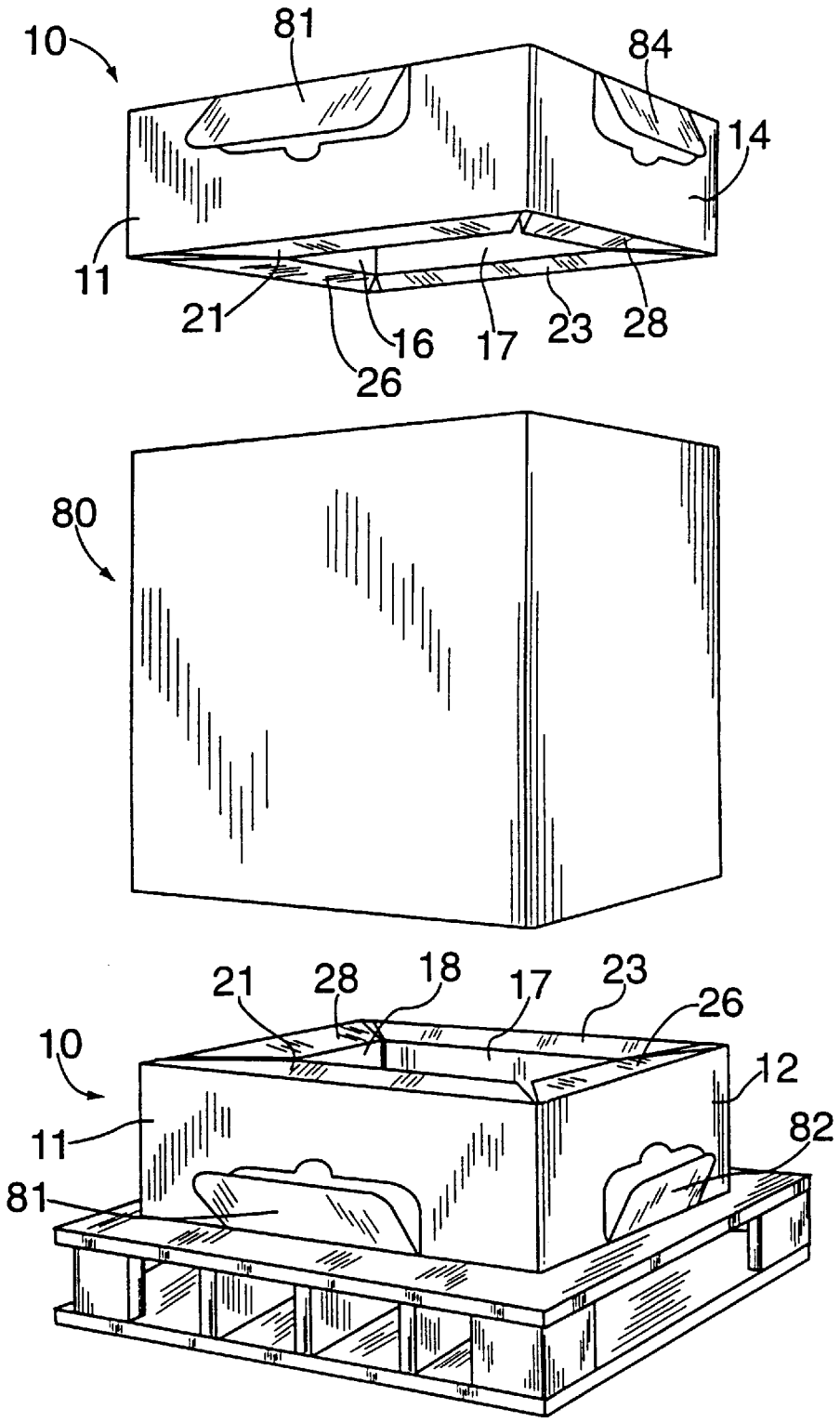
FIG. 25 is a perspective exploded view showing a packaging arrangement incorporating two box caps according to another embodiment of the present invention.

FIG. 25 shows a packaging arrangement incorporating two boxes in the form of box caps 10 according to another embodiment of the present invention. Such a packaging arrangement may be used, for example, in packaging for shipping large items. A tall box sleeve 80 with open ends is provided, the ends being closable by the box caps 10 as shown. The outer side panels 11 to 14 of the box caps 10 fit within the sleeve 80, with the box cap flaps 81 to 84 abutting against the end of the sleeve 80.

Figure 26:
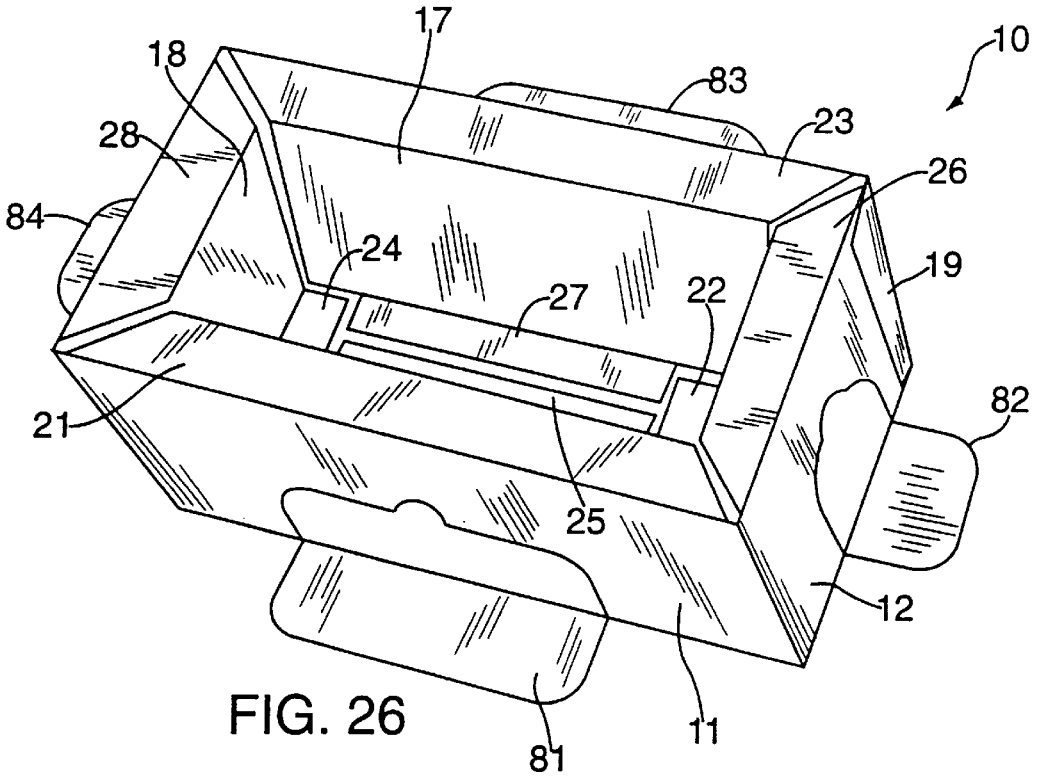
FIG. 26 is an inside perspective view of a box cap according to an embodiment of the present invention.
Figure 27:
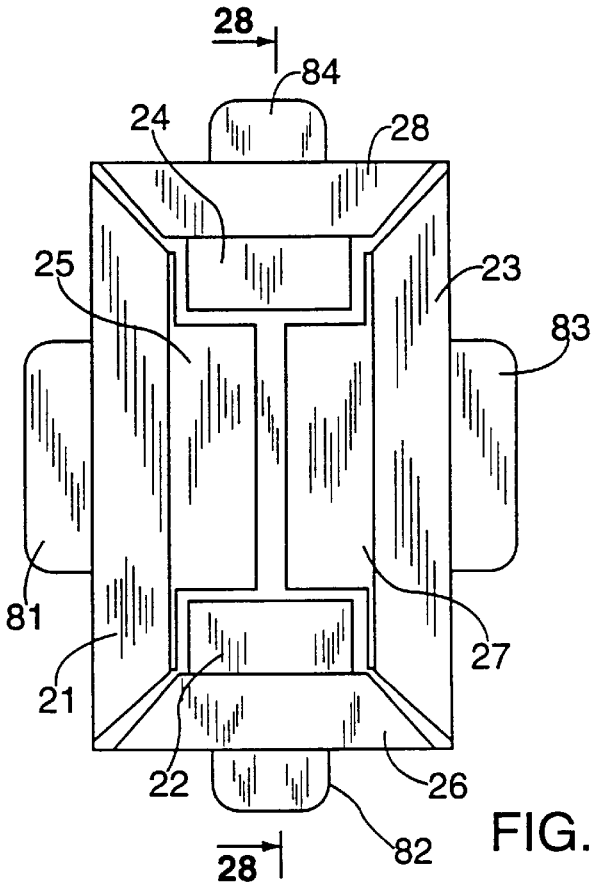
FIG. 27 is a plan view of the inside of the box cap shown in FIG. 26.
Figure 28:
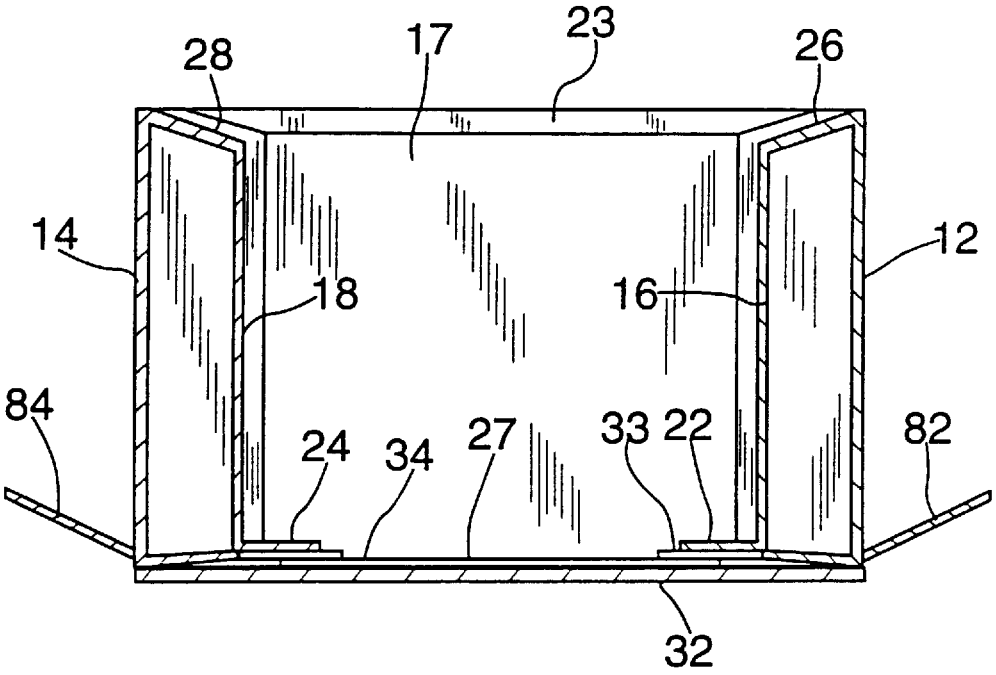
FIG. 28 is a cross-sectional view taken through the box cap of FIG. 26 in the plane indicated by and in the direction of the arrows 28—28 of FIG. 27.

FIGS. 26 to 28 show details of a box cap according to an embodiment of the invention. The box cap 10 has outer side panels 11 to 14 provided with associated inner side panels 15 to 18, respectively. The inner side panels are connected to and distanced from the respective outer side panels by distancing flaps 21, 26, 23 and 28. Connecting flaps 25, 22, 27 and 24 are provided for connecting the inner side panels 15, 16, 17 and 18 to outer end closing panels 31, 33, 32 and 34, respectively. The connecting flaps 25, 22, 27, and 24 are attached, for example by gluing, to the respective outer end closing panels 31, 33, 32 and 34.

Figure 29:
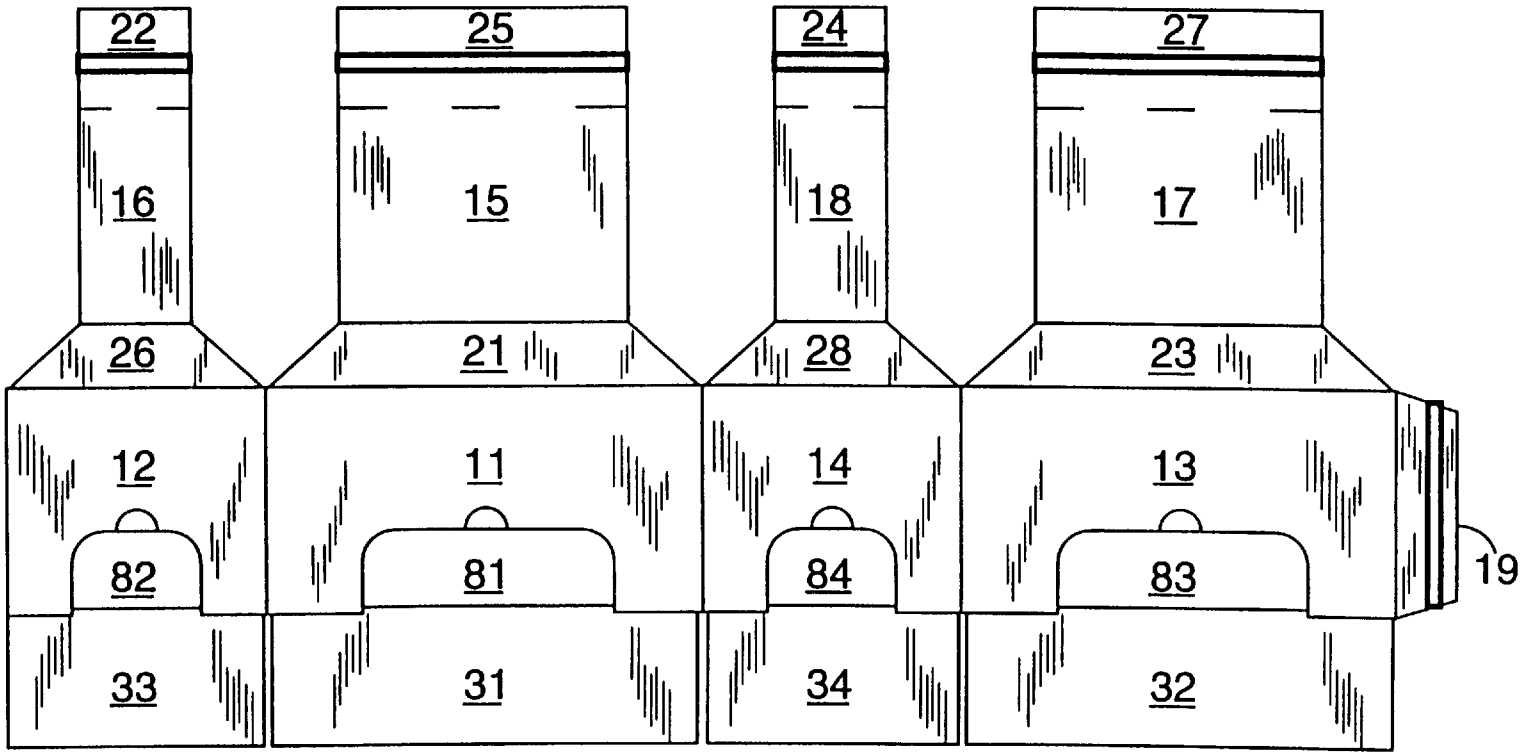
FIG. 29 is a view of a preform from which the box cap of FIG. 26 can be formed by folding and connecting the respective associated portions thereof.

The double panel construction in the box cap 10 operates in a similar manner to that previously described. When the end closing panels 31, 33, 32 and 34 are folded to the closed position, the respective inner panels 15, 16, 17 and 18 are moved toward the center of the box to a distanced position in which they are displaced from the adjacent outer side panel 11, 12, 13 and 14, respectively. It should be noted that the flaps 81 to 84 are formed from cutouts in the outer side panels 11 to 14, respectively, and are integral with the end closing panels 31, 33, 32, and 34, respectively, such that the end closing panels 31, 33, 32, and 34 can be moved to a closed position simultaneously with the movement of the flaps 81 to 84 away from and perpendicular to their respective side panels 11 to 14. The arrangement of the various parts of this box cap is shown in the preform view of FIG. 29.

Figure 30:
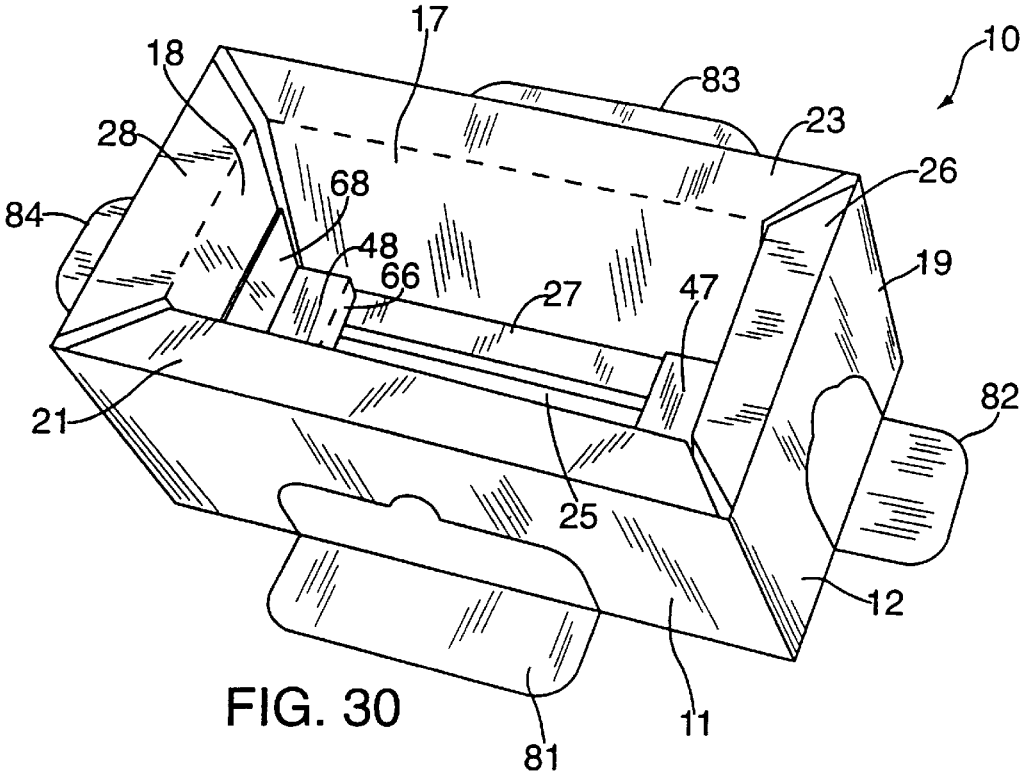
FIG. 30 is an inside perspective view of a box cap according to another embodiment of the present invention.
Figure 31:
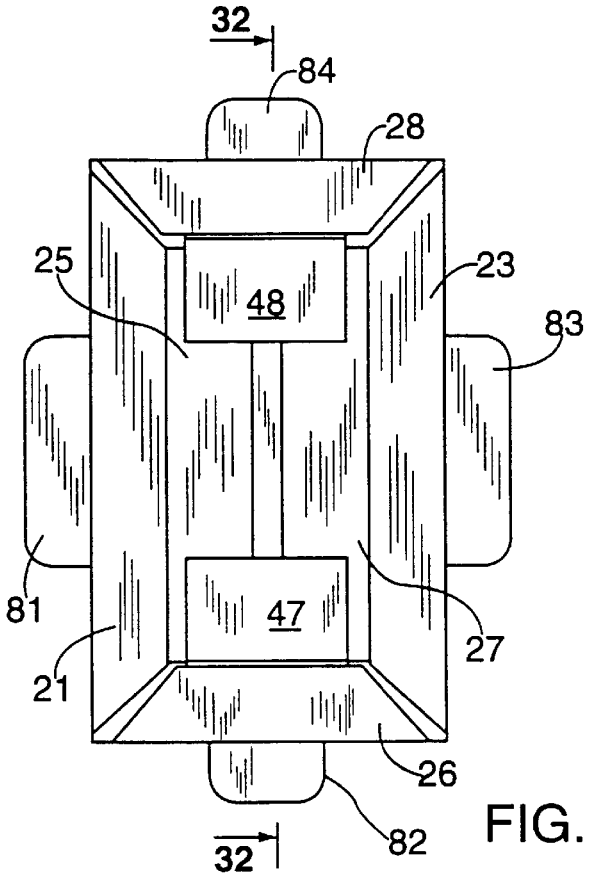
FIG. 31 is a plan view of the inside of the box cap shown in FIG. 30.
Figure 32:
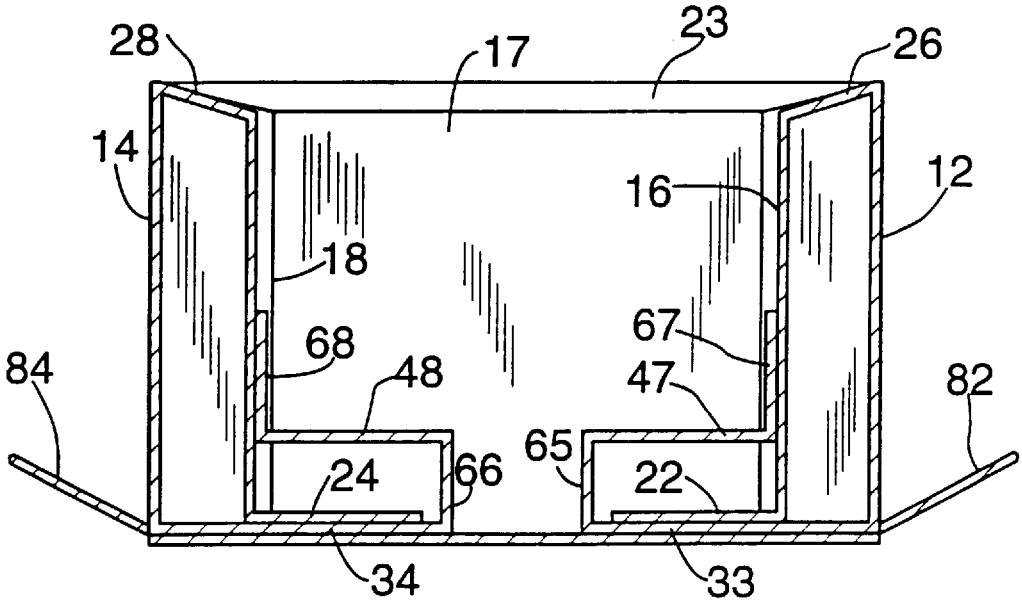
FIG. 32 is a cross-sectional view taken through the box cap of FIG. 30 in the plane indicated by and in the direction of the arrows 32—32 of FIG. 31.
Figure 33:
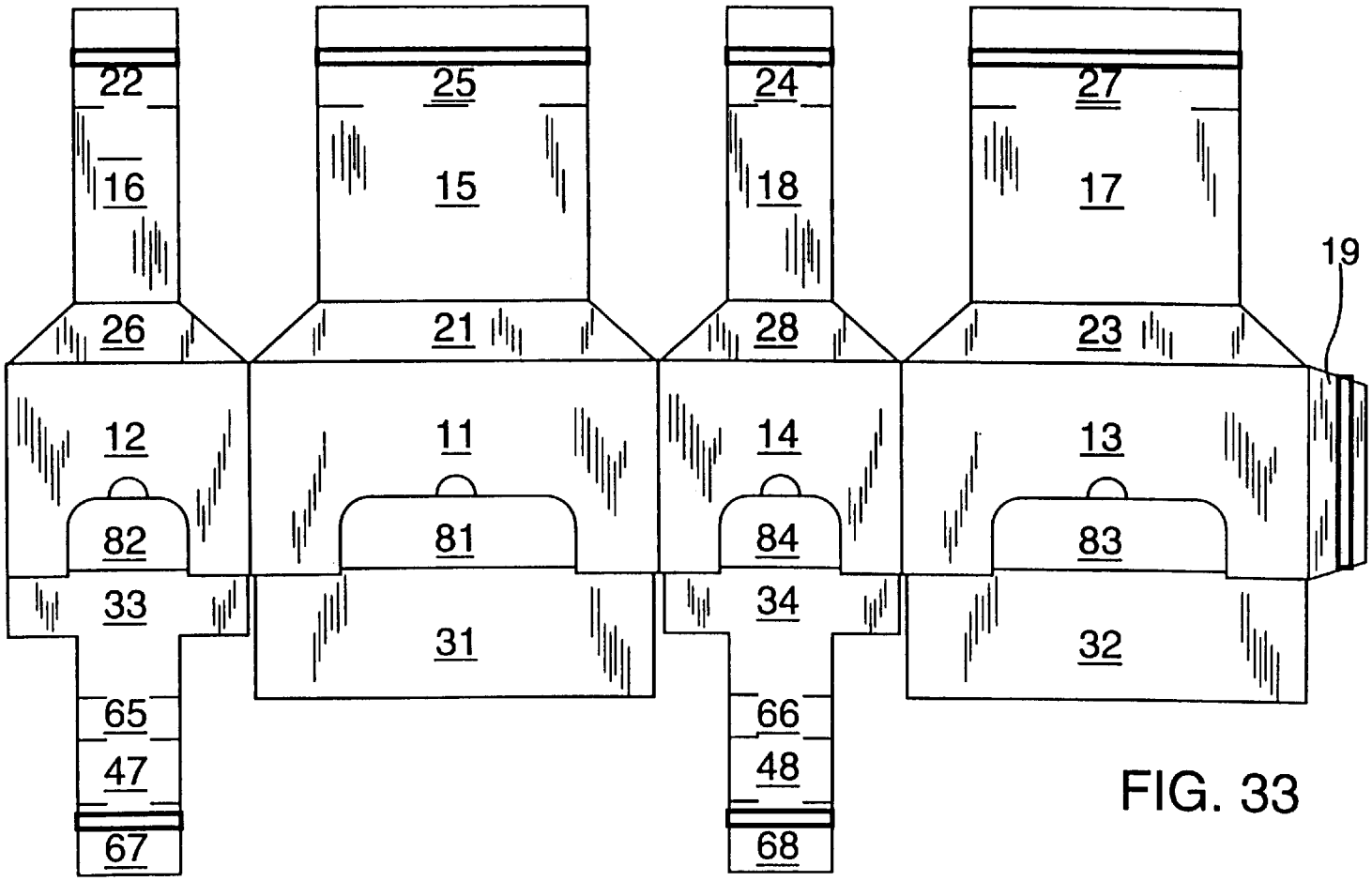
FIG. 33 is a view of a preform from which the box cap of FIG. 30 can be formed by folding and connecting the respective associated portions thereof.

FIGS. 30 to 32 show an alternate embodiment of a box cap 10 according to the invention. This embodiment is similar to that previously described, except that it has an additional double end panel construction. Thus, closing panel inner panels 47 and 48 are associated with outer closing panels 33 and 34, respectively. Distancing flaps 65 and 66 connect the closing panel inner panels 47 and 48, respectively, with the associated outer closing panels 33 and 34, and connecting flaps 67 and 68 connect the closing panel inner panels 47 and 48, respectively, with the adjacent inner side panels 16 and 18. These inner panels 47 and 48 are moved into their distanced positions by the closing of the outer closing panels 33 and 34 in a manner similar to that already described. A preform for constructing a box cap according to FIGS. 30 to 32 is shown in FIG. 33.

It should be appreciated that an inner panel in accordance with the invention may be parallel to its associated outer panel, as shown in the embodiments illustrated in FIGS. 1 to 33, but it need not be. The inner panel may alternatively be in a plane that lies at an angle with respect to its associated outer panel. The inner panel may additionally or alternatively have one or more bend lines separating it into more than one section.

Figure 34:
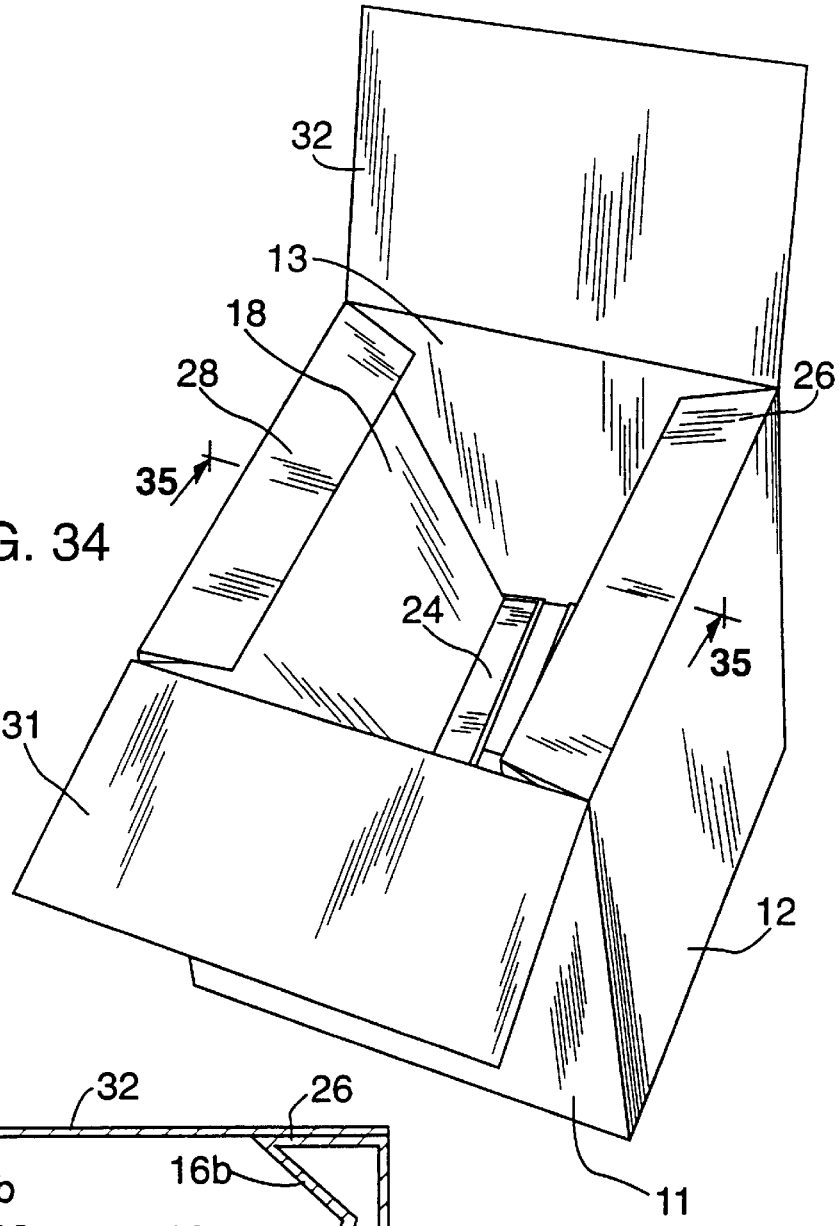
FIG. 34 is a front perspective view of another embodiment of a packaging box according to the present invention.
Figure 35:
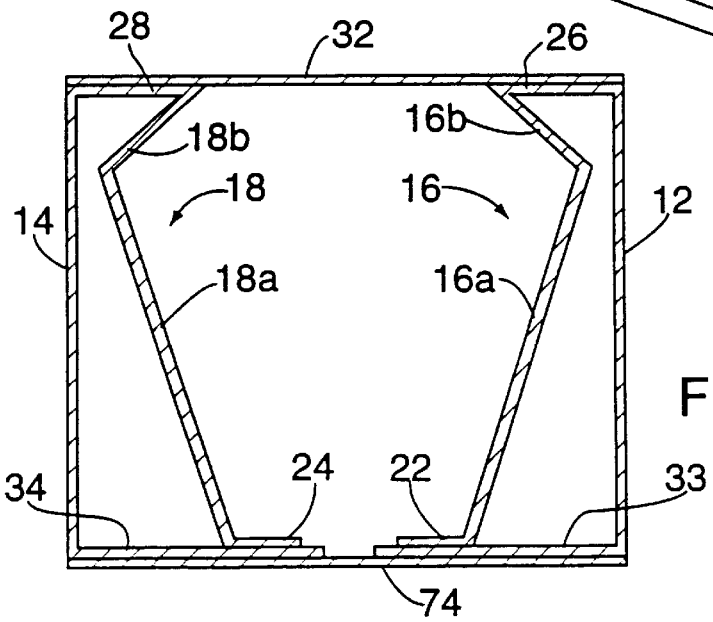
FIG. 35 is a cross-sectional view taken through the packaging box of FIG. 34, in a closed condition, in the plane indicated by and in the direction of the arrows 35—35 of FIG. 34.
Figure 36:
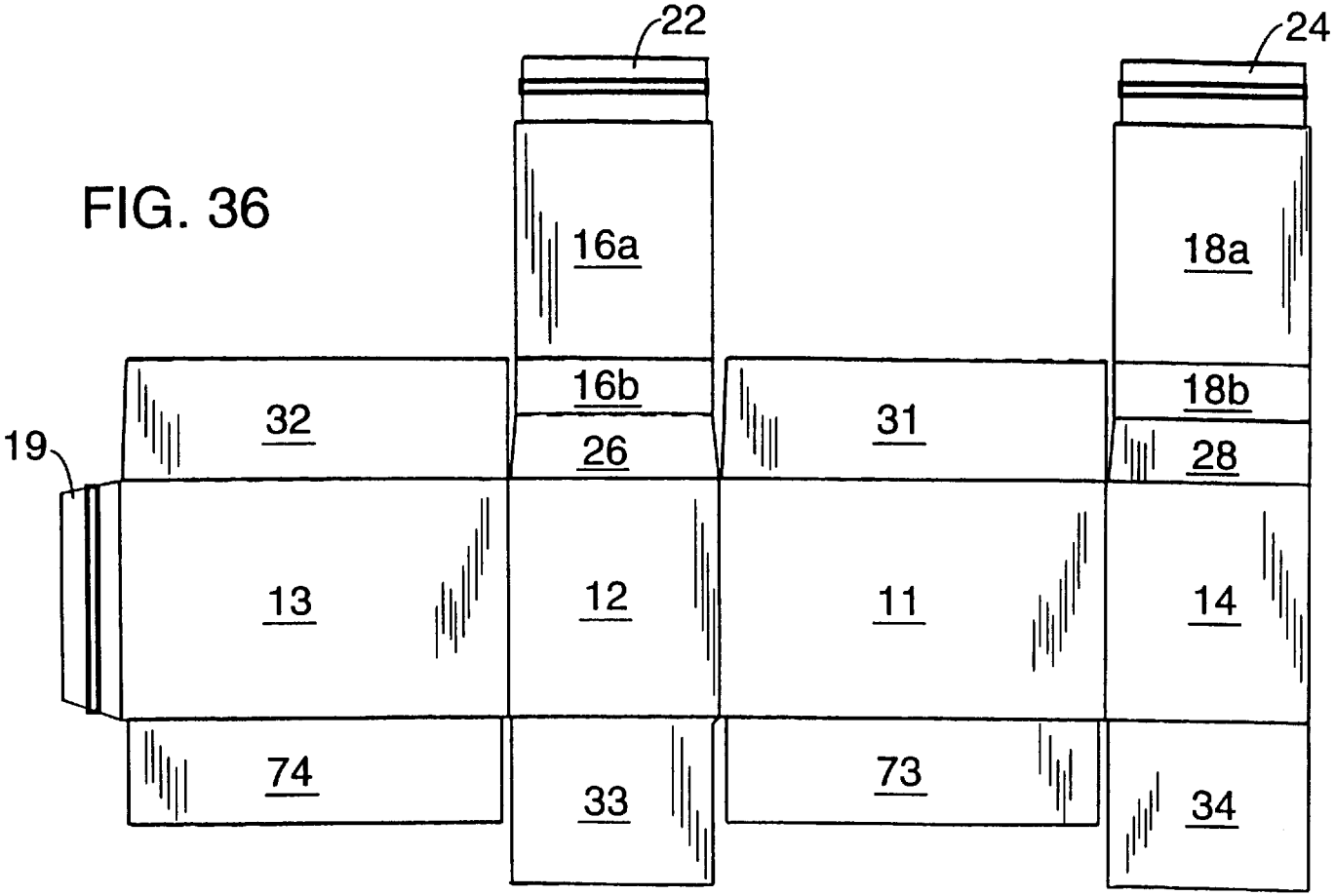
FIG. 36 is a view of a preform from which the packaging box of FIG. 34 can be formed by folding and connecting the respective associated portions thereof.
Figure 37:
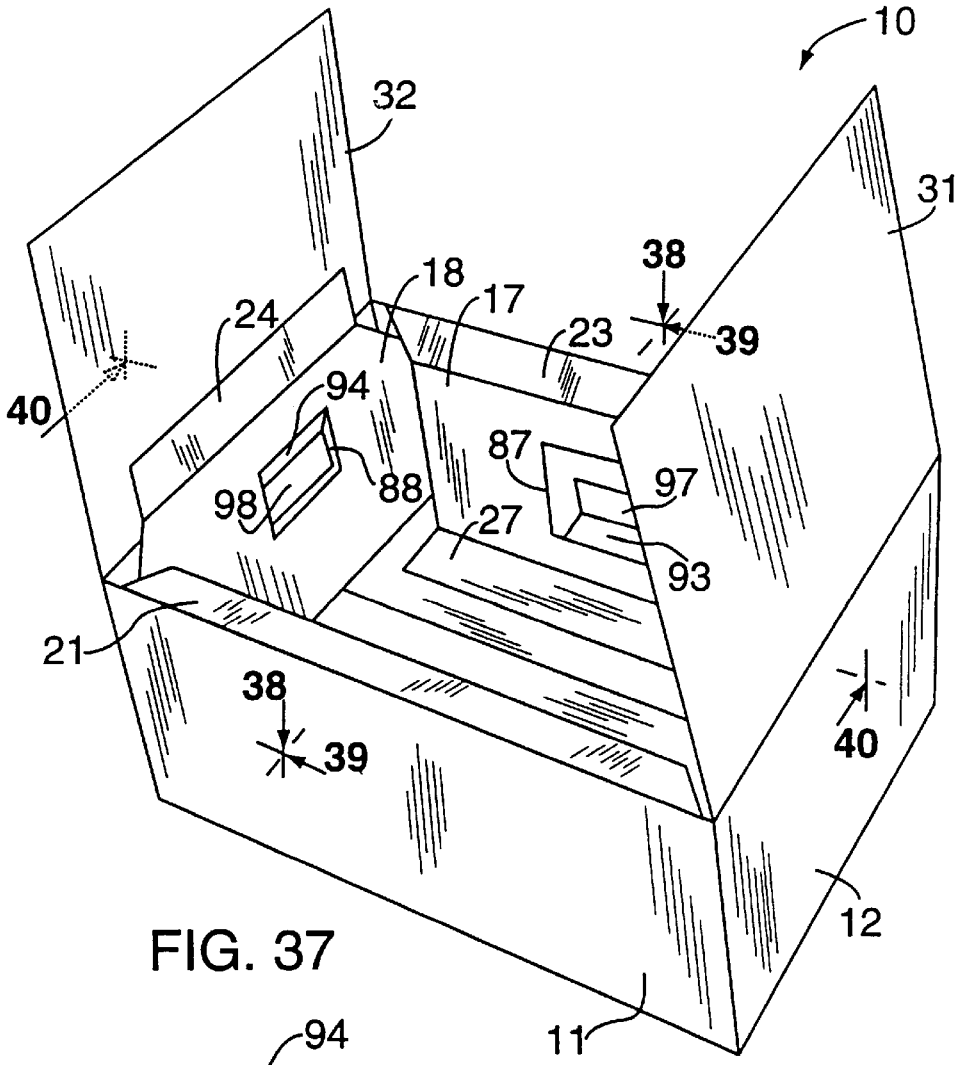
FIG. 37 is a front perspective view of another embodiment of a packaging box according to the present invention.
Figure 38:
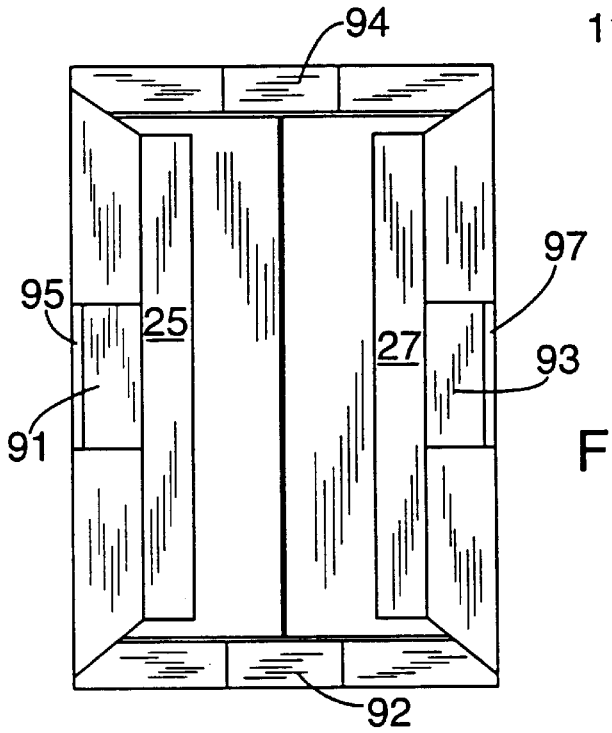
FIG. 38 is a cross-sectional view taken through the packaging box of FIG. 37, in a closed condition, in the plane indicated by and in the direction of the arrows 38—38 of FIG. 37.
Figure 39:
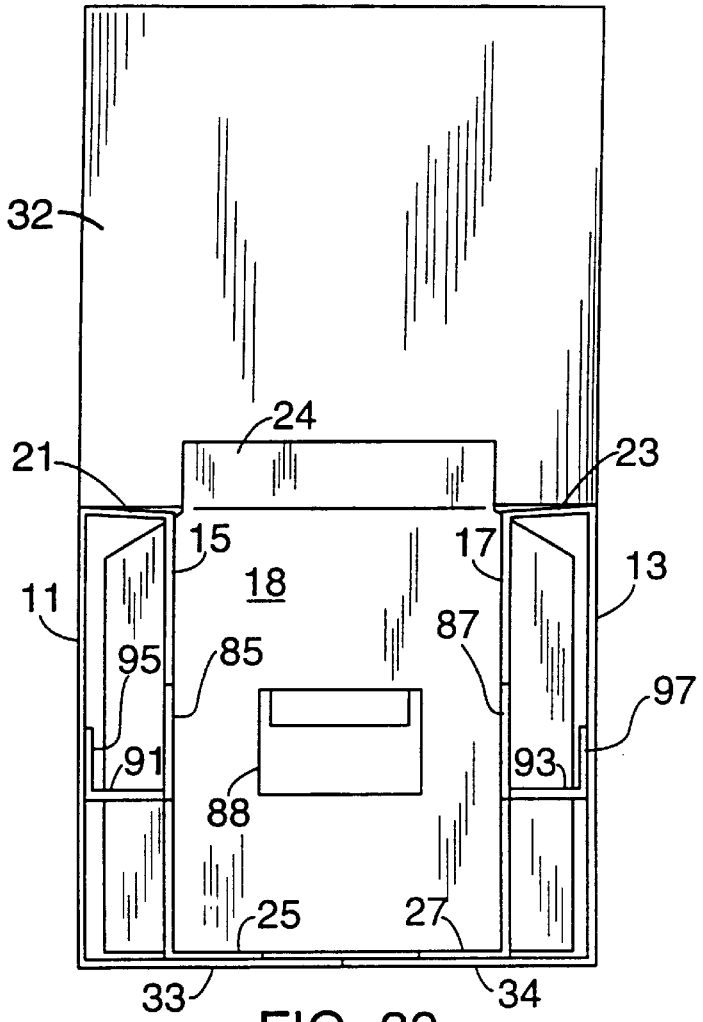
FIG. 39 is a cross-sectional view taken through the packaging box of FIG. 37, in a partially open condition, in the plane indicated by and in the direction of the arrows 39—39 of FIG. 37.
Figure 40:
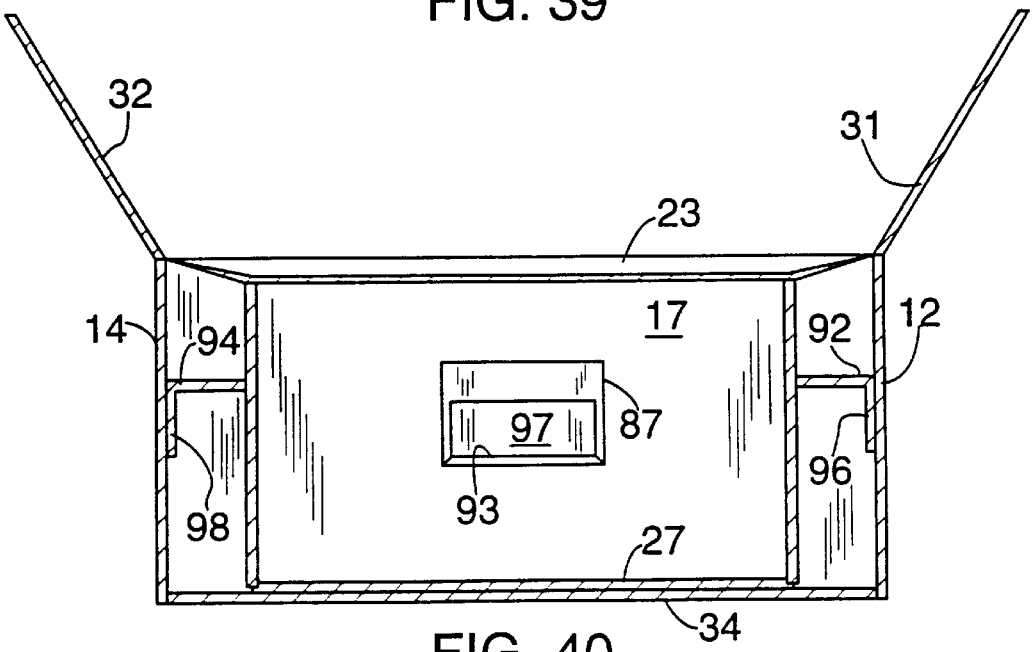
FIG. 40 is a cross-sectional view taken through the packaging box of FIG. 37, in a closed condition, in the plane indicated by and in the direction of the arrows 40—40 of FIG. 37.

Accordingly, FIGS. 34 and 35 illustrate an embodiment in which the inner panels 16, 18 are at angles with respect to their associated outer panels 12, 14. Each of the inner panels 16, 18 has a bend line separating it into two sections, 16*a* and 16*b*, and 18*a* and 18*b*. The operation of this embodiment is similar to that previously described. It should be noted that the illustrated box has additional outer closing panels 73 and 74, which can be seen in the preform view illustrated in FIG. 36.

Figure 41:
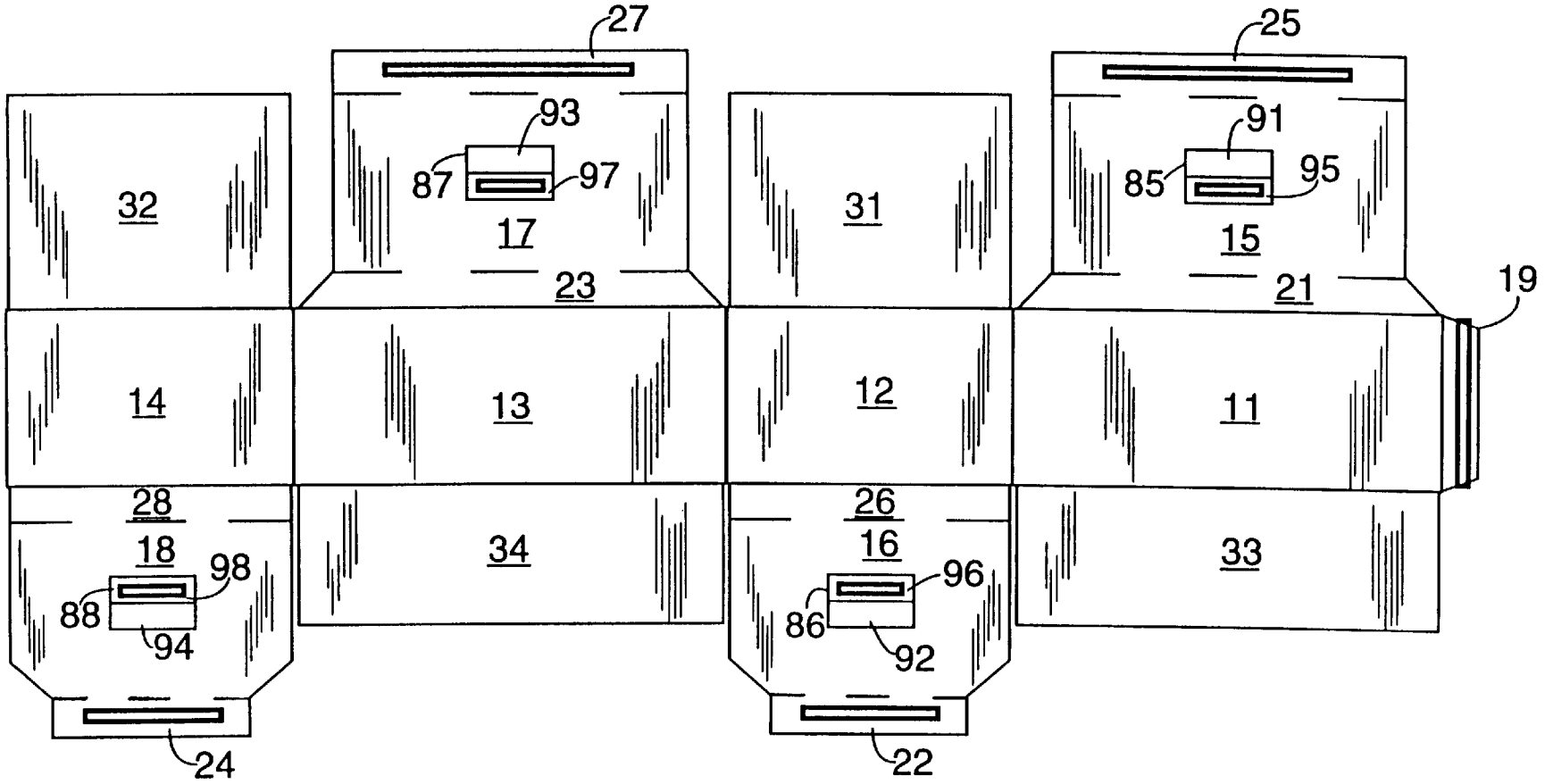
FIG. 41 is a view of a preform from which the packaging box of FIG. 37 can be formed by folding and connecting the respective associated portions thereof.

In accordance with further modifications possible within the scope of the invention, one or more cutouts may be provided in the inner panel(s) and/or distancing flap(s). The embodiment shown in FIGS. 37 to 40 corresponds in many respects to that shown in FIGS. 1 to 5. In this embodiment, however, cutouts 85 to 88 are provided in each of the inner side panels 15 to 18, and the material at each cutout is folded to provide a buttress flap 91 to 94 and buttress connecting flap 95 to 98 for providing further support for the inner panel. The buttress connecting flaps 95 to 98 are attached, for example by gluing, to the outer side panels 11 to 14, respectively. It will be appreciated that the buttress flaps 91 to 94 move in a manner similarly to the distancing flaps 21, 26, 23, and 28 when the outer closing panels 33, 31, 34, and 32 are moved into and between their open and closed positions. A preform for the box of FIGS. 37 to 40 is shown in FIG. 41.

Figure 44:
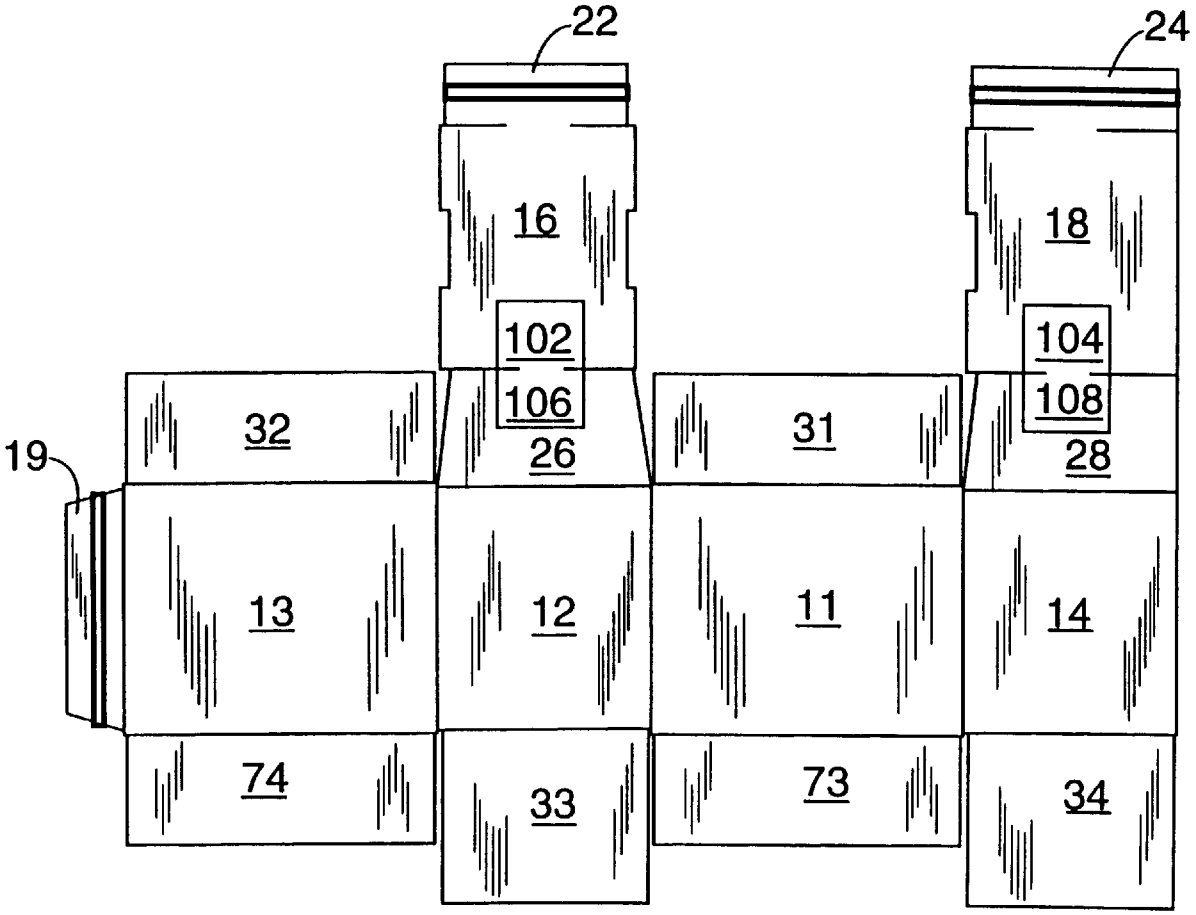
FIG. 44 is a view of a preform from which the packaging box of FIG. 42 can be formed by folding and connecting the respective associated portions thereof.
Figure 45:
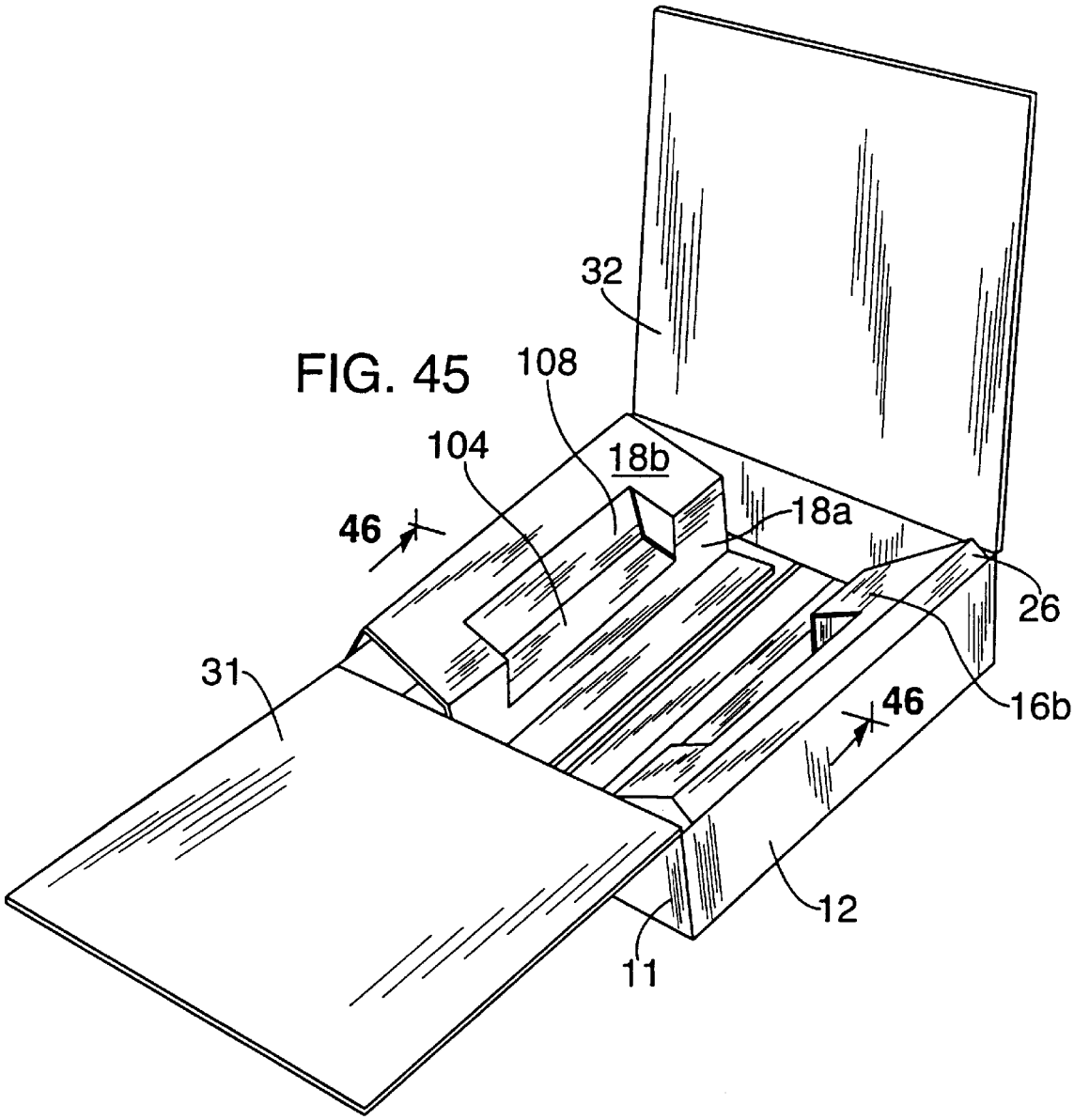
FIG. 45 is a front perspective view of another embodiment of a packaging box according to the present invention.
Figure 46:
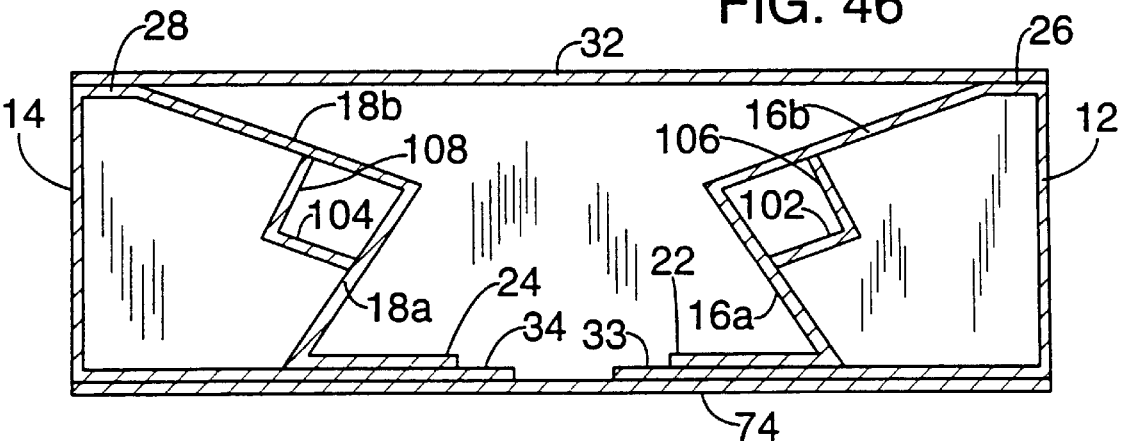
FIG. 46 is a cross-sectional view taken through the packaging box of FIG. 45, in a closed condition, in the plane indicated by and in the direction of the arrows 46—46 of FIG. 45.
Figure 47:
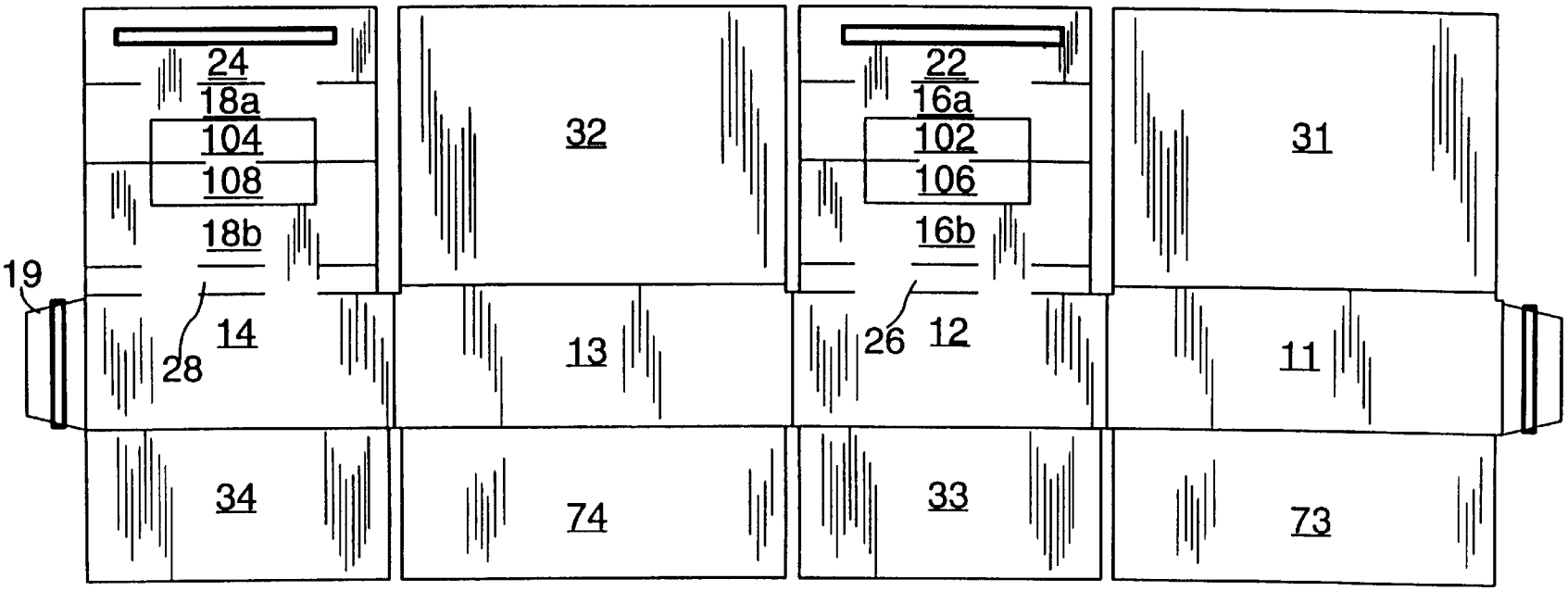
FIG. 47 is a view of a preform from which the packaging box of FIG. 45 can be formed by folding and connecting the respective associated portions thereof.

Cutouts may be utilized for other purposes. For example, as shown in the embodiment of FIGS. 42 and 43 (with a preform for this embodiment shown in FIG. 44), the material at the cutouts may be used as supporting flaps 102, 104, 106, 108 for supporting the goods to be shipped. This feature may be combined with other features previously described, for example, with an inner panel that is separated by one or more bend lines into a plurality of panels, as shown in the embodiment of FIGS. 45 and 46 (with the preform shown in FIG. 47). Such an embodiment may be used for particular items, such as electronic circuit boards.

Figure 48:
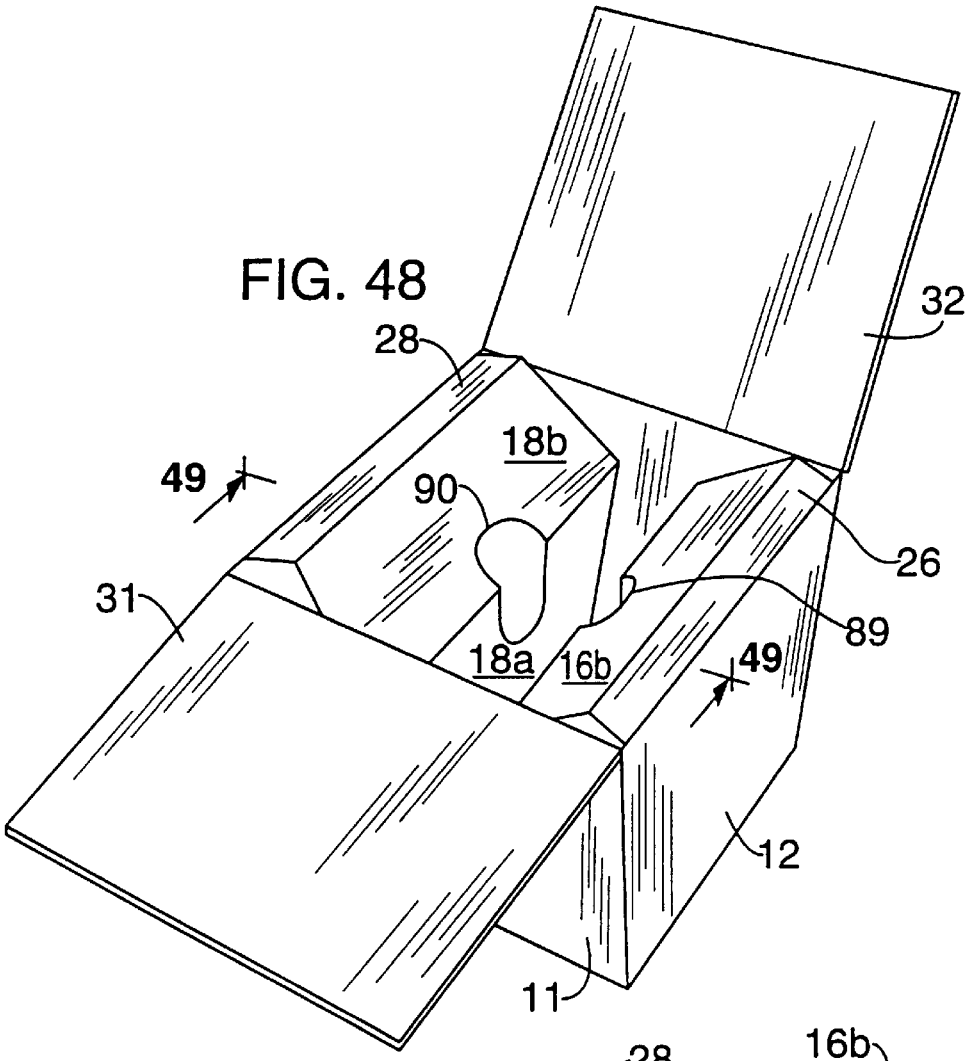
FIG. 48 is a front perspective view of another embodiment of a packaging box according to the present invention.
Figure 49:
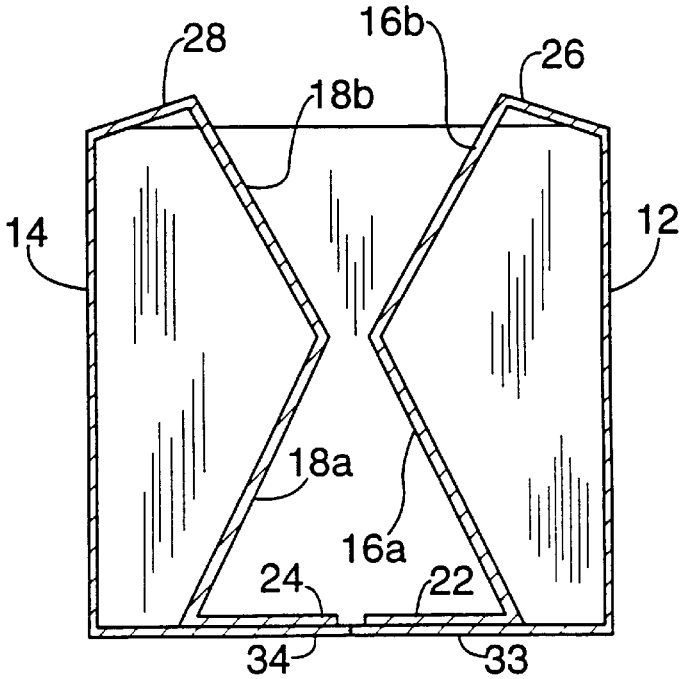
FIG. 49 is a cross-sectional view taken through the packaging box of FIG. 48, in a partially open condition, in the plane indicated by and in the direction of the arrows 49—49 of FIG. 48.
Figure 50:
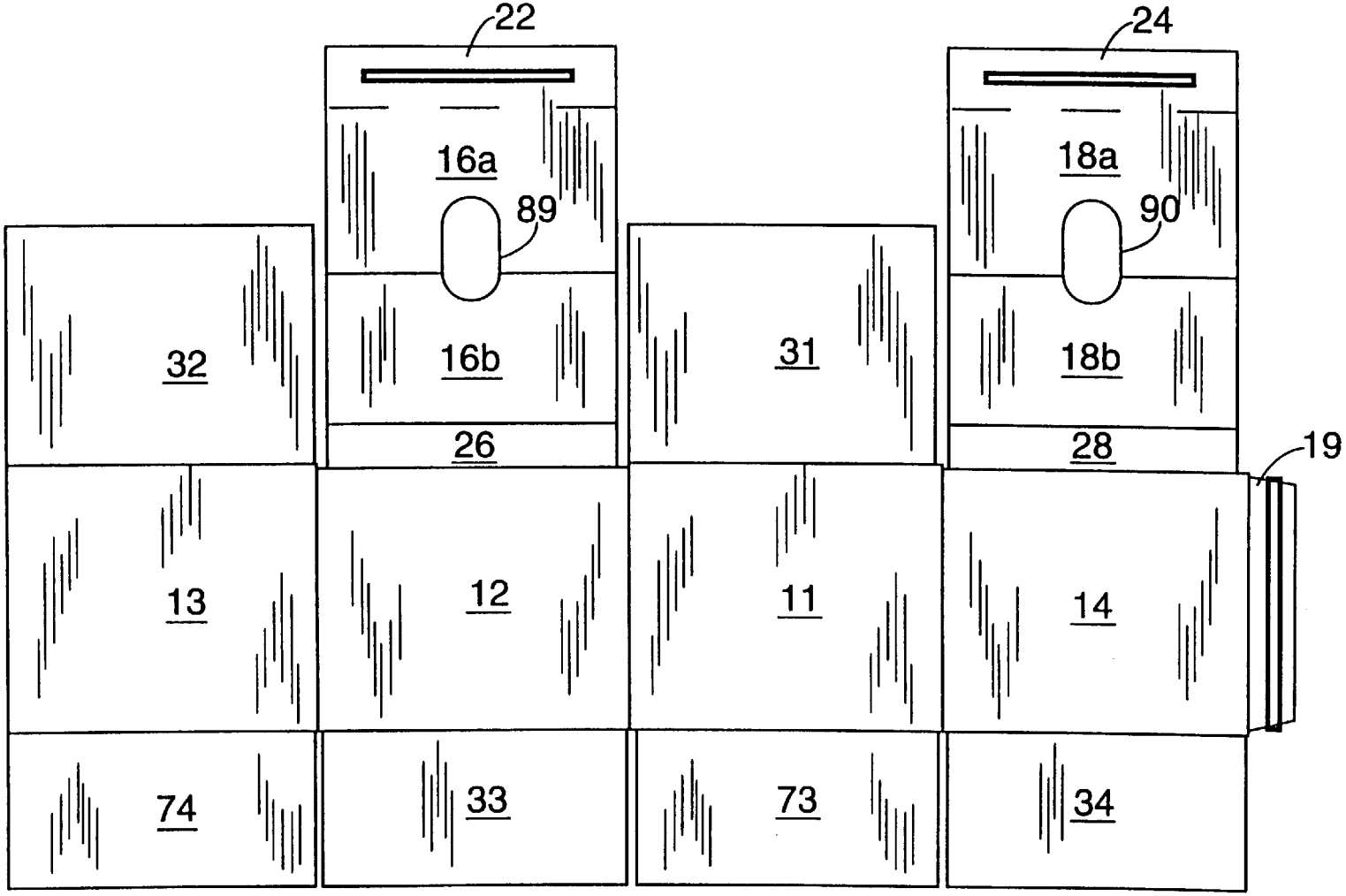
FIG. 50 is a view of a preform from which the packaging box of FIG. 48 can be formed by folding and connecting the respective associated portions thereof.

In other embodiments, such as that shown in FIGS. 48 and 49, the material at the cutouts 89, 90 may be taken away in its entirety, such that the cutout area itself, as bounded by the remainder of the inner panels 16, 18, provides support for the goods to be shipped. Such a construction may be useful for shipping items such as glass stemware or automobile headlights, for example. For multiple items, more than one cutout may be used. The preform view for the FIG. 48 embodiment is shown in FIG. 50.

In the embodiments described thus far, the inner panel and/or the distancing flap is connected to an outer closing panel such that the inner panel is moved to its distanced position in which it is displaced from an adjacent outer panel when the closing panel is closed. In other embodiments, an inner side panel may be provided with two distancing flaps that connect that inner side panel to an outer side panel. In such a case, the inner side panel is moved to its distanced position when one or more of the distancing flaps is folded relative to the outer panel.

Figure 51:
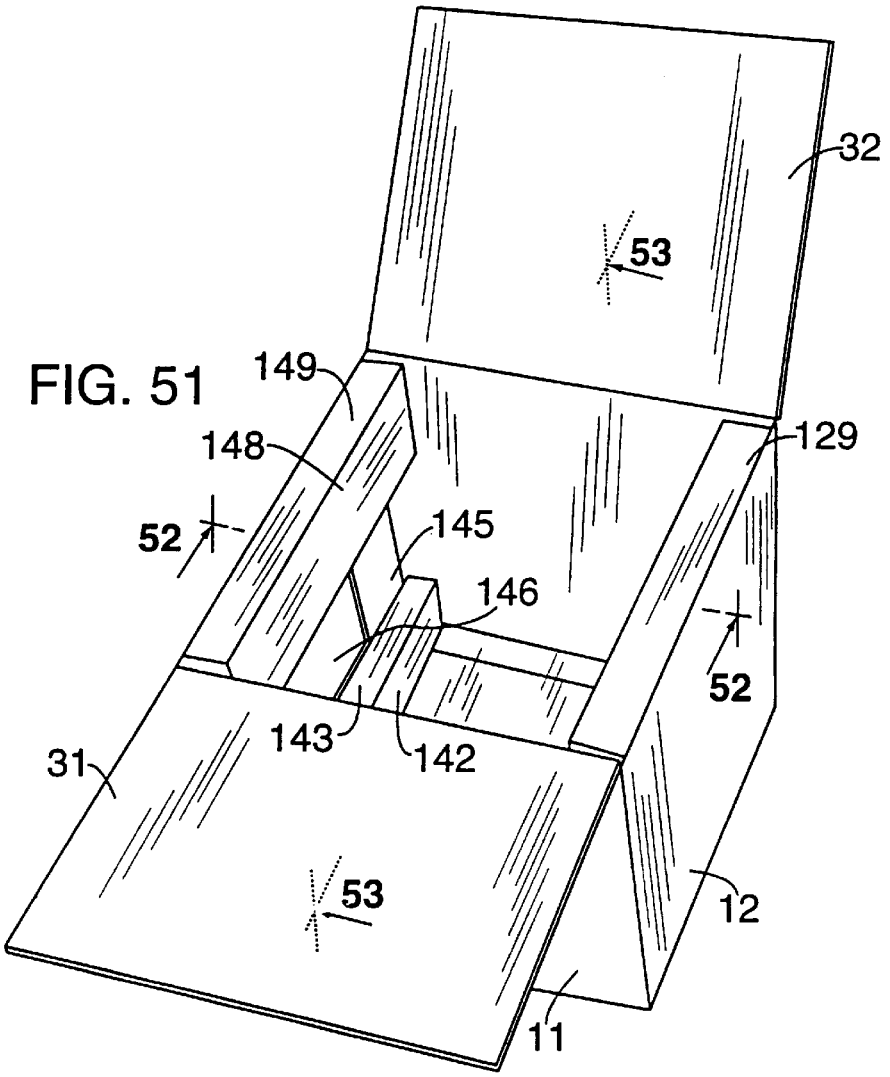
FIG. 51 is a front perspective view of another embodiment of a packaging box according to the present invention.
Figure 52:
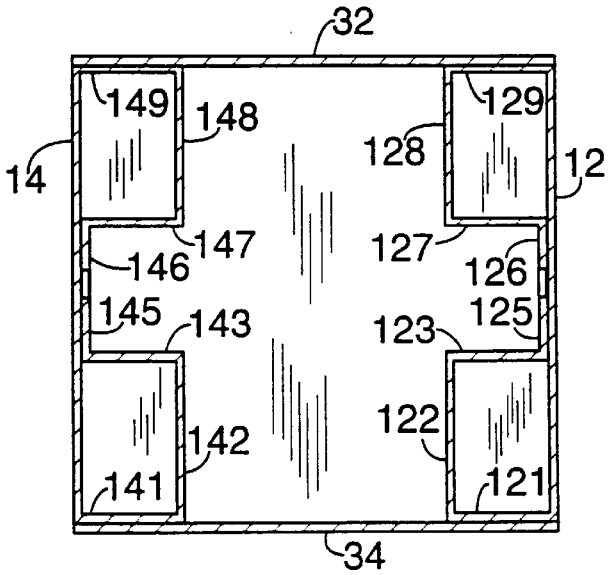
FIG. 52 is a cross-sectional view taken through the packaging box of FIG. 51, in a closed condition, in the plane indicated by and in the direction of the arrows 52—52 of FIG. 51.
Figure 53:
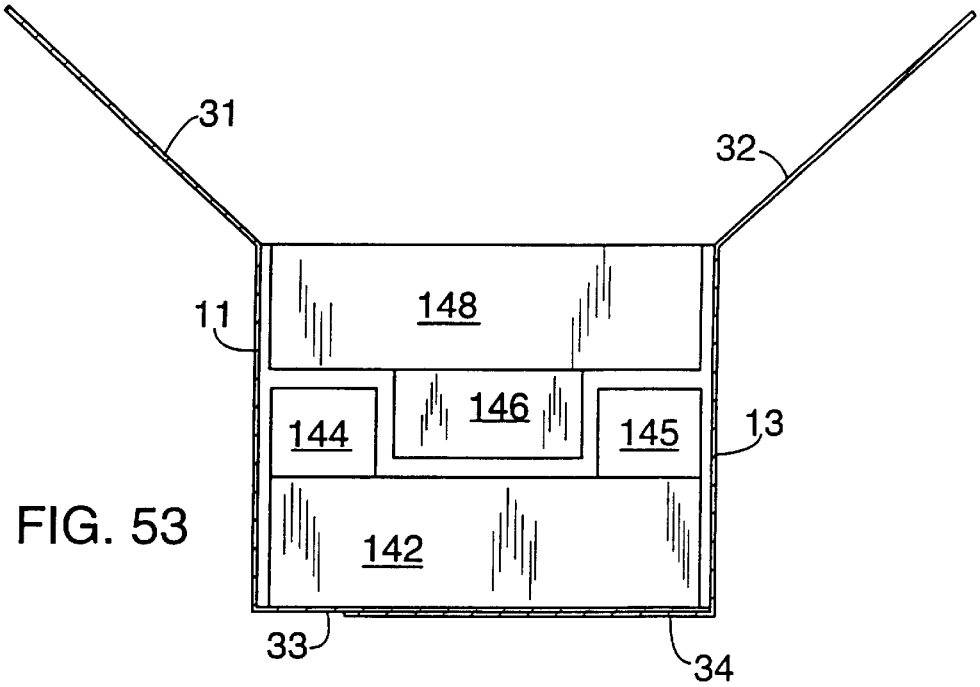
FIG. 53 is a cross-sectional view taken through the packaging box of FIG. 51, in the plane indicated by and in the direction of the arrows 53—53 of FIG. 51.
Figure 54:
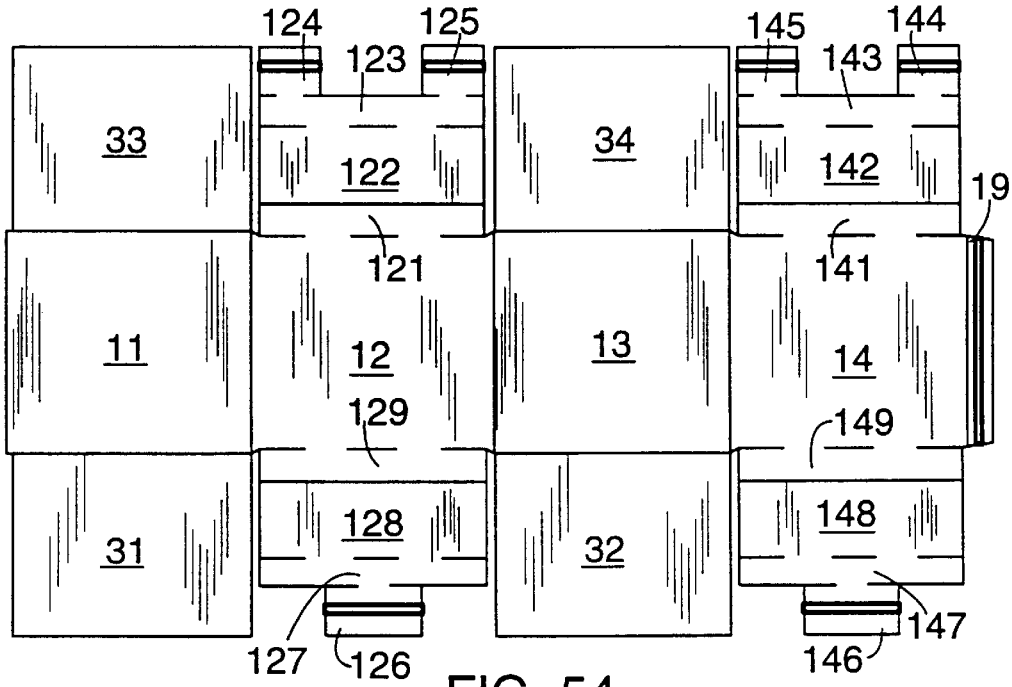
FIG. 54 is a view of a preform from which the packaging box of FIG. 51 can be formed by folding and connecting the respective associated portions thereof.
Figure 55:
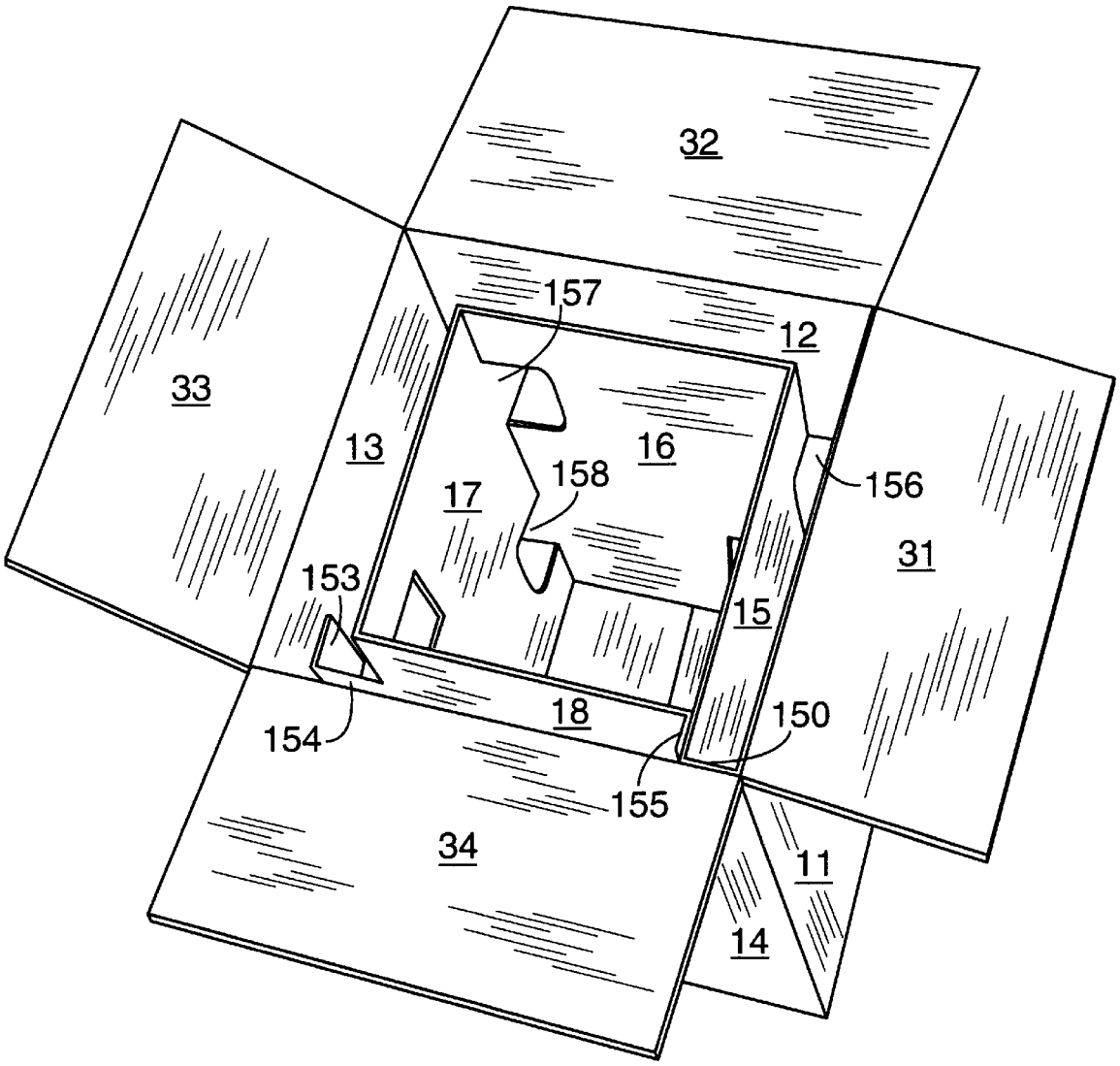
FIG. 55 is a front perspective view of another embodiment of a packaging box according to the present invention.
Figure 56:
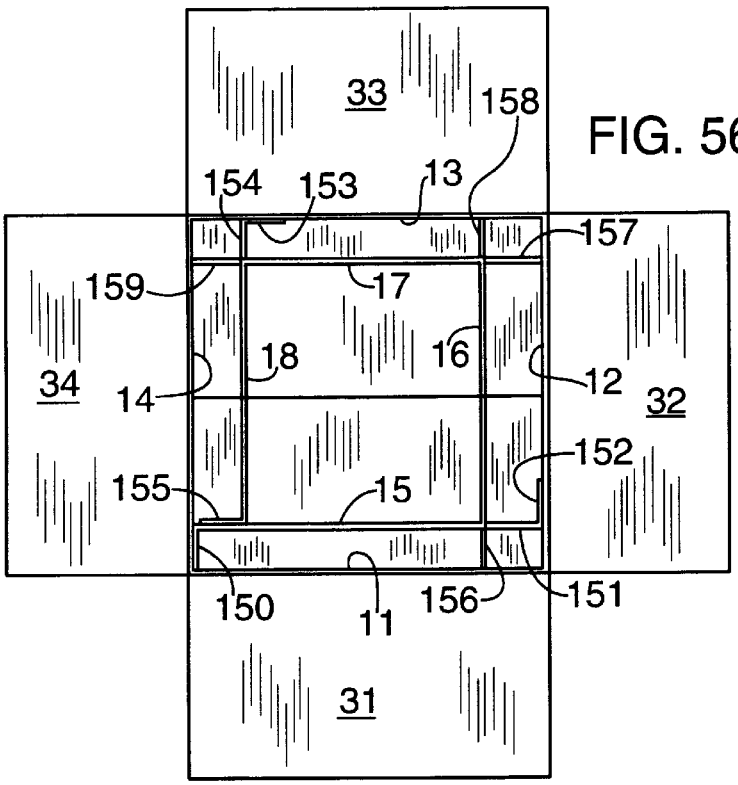
FIG. 56 is a top view of the packaging box of FIG. 55.
Figure 57:
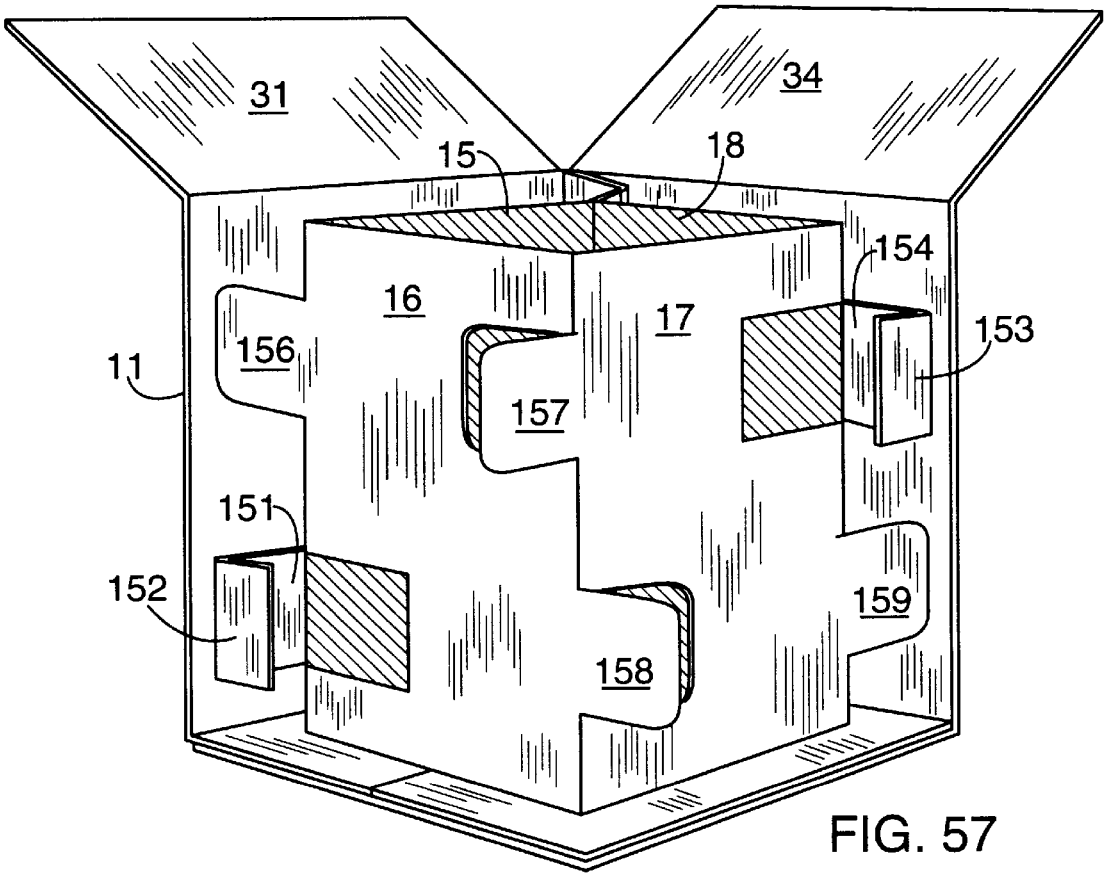
FIG. 57 is a perspective view of the packaging box of FIG. 55, with panels removed to show details of the inside of the box.
Figure 58:
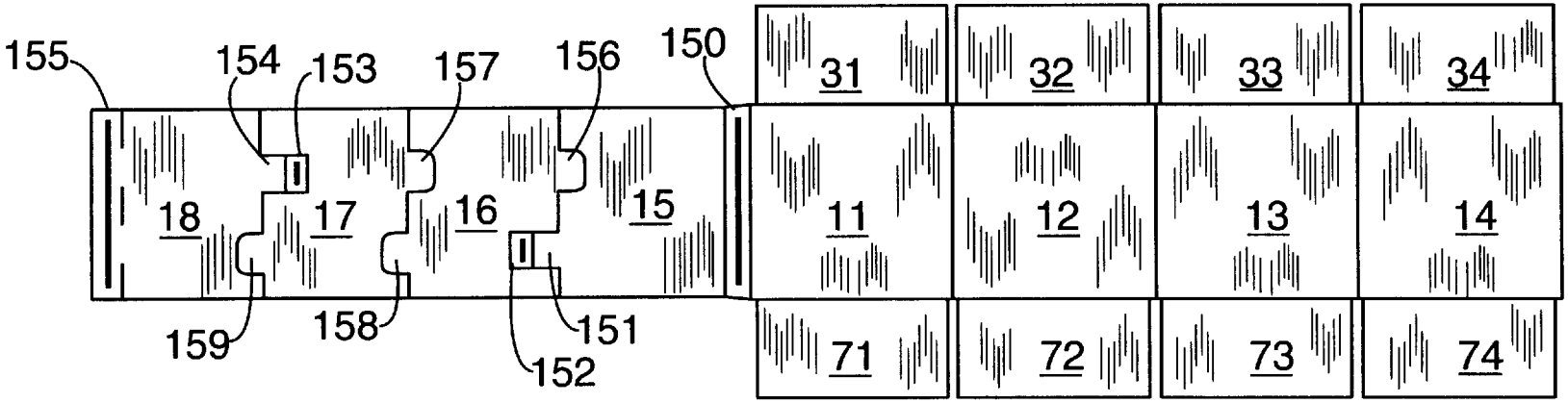
FIG. 58 is a view of a preform from which the packaging box of FIG. 55 can be formed by folding and connecting the respective associated portions thereof.
Figure 59:
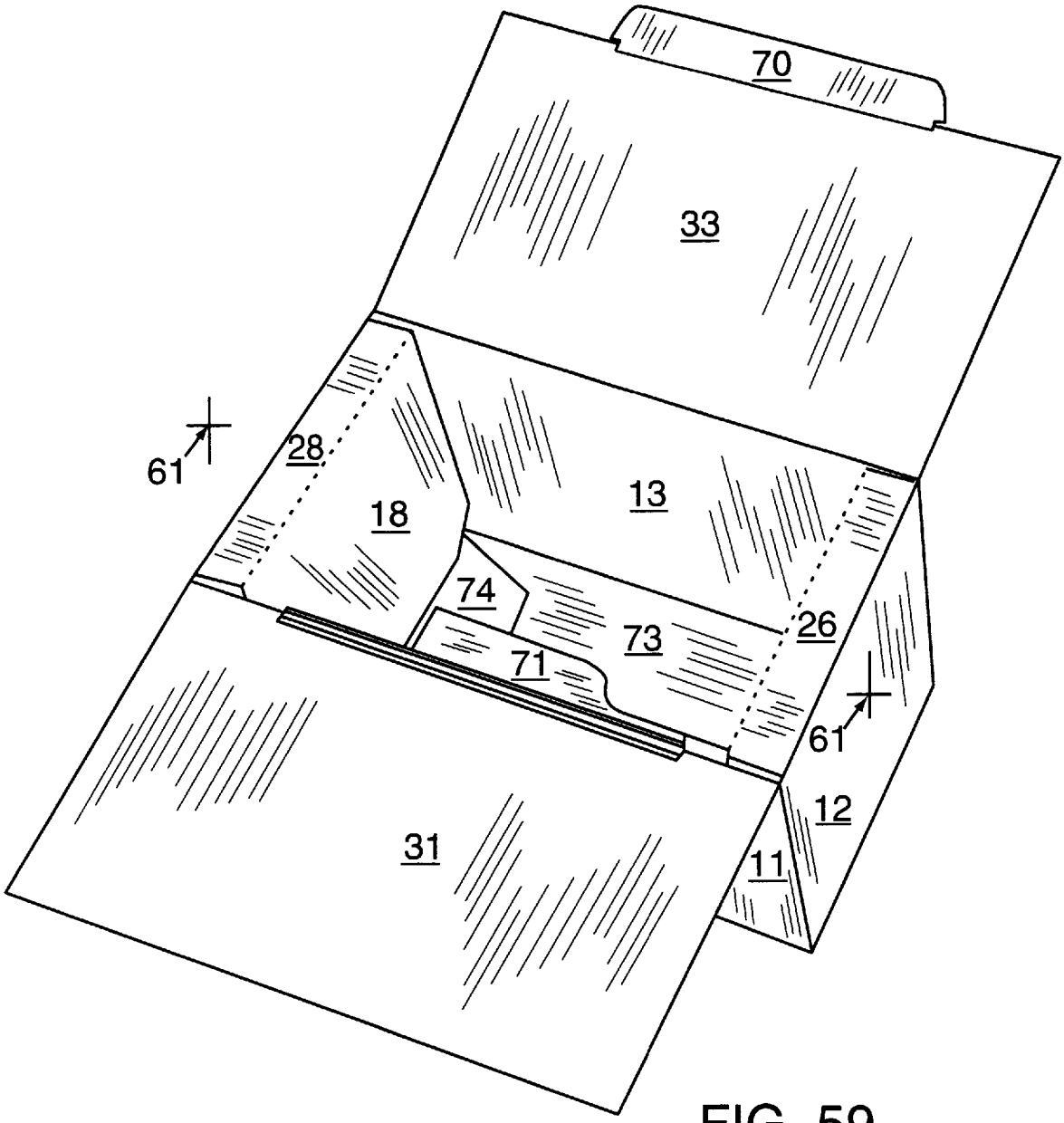
FIG. 59 is a front perspective view of another embodiment of a packaging box according to the present invention.
Figure 60:
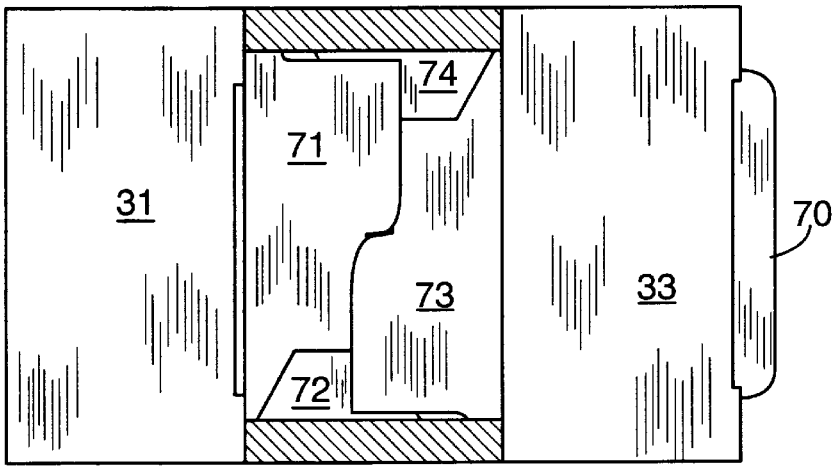
FIG. 60 is a top view of the packaging box of FIG. 59.
Figure 61:
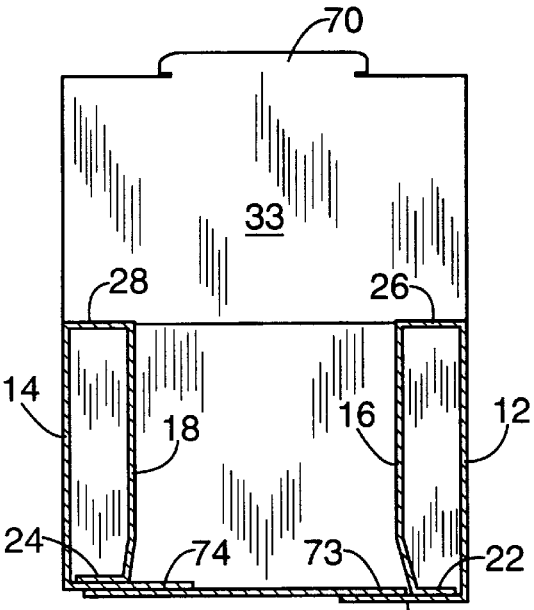
FIG. 61 is a cross-sectional view taken through the packaging box of FIG. 59, in the plane indicated by and in the direction of the arrows 61—61 of FIG. 59.
Figure 62:
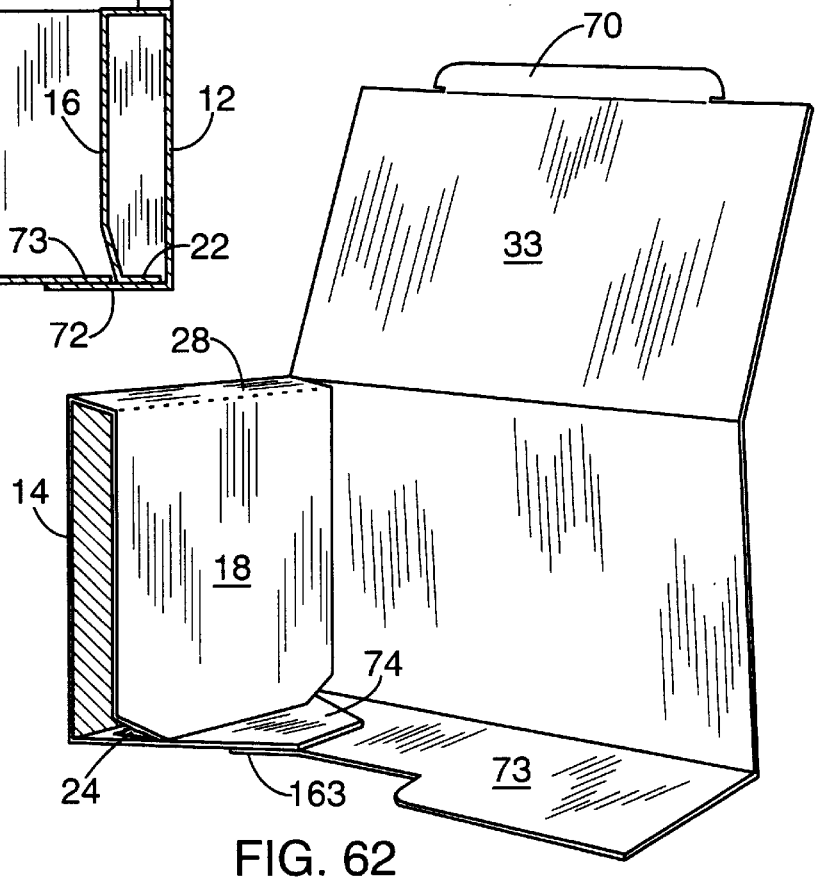
FIG. 62 is a perspective view of the packaging box of FIG. 59, with panels removed to show details of the inside of the box.
Figure 63:
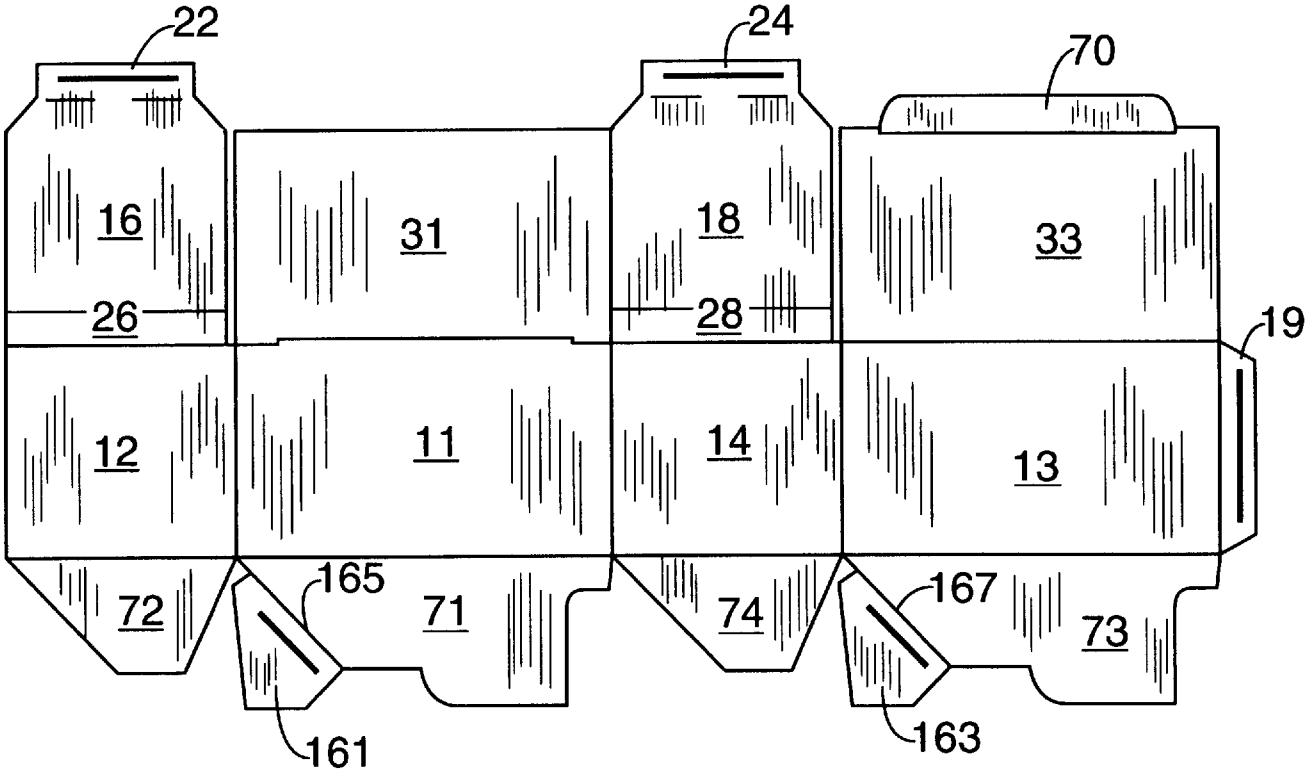
FIG. 63 is a view of a preform from which the packaging box of FIG. 59 can be formed by folding and connecting the respective associated portions thereof.
Figure 64:
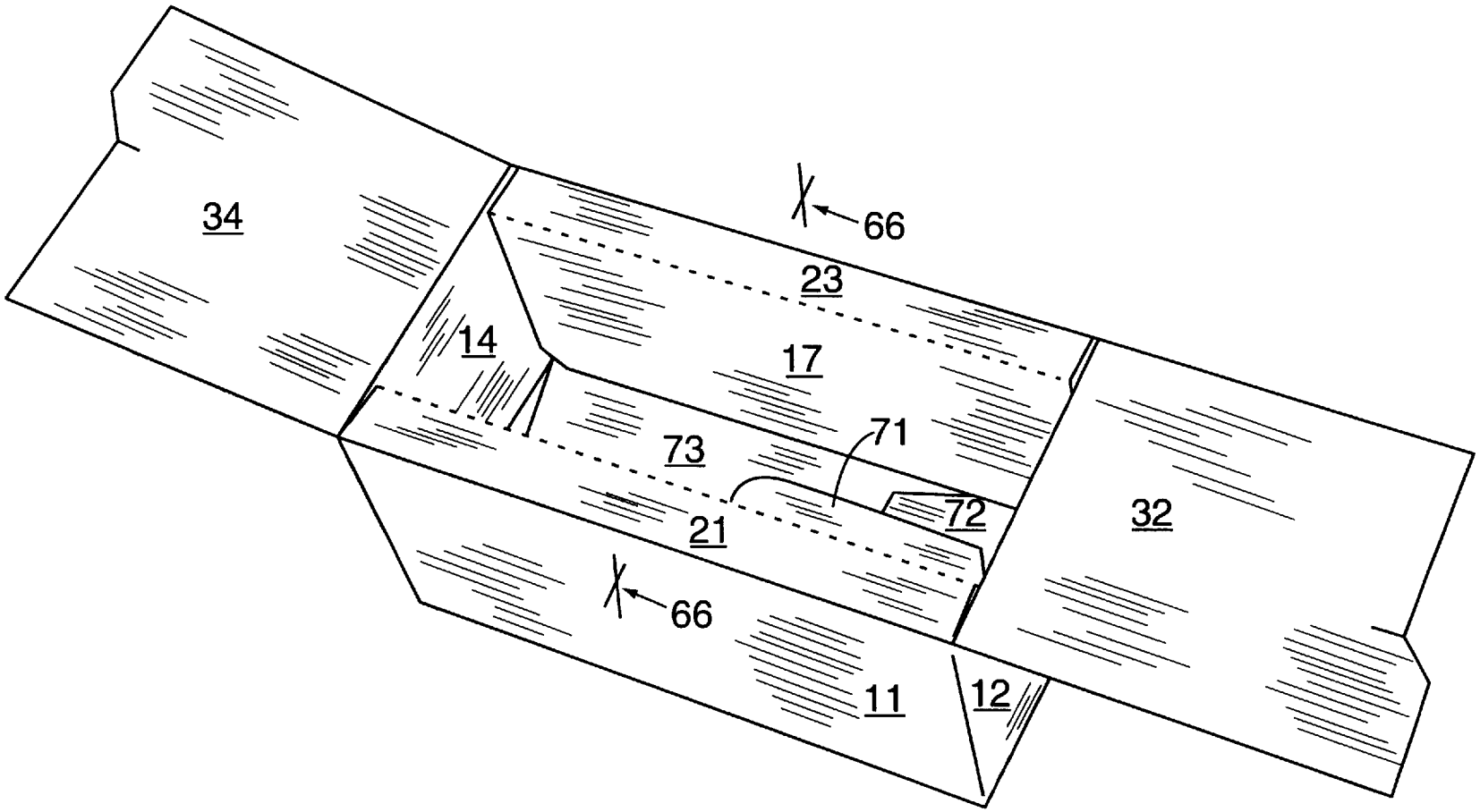
FIG. 64 is a front perspective view of another embodiment of a packaging box according to the present invention.
Figures 65, 66, 67:
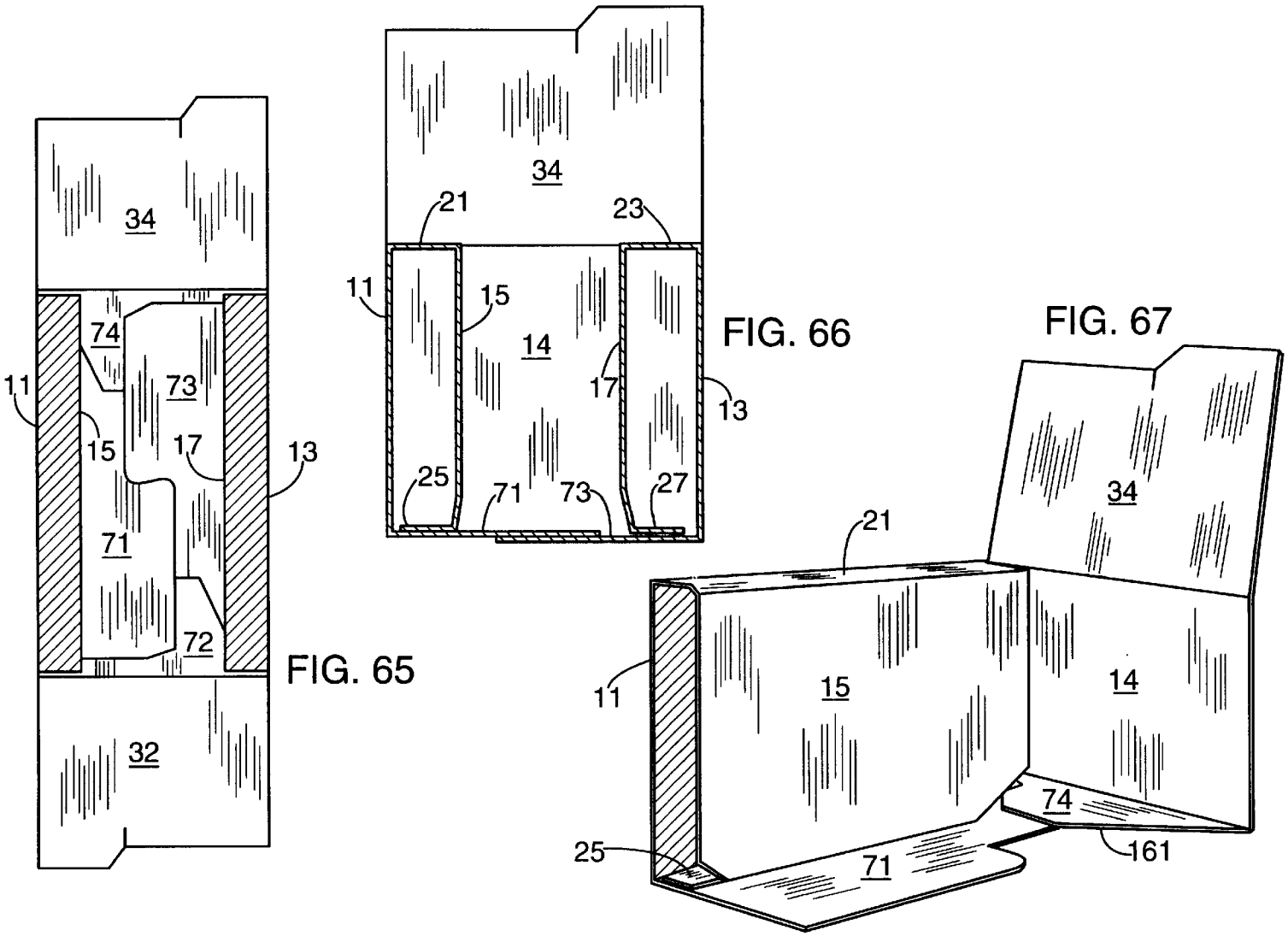
FIG. 65 is a top view of the packaging box of FIG. 64.
FIG. 66 is a cross-sectional view taken through the packaging box of FIG. 64, in the plane indicated by and in the direction of the arrows 66—66 of FIG. 64.
FIG. 67 is a perspective view of the packaging box of FIG. 64, with panels removed to show details of the inside of the box.
Figure 68:
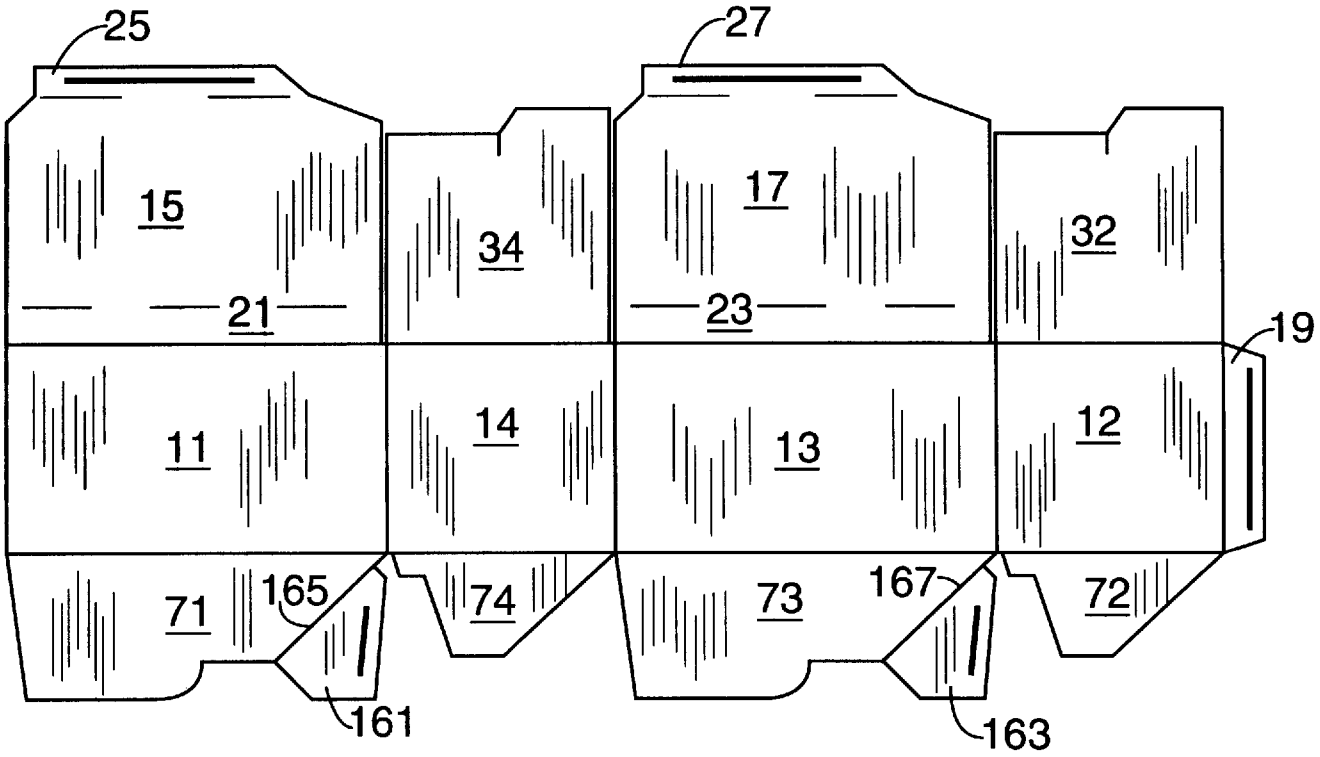
FIG. 68 is a view of a preform from which the packaging box of FIG. 64 can be formed by folding and connecting the respective associated portions thereof.

Such an embodiment is illustrated in FIGS. 51 to 53. Inner side panels 122, 128, 142, and 148 are provided in the illustrated embodiment. Inner side panel 122 has two associated distancing flaps 121, 123 that distance it from the associated outer side panel 12. Two connecting flaps 124, 125 connect the distancing flap 123 to the outer side panel 12. Inner side panel 128 similarly has two distancing flaps 127, 129 that distance it from the associated outer side panel 12. One connecting flap 126 connects the distancing flap 127 to the outer side panel 12. Inner side panel 142 with its associated distancing flaps 141, 143 and connecting flaps 144, 145 is similar in construction to inner side panel 122. Inner side panel 148 with its associated distancing flaps 147, 149 and connecting flap 146 is similar in construction to inner side panel 128. It will be appreciated that by folding the associated distancing flaps, each inner side panel in this embodiment may be alternately moved between a position in which lies flat against its associated outer side panel, with its respective distancing flaps substantially parallel to the outer side panel, and a distanced position in which it is displaced from its associated outer side panel, with its respective distancing flaps folded to be substantially perpendicular to the outer side panel.

In alternative embodiments the box may be configured such that after the box is cut and glued, erecting the box from its collapsed flat position by movement of the outer side panels automatically causes the inner side panels to be moved toward the center of the box. In the embodiment illustrated in FIGS. 55 to 58, for example, when the box is moved from the collapsed flat condition to a condition in which the adjacent outer side panels are at substantially right angles to one another, i.e., when the box is erected from a collapsed flat condition to a condition in which the outer side panels form a rectangle so as to bound an internal space, the inner side panels automatically move to their activated positions.

The box shown in FIGS. 55 to 58 comprises a plurality of outer side panels 11 to 14 and a plurality of associated inner side panels 15 to 18. The inner side panels 15 to 18 are connected to the outer side panels 11 to 14 by a plurality of connecting flaps 150, 152, 153, 155. In the illustrated example, three connecting flaps 150, 152 and 153 are shown connected to the outer side panels, and one connecting flap 155 is shown connected to inner side panel 15. The connecting flaps may extend the entire length of the respective inner side panel, as in connecting flaps 150 and 155, or over only a portion of the respective inner side panel, as in connecting flaps 152 and 153. The connecting flaps may have associated bracing extensions for bracing an inner side panel against a respective outer side panel. Thus, for example, in the illustrated embodiment, the connecting flaps 152 and 153 are attached to bracing extensions 151 and 154, respectively. Additional bracing extensions 156 to 159 may be provided, with or without associated connecting flaps.

When the box shown in FIGS. 55 to 58 is cut and glued, it can be folded in a manner such that it can lie substantially flat, with the corresponding inner side panels lying flat against their adjacent outer side panels, without the need for any ungluing or unstapling. When the box is moved to its erected condition so that the outer side panels form a rectangle, the inner side panels remain parallel to their adjacent outer side panels, but are distanced away from them. Thus, simply by moving the outer side panels to a condition in which the outer side panels form a rectangle, the inner side panels automatically are moved toward the center of the box to a distanced position in which they are then displaced from their respective adjacent outer side panels.

Other embodiments are possible in which the inner side panels are automatically moved toward the center of the box when the box is erected from a collapsed flat condition. This may be in conjunction with outer closing panels additionally and simultaneously being automatically put into their operative closed positions when the box is erected from a collapsed flat condition. The box shown in FIGS. 59 to 63 illustrates such an embodiment.

The box shown in FIGS. 59 to 63 comprises a plurality of outer side panels 11 to 14 and two inner side panels 16 and 18 associated with the outer side panels 12 and 14, respectively. The inner side panels 16 and 18 are similar to inner side panels described above. In the erected condition of the box, they are spaced from the associated outer side panels 12 and 14 by distancing flaps 26 and 28 and/or connecting flaps 22 and 24. The connecting flaps 22 and 24 are connected to outer closing panels 72 and 74, respectively.

In this embodiment, outer closing panel 71 and adjacent outer closing panel 72 are attached to each other, for example, by gluing outer closing panel flap 161 to outer closing panel 72. Outer closing panel flap 161 is foldable with respect to the rest of outer closing panel 71 at a fold line 165. Outer closing panel 73 is similarly attached to adjacent outer closing panel 74 by gluing outer closing panel flap 163 to outer closing panel 74. Again, outer closing panel flap 163 is foldable with respect to the rest of outer closing panel 73 at a fold line 167.

When the box of FIGS. 59 to 63 is cut and glued, it can be collapsed substantially flat. In the collapsed position, the outer closing panels 71 to 74 are folded to the inside of the box, such that each lies substantially parallel to its associated outer side panel 11 to 14, respectively. In this embodiment, when the box is collapsed flat, each of the outer closing panels 71 to 74 lies substantially flat against its associated outer side panel 11 to 14, respectively. In the illustrated embodiment, moving the outer side panels 11 to 14 into the position of a rectangle automatically pulls the outer closing panels 71 to 74 from the inside of the box into their closed positions in which they form the bottom of the box. Because of the connection of the inner side panels 16 and 18 to the outer closing panels 72 and 74, when the movement of the outer side panels automatically folds the outer closing panels 72 and 74 to their closed positions, the inner side panels 16 and 18 are likewise automatically moved toward the center of the box to the distanced position in which they are displaced from their adjacent outer side panels 12 and 14. Thus, simply moving the outer side panels from a collapsed flat condition to an erected condition automatically folds the outer closing panels into their closed position (e.g., to form a bottom of the box) and the inner side panels toward the center of the box into their distanced positions.

A similar embodiment is shown in FIGS. 64 to 68. The box shown in FIGS. 64 to 68 comprises a plurality of outer side panels 11 to 14 and two inner side panels 15 and 17 associated with the outer side panels 11 and 13, respectively. The inner side panels 15 and 17 are similar to inner side panels described above. In the erected condition of the box, they are spaced from the associated outer side panels 11 and 13 by distancing flaps 21 and 23 and/or connecting flaps 25 and 27. The connecting flaps 25 and 27 are connected to outer closing panels 71 and 73, respectively.

Outer closing panel 71 and adjacent outer closing panel 74 are attached to each other, for example, by gluing outer closing panel flap 161 to outer closing panel 74. Outer closing panel flap 161 is foldable with respect to the rest of outer closing panel 71 at a fold line 165. Outer closing panel 73 is similarly attached to adjacent outer closing panel 72 by gluing outer closing panel flap 163 to outer closing panel 72. Again, outer closing panel flap 163 is foldable with respect to the rest of outer closing panel 73 at a fold line 167.

As in the previous embodiment, when the box of FIGS. 64 to 68 is cut and glued, it can be collapsed substantially flat. In the collapsed position, the outer closing panels 71 to 74 are folded to the inside of the box, such that each lies substantially parallel to and flat against its associated outer side panel 11 to 14. Moving the outer side panels 11 to 14 into the position of a rectangle automatically pulls the outer closing panels 71 to 74 from the inside of the box into their closed positions to form the bottom of the box. Because the inner side panels 15 and 17 are connected to the outer closing panels 71 and 73, when the outer side panels 11 to 14 are moved into the position of a rectangle, not only are the outer closing panels 71 to 74 automatically folded to their closed positions, but the inner side panels 15 and 17 are also automatically moved toward the center of the box to the distanced position in which they are displaced from their adjacent outer side panels 11 and 13. Thus, again, simply moving the outer side panels from a collapsed flat condition to an erected condition automatically folds the outer closing panels into their closed position (e.g., to form a bottom of the box) and the inner side panels toward the center of the box into their distanced positions.

Figure 69:
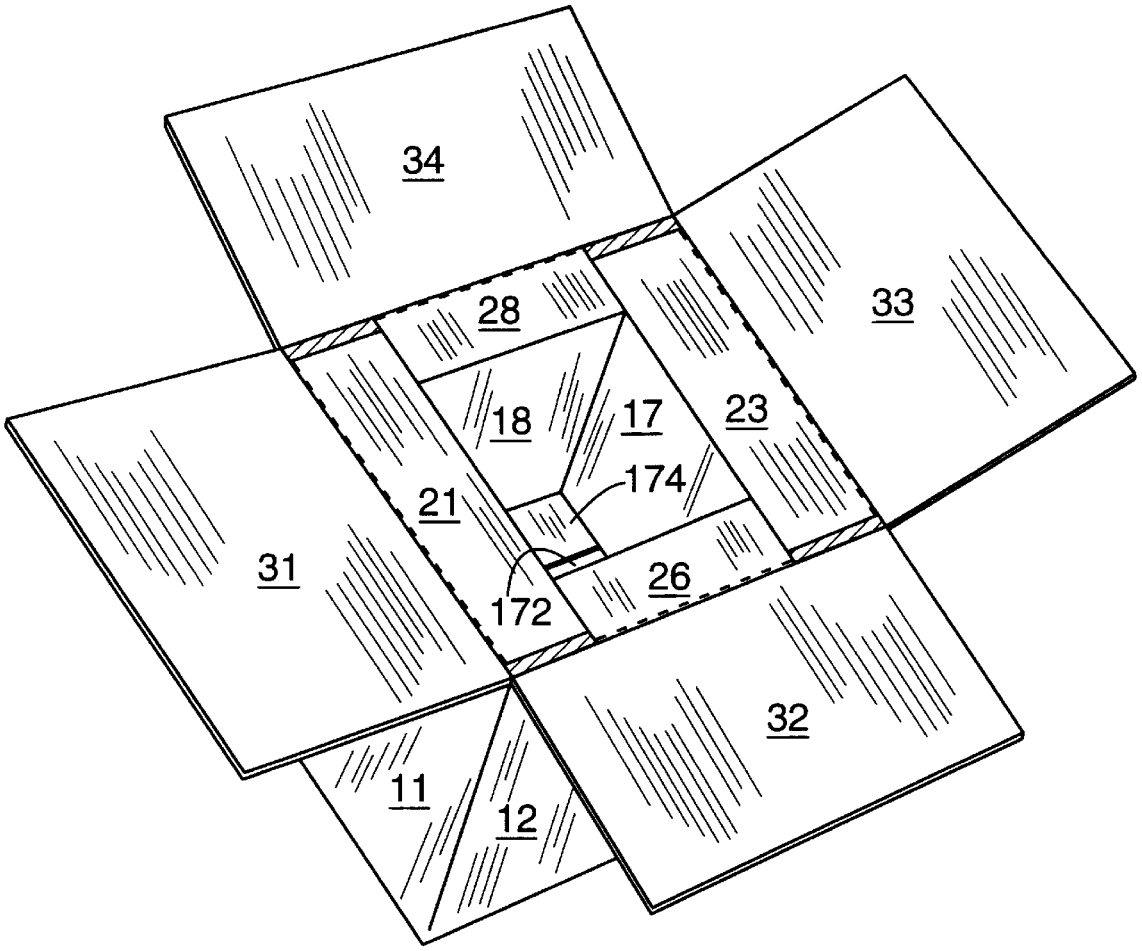
FIG. 69 is a front perspective view of another embodiment of a packaging box according to the present invention.
Figure 70:
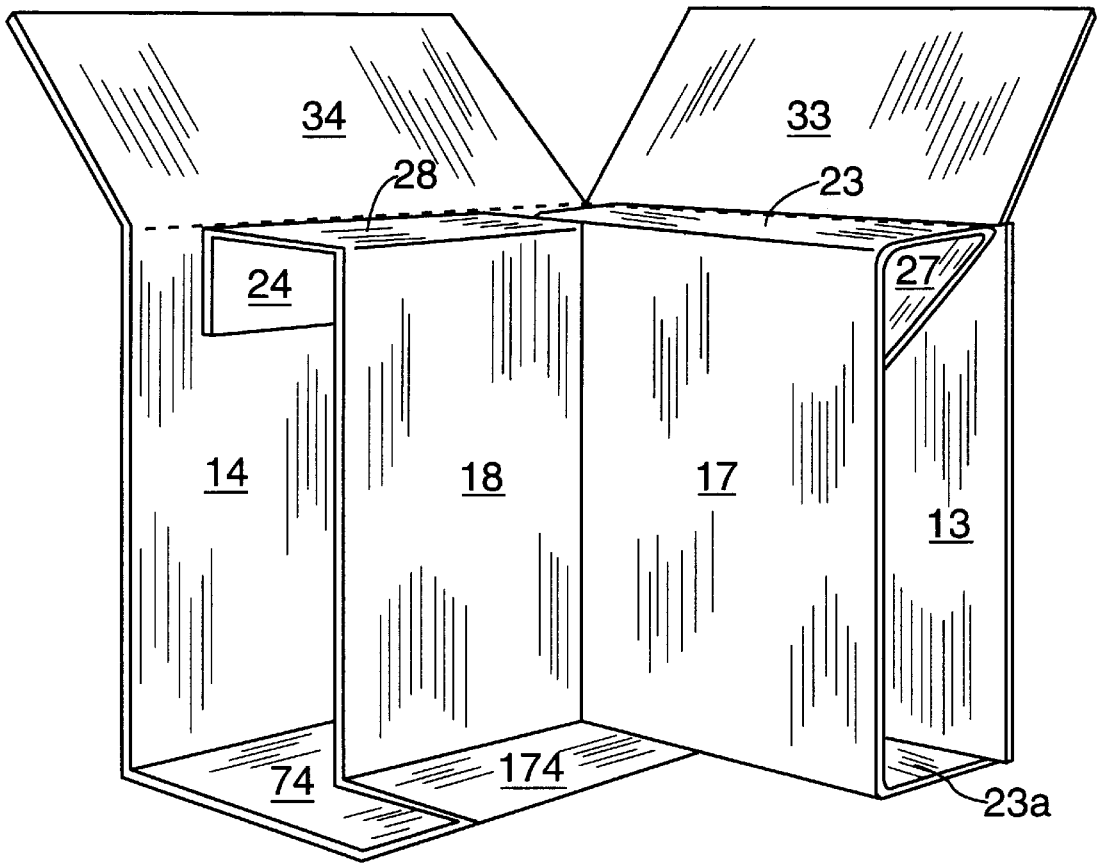
FIG. 70 is a perspective view of the packaging box of FIG. 69, with panels removed to show details of the inside of the box.
Figure 71:
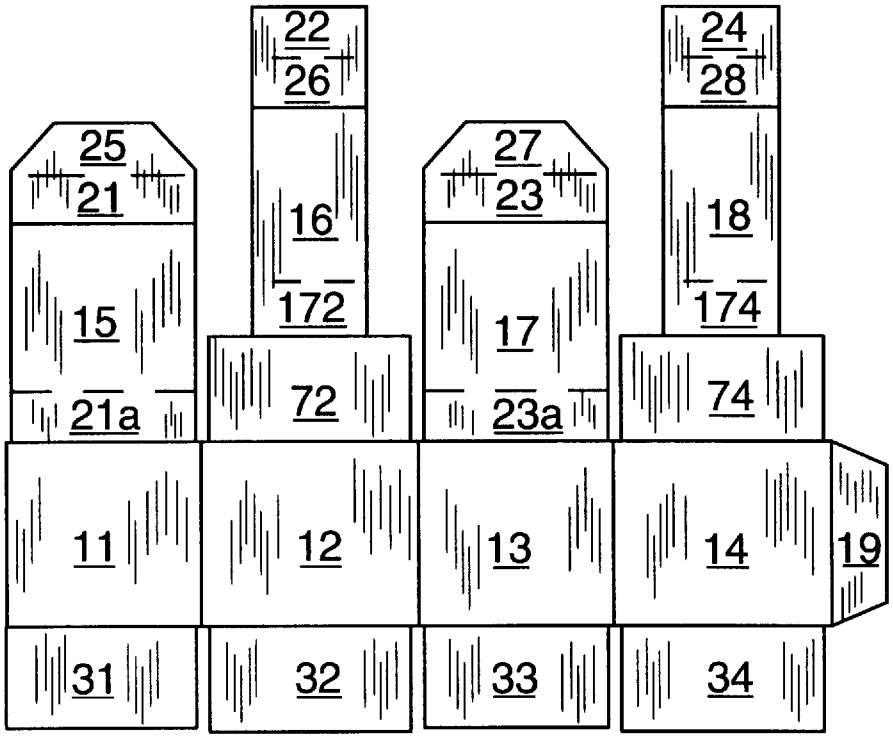
FIG. 71 is a view of a preform from which the packaging box of FIG. 69 can be formed by folding and connecting the respective associated portions thereof.

FIGS. 69 to 71 illustrate another variation of a double panel box according to the invention. In this embodiment, the box comprises a plurality of outer side panels 11 to 14 and inner side panels 15 to 18 associated with the outer side panels 11 to 14, respectively. The inner side panels 15 to 18 are similar to inner side panels described above. In the erected condition of the box, they are spaced from the associated outer side panels 11 to 14 by distancing flaps 21, 26, 23 and 28. The inner side panels 16 and 18 are connected to outer closing panels 72 and 74 such that when the outer closing panels 72 and 74 are moved to their closed positions, the inner side panels 16 and 18 are moved toward the center of the box to the distanced position in which they are displaced from their adjacent outer side panels 12 and 14. The inner side panels 15 and 17 are connected to distancing flaps 21*a* and 23*a* such that when the distancing flaps 21*a* and 23*a* are folded relative to their respective outer side panels 11 and 13, the inner side panels 15 and 17 are moved to their distanced positions in which they are displaced from their adjacent outer side panels 11 and 13.

In this embodiment, each of the outer closing panels 72 and 74 that causes movement of an inner side panel 16 and 18 is located at the bottom of the box. The distancing flaps 21*a* and 23*a* are also located at the bottom of the box. In the illustrated embodiment, outer closing panel 72 and outer closing panel 74 together close the bottom of the box. The box comprises fold back panels 172 and 174, respectively, that are folded back against the respective outer closing panel to a position at which the respective inner side panel 16 and 18 is located.

With this embodiment, all of the inner side panels 15 to 18 are in their distanced positions when the bottom of the box is fully closed. In this way, the interior space within the inner side panels 15 to 18 is defined prior to closing any of the top outer closing panels 31 to 34. Another advantage of the construction of this embodiment is that the box can be taped in the same direction. That is, the meeting line of outer closing panels 72 and 74 can be taped to close the bottom of the box, and, subsequently, after outer closing panels 31 and 33 have been closed, outer closing panels 32 and 34 can be folded closed and then taped along a line parallel to the meeting line of outer closing panels 72 and 74. This may simplify the manufacturing operation.

Figure 72:
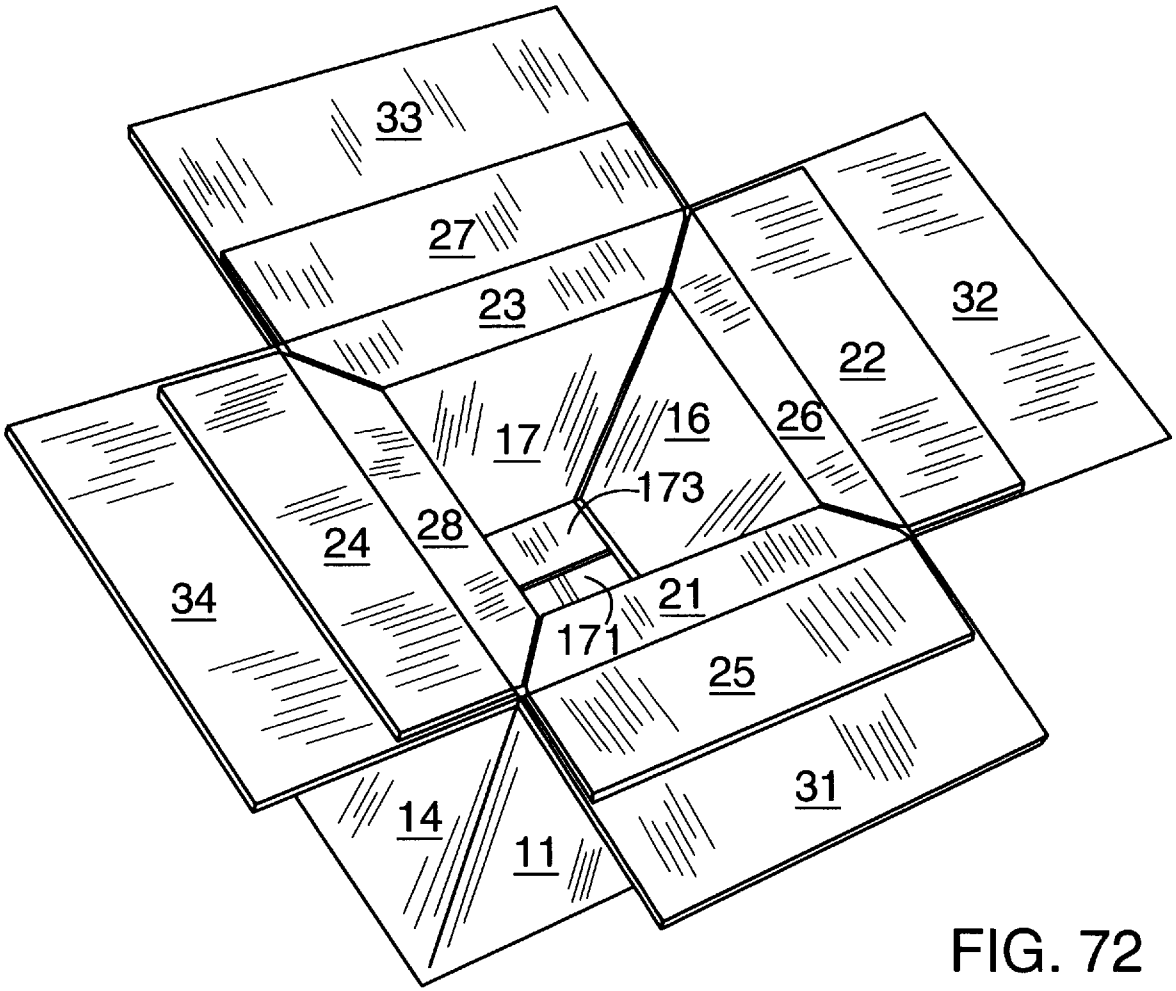
FIG. 72 is a front perspective view of another embodiment of a packaging box according to the present invention.
Figure 73:
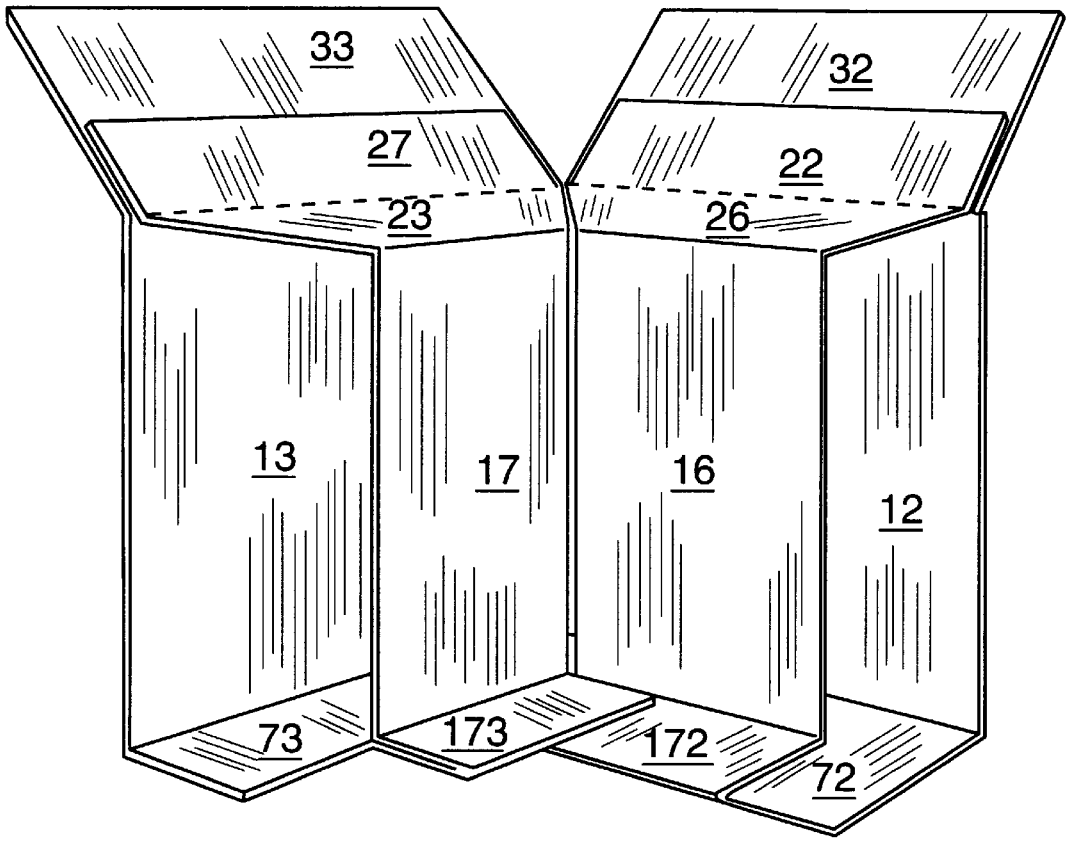
FIG. 73 is a perspective view of the packaging box of FIG. 72, with panels removed to show details of the inside of the box.
Figure 74:
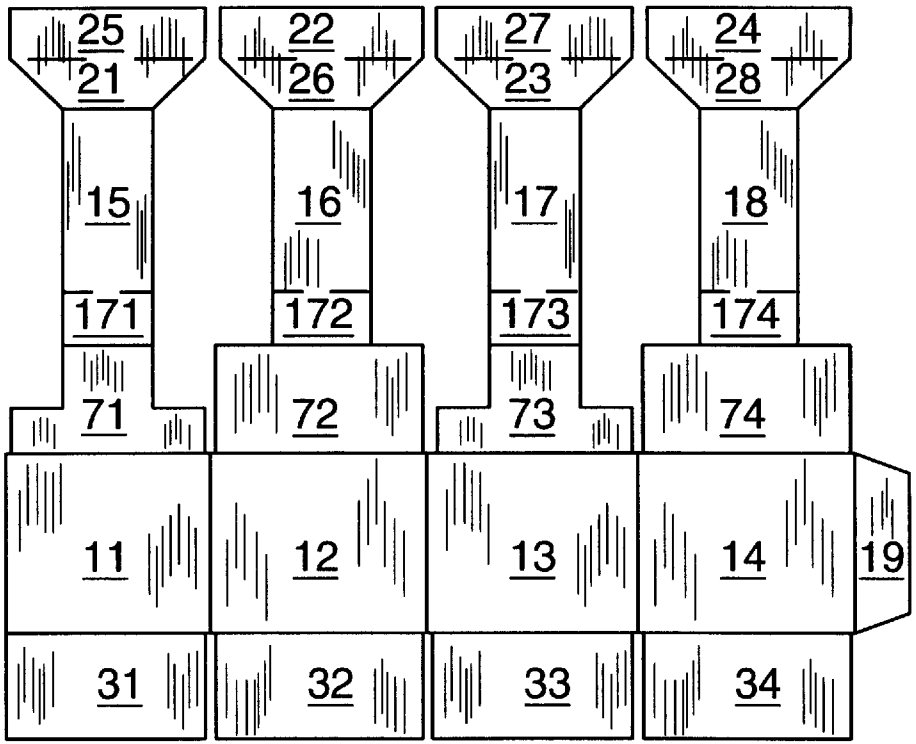
FIG. 74 is a view of a preform from which the packaging box of FIG. 72 can be formed by folding and connecting the respective associated portions thereof.

FIGS. 72 to 74 illustrate a double panel box similar to the previous embodiment. The box again comprises a plurality of outer side panels 11 to 14 and inner side panels 15 to 18 associated with the outer side panels 11 to 14, respectively. In the erected condition of the box, the inner side panels 15 to 18 are spaced from the associated outer side panels 11 to 14 by distancing flaps 21, 26, 23 and 28. When the outer closing panels 71 to 74 are moved to their closed positions, the inner side panels 15 to 18 are moved toward the center of the box to the distanced position in which they are displaced from their adjacent outer side panels 11 to 14.

As in the previous embodiment, each of the outer closing panels 71 to 74 that causes movement of an inner side panel 15 to 18 is located at the bottom of the box. Outer closing panel 72 and outer closing panel 74 together close the bottom of the box.

In this embodiment, the box comprises fold back panels 171 to 174 that are folded back against the respective outer closing panels 71 to 74 to the positions at which the respective inner side panels 15 to 18 are located. In this embodiment, the connecting flaps 25, 22, 27 and 24 are shown connected to the outer closing panels 31 to 34, but it will be appreciated that they could also be connected to outer side panels 11 to 14, as in the previous embodiment.

Again, as in the previous embodiment, the box can be taped in the same direction. The meeting line of outer closing panels 72 and 74 can be taped to close the bottom of the box, and, subsequently, after outer closing panels 31 and 33 have been closed, outer closing panels 32 and 34 can be folded closed and then taped along a line parallel to the meeting line of outer closing panels 72 and 74.

Figure 75:
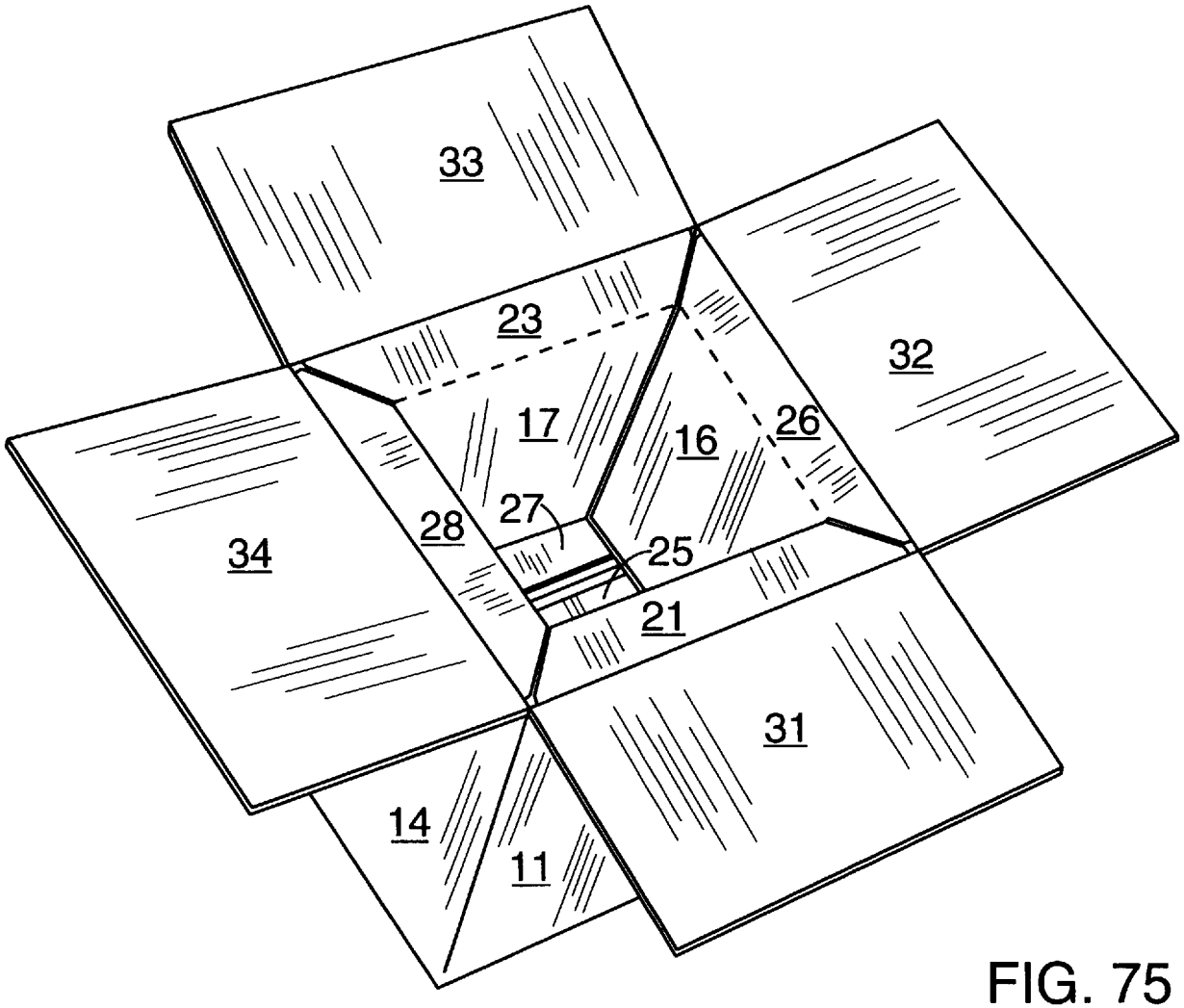
FIG. 75 is a front perspective view of another embodiment of a packaging box according to the present invention.
Figure 76:
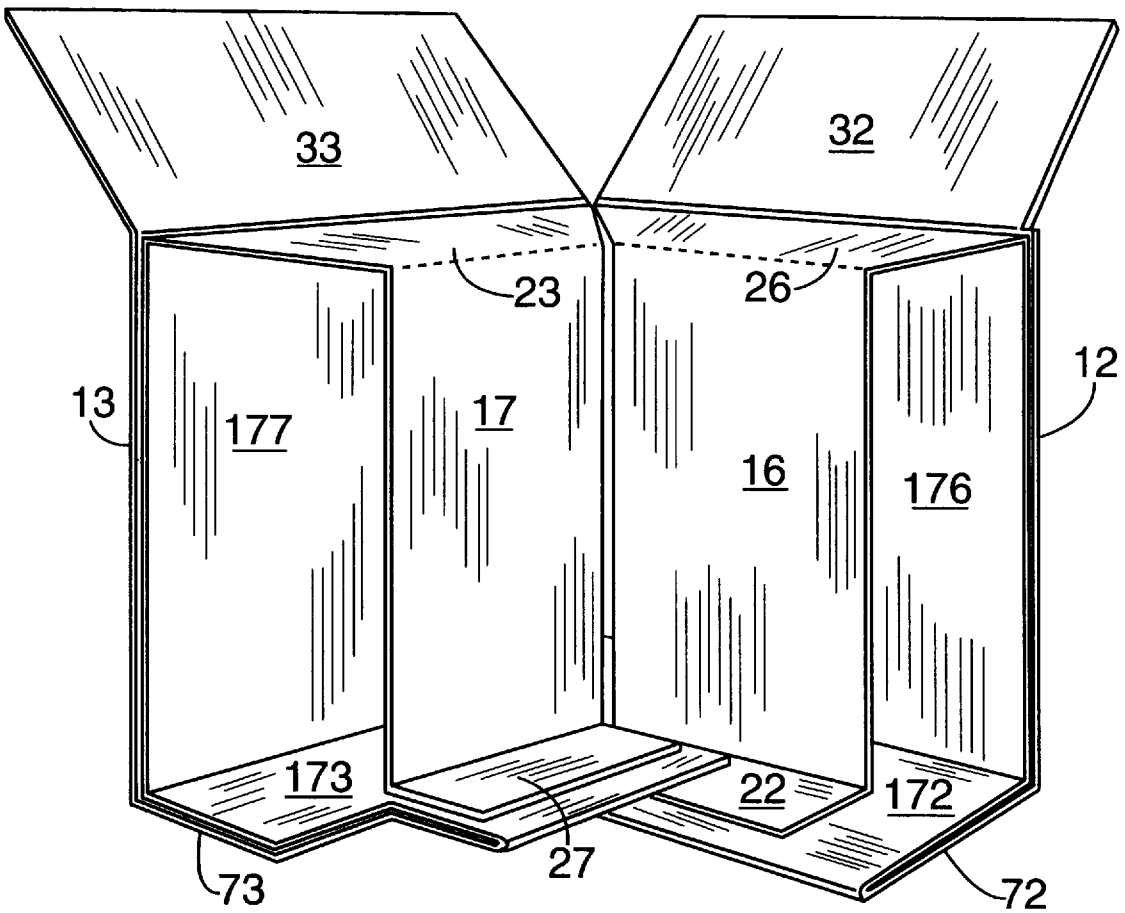
FIG. 76 is a perspective view of the packaging box of FIG. 75, with panels removed to show details of the inside of the box.
Figure 77:
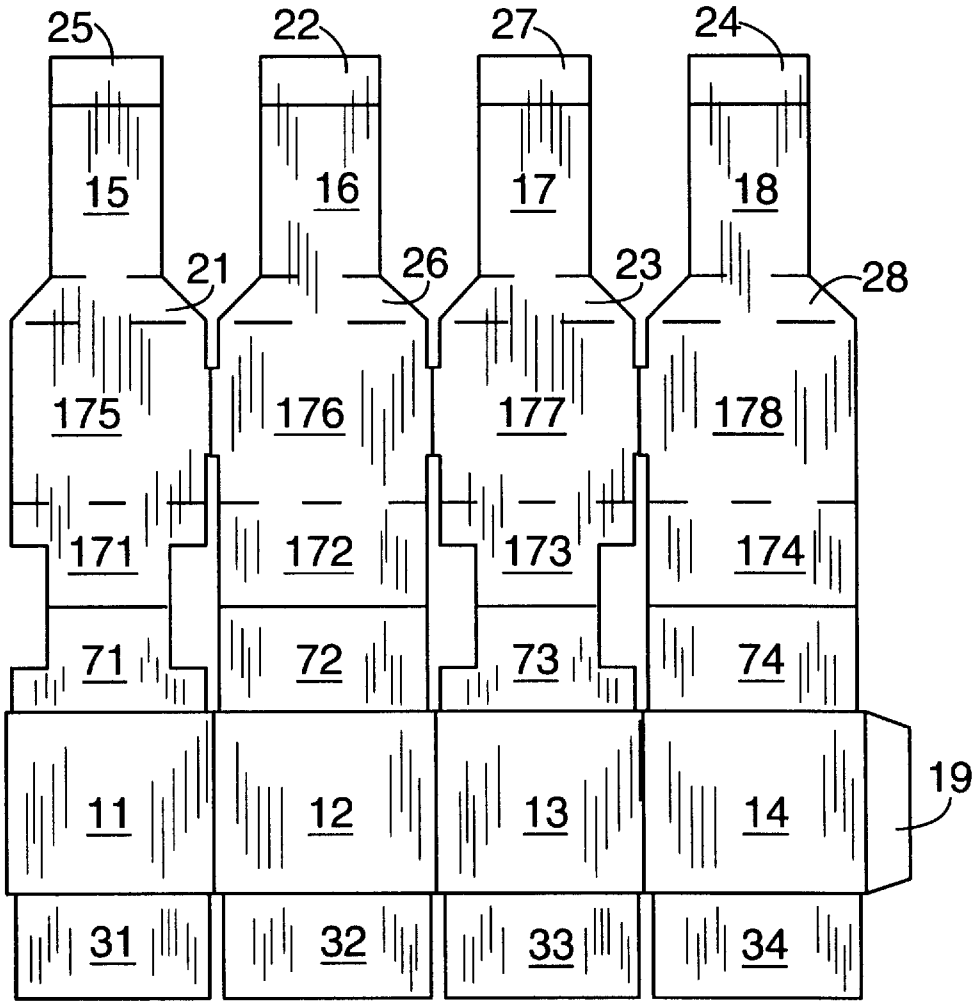
FIG. 77 is a view of a preform from which the packaging box of FIG. 75 can be formed by folding and connecting the respective associated portions thereof.

FIGS. 75 to 77 illustrate yet another double panel box in which all of the inner side panels 15 to 18 are in their distanced positions when the bottom of the box is fully closed. The box again comprises a plurality of outer side panels 11 to 14 and inner side panels 15 to 18 associated with the outer side panels 11 to 14, respectively. In the erected condition of the box, the inner side panels 15 to 18 are spaced from the associated outer side panels 11 to 14 by distancing flaps 21, 26, 23 and 28. When the outer closing panels 71 to 74 are moved to their closed positions, the inner side panels 15 to 18 are moved toward the center of the box to the distanced position in which they are displaced from their adjacent outer side panels 11 to 14.

As in the previous two embodiments, each of the outer closing panels 71 to 74 that causes movement of an inner side panel 15 to 18 is located at the bottom of the box. In this embodiment, the box comprises not only fold back panels 171 to 174 that are folded back against the respective outer closing panels 71 to 74, but also fold back panels 175 to 178 that are folded back against the respective outer side panels 11 to 14. In this embodiment, the connecting flaps 25, 22, 27 and 24 are connected to the fold back panels 171 to 174.

As in the previous embodiments, the box can be taped in the same direction. The meeting line of outer closing panels 72 and 74 is parallel to the meeting line of outer closing panels 32 and 34. It will be appreciated that a further advantage of this embodiment, as well as of the previous two embodiments, is that the fold back panels provide extra strength to the associated outer panels. They also provide extra paper for additional features such as spacers, buttresses, etc.

Figure 78:
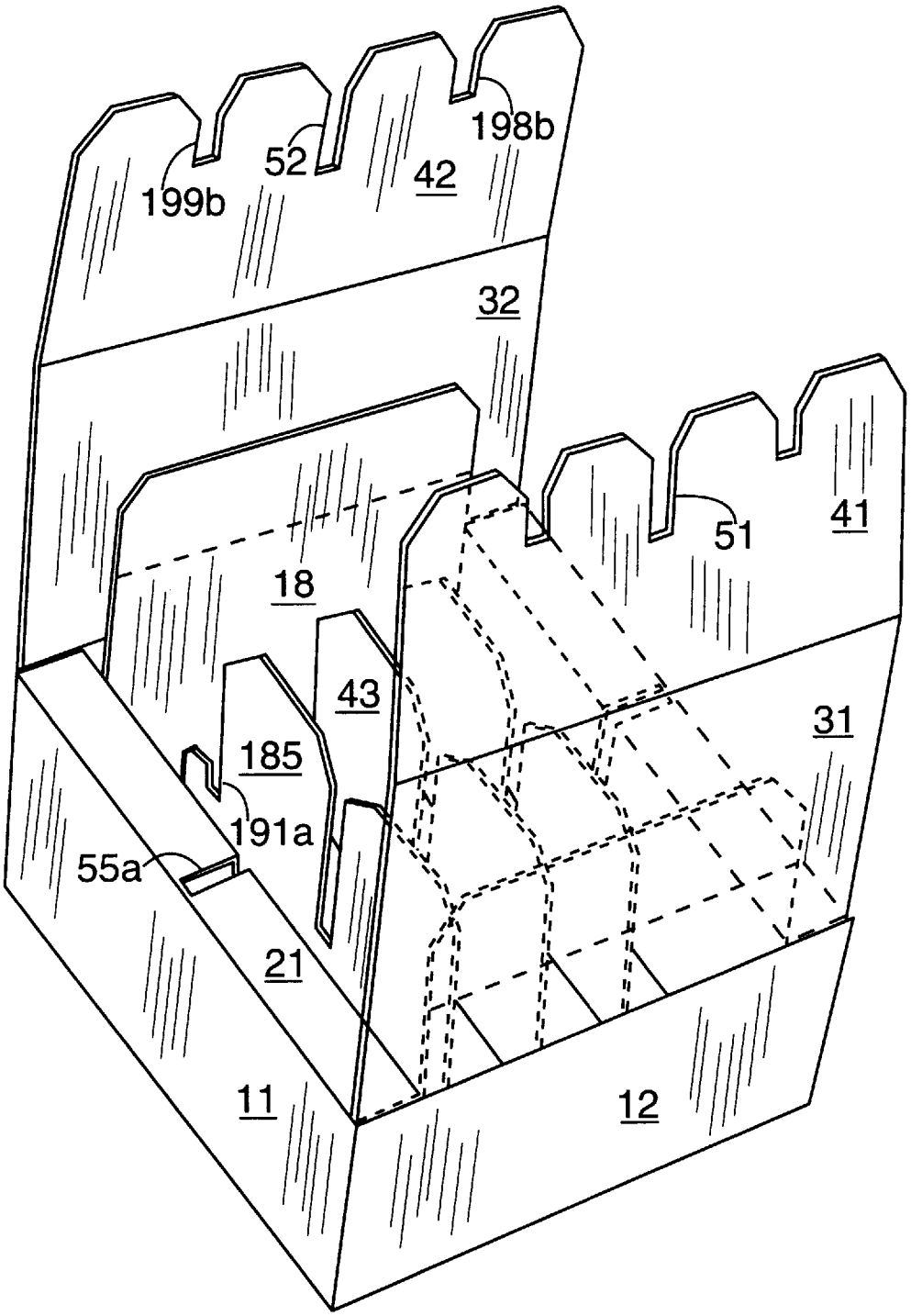
FIG. 78 is a front perspective view of another embodiment of a packaging box according to the present invention.
Figure 79:
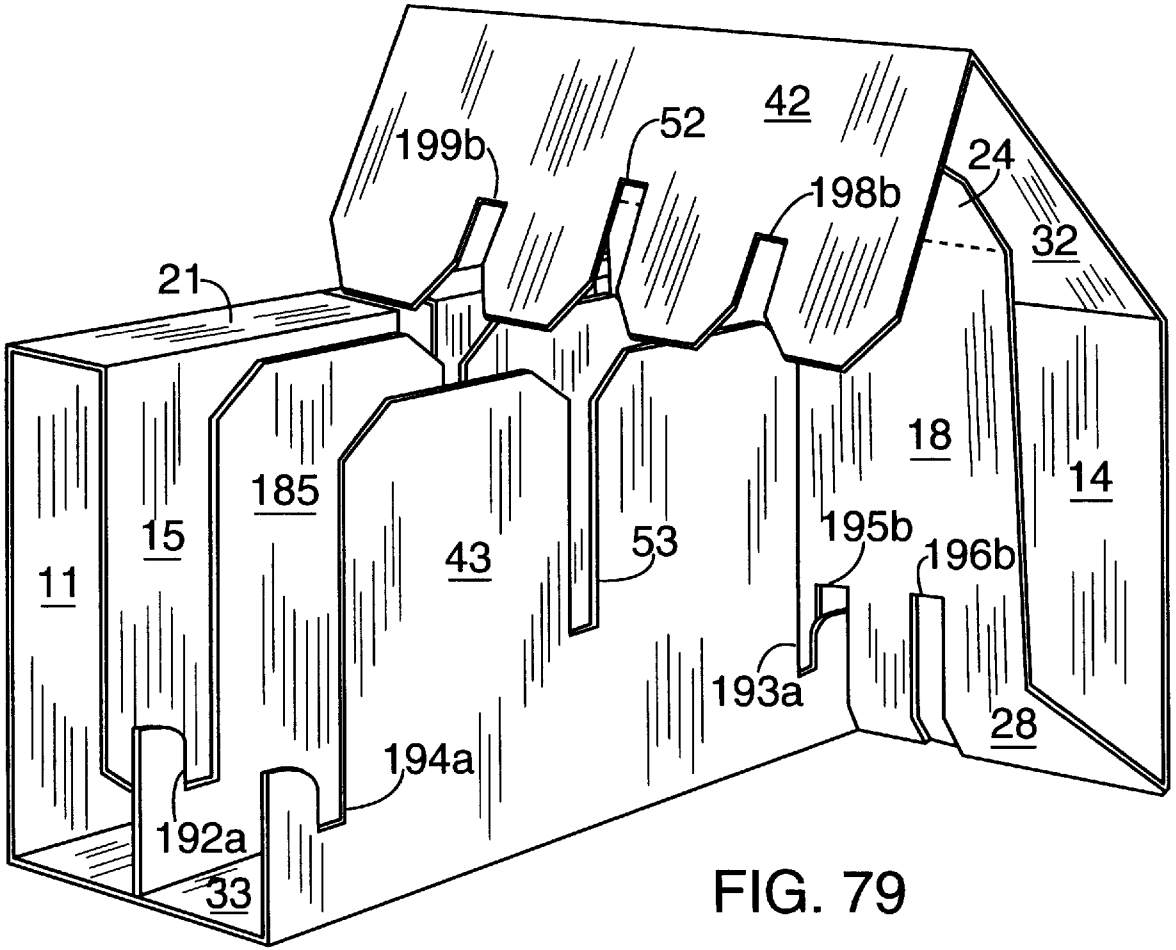
FIG. 79 is a perspective view of the packaging box of FIG. 78, with panels removed to show details of the inside of the box.
Figure 80:
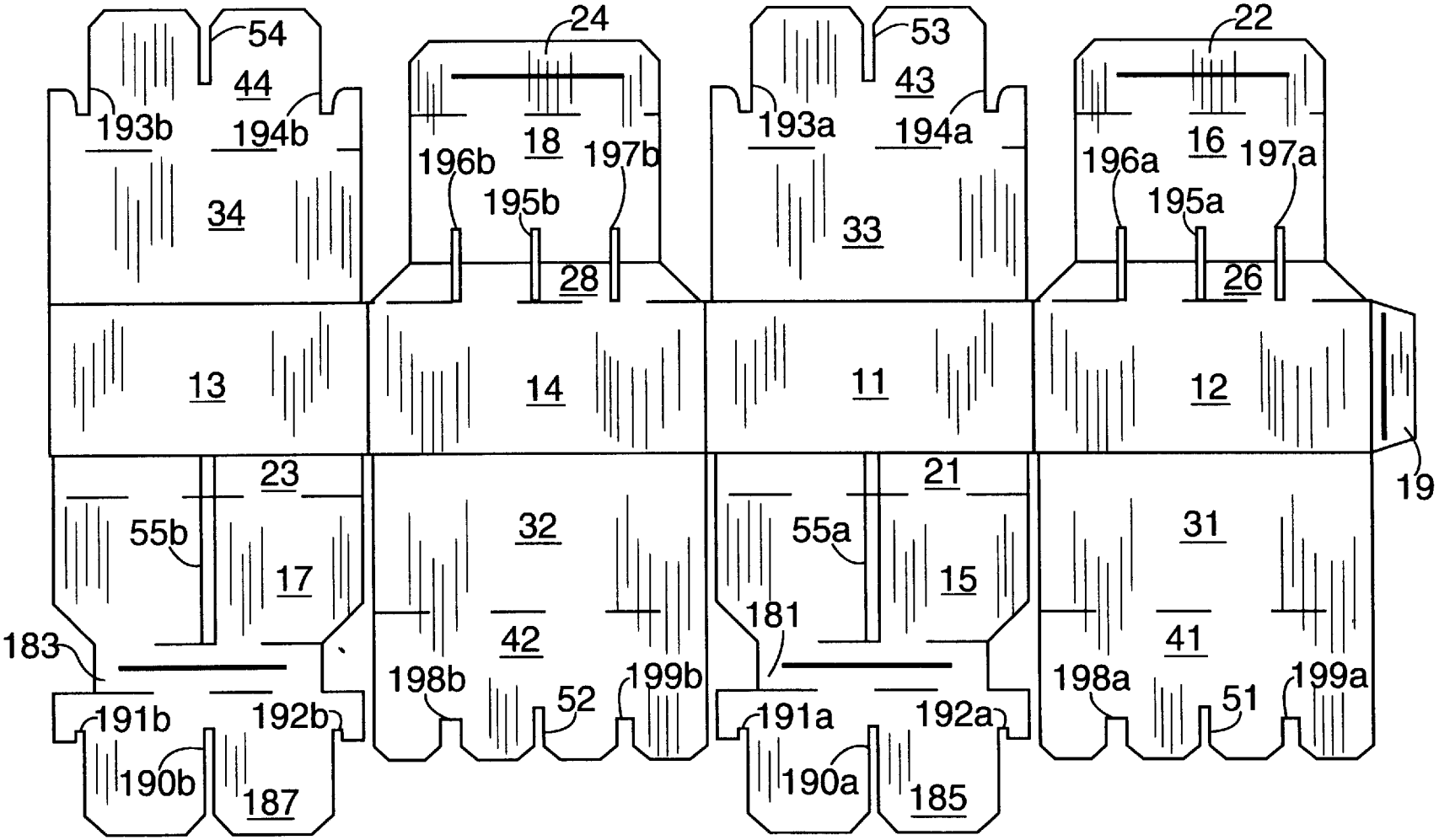
FIG. 80 is a view of a preform from which the packaging box of FIG. 78 can be formed by folding and connecting the respective associated portions thereof.

FIGS. 78 to 80 illustrate another variation of a packaging box according to the invention that is similar to the box that is illustrated in FIGS. 7 to 10. That is, the box of FIGS. 78 to 80 includes partitioning flaps 41 to 44 that adjoin and are of one piece with the top and bottom closing panels 31 to 34. In this embodiment, the box also includes further partitioning flaps 185 and 187 to separate the interior of the box into further compartments. These partitioning flaps 185 and 187 are connected to inner side panels 15 and 17 by partitioning spacers 181 and 183, respectively. When the box is folded and glued, the partitioning spacer 181 is glued to the outer closing panel 33, and the partitioning spacer 183 is glued to the outer closing panel 34. In this way, the partitioning flaps 185 and 187 are spaced from the respective inner side panels 15 and 17.

To accommodate the various panels and flaps, the box of FIGS. 78 to 80 includes a number of accommodating slots and cutouts. Accommodating slots 51 to 54 and cutouts 55*a* and 55*b* are similar to those described with respect to FIGS. 7 to 10. Further accommodating slots and cutouts 190*a* and *b* to 199*a* and *b* are provided in the box to act in a manner similar to that described above.

Figure 81:
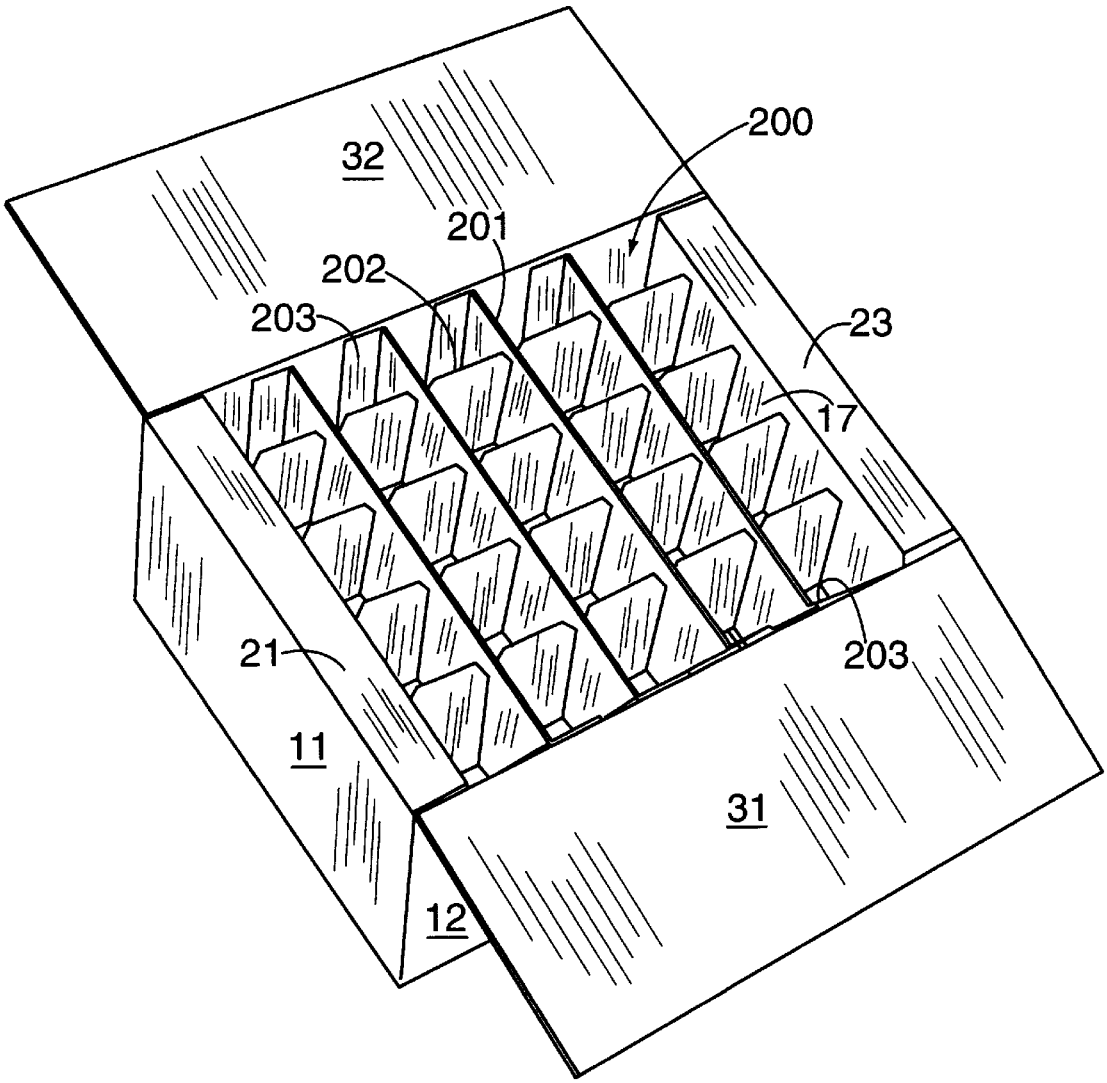
FIG. 81 is a front perspective view of another embodiment of a packaging box according to the present invention.
Figure 82:
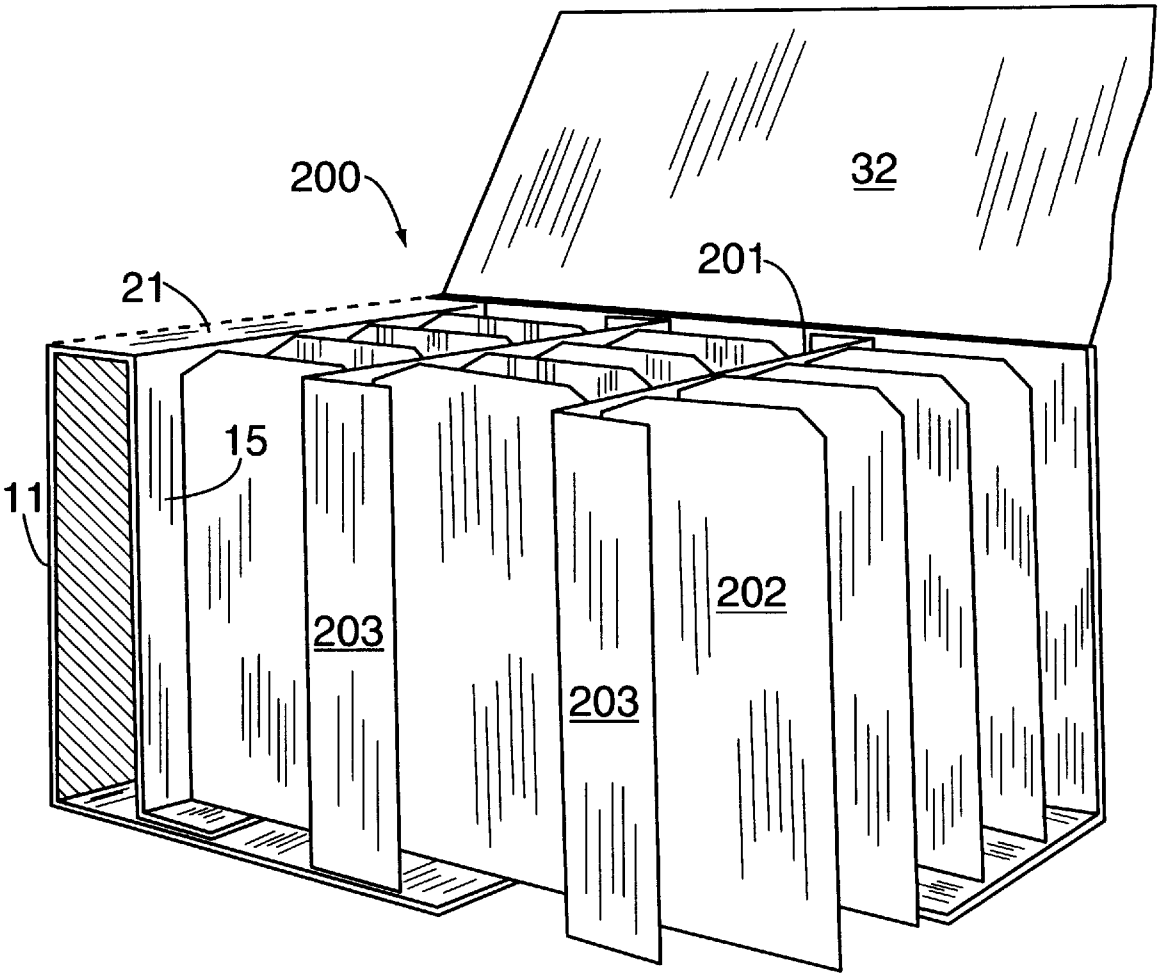
FIG. 82 is a perspective view of the packaging box of FIG. 81, with panels removed to show details of the inside of the box.
Figure 83:
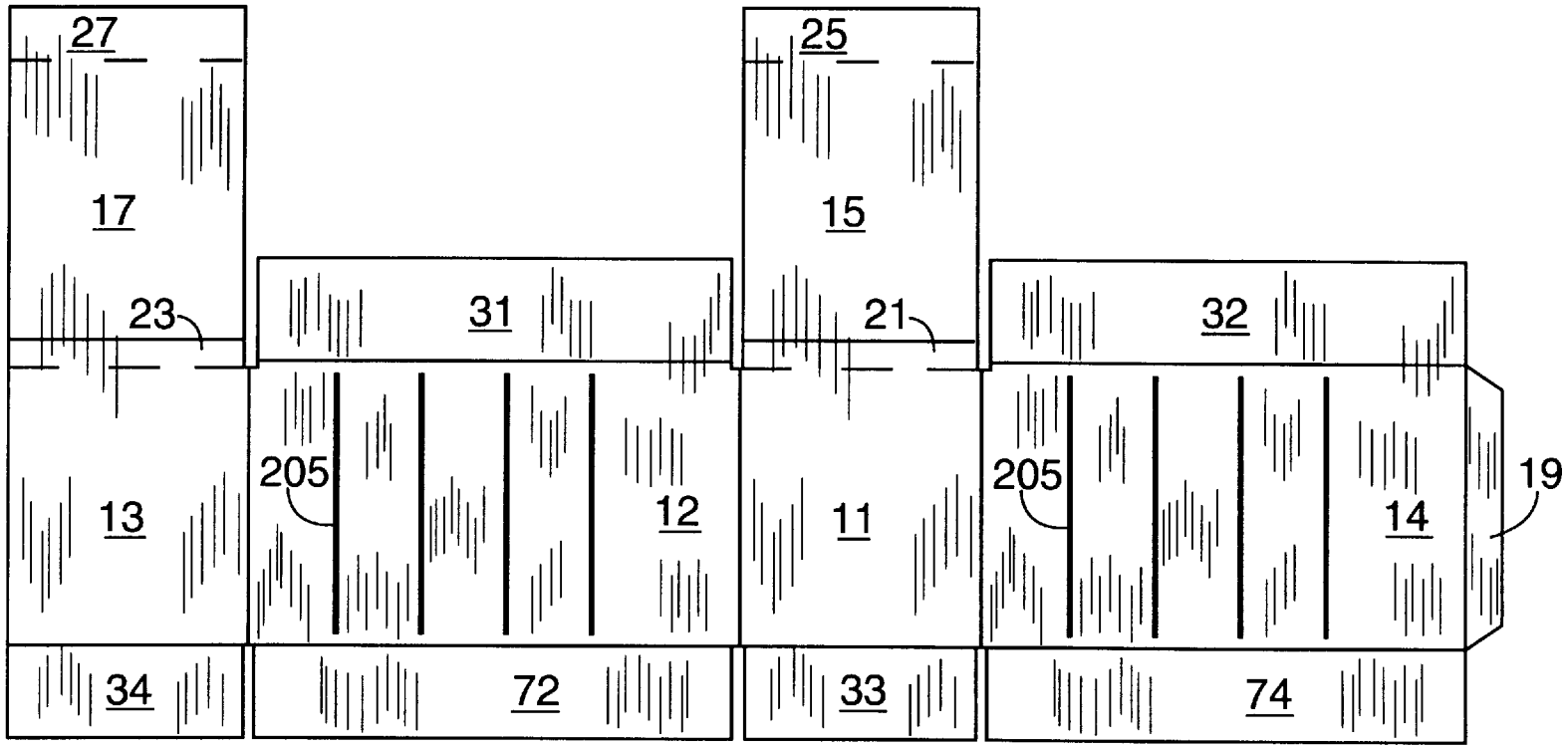
FIG. 83 is a view of a preform from which the packaging box of FIG. 81 can be formed by folding and connecting the respective associated portions thereof.

FIGS. 81 to 83 illustrate an application of a double panel box in which partitions are formed in the box automatically when the box is erected. The double panel construction is similar to that described above. The box includes a set of partitions 200 comprising partition panels 201 and 202. In the illustrated embodiment, the partition panels 201 are glued to outer side panels 12 and 14 at glue tabs 203, but it will be appreciated that the partitions 200 may be attached to the rest of the box in many ways.

Because of the arrangement of the partitions, the box can be collapsed flat without the need to remove the partitions. When the outer side panels are moved to erect the box, the partitions are automatically moved. Thus, the box is automatically partitioned by movement of the side panels.

Figures 84, 85:
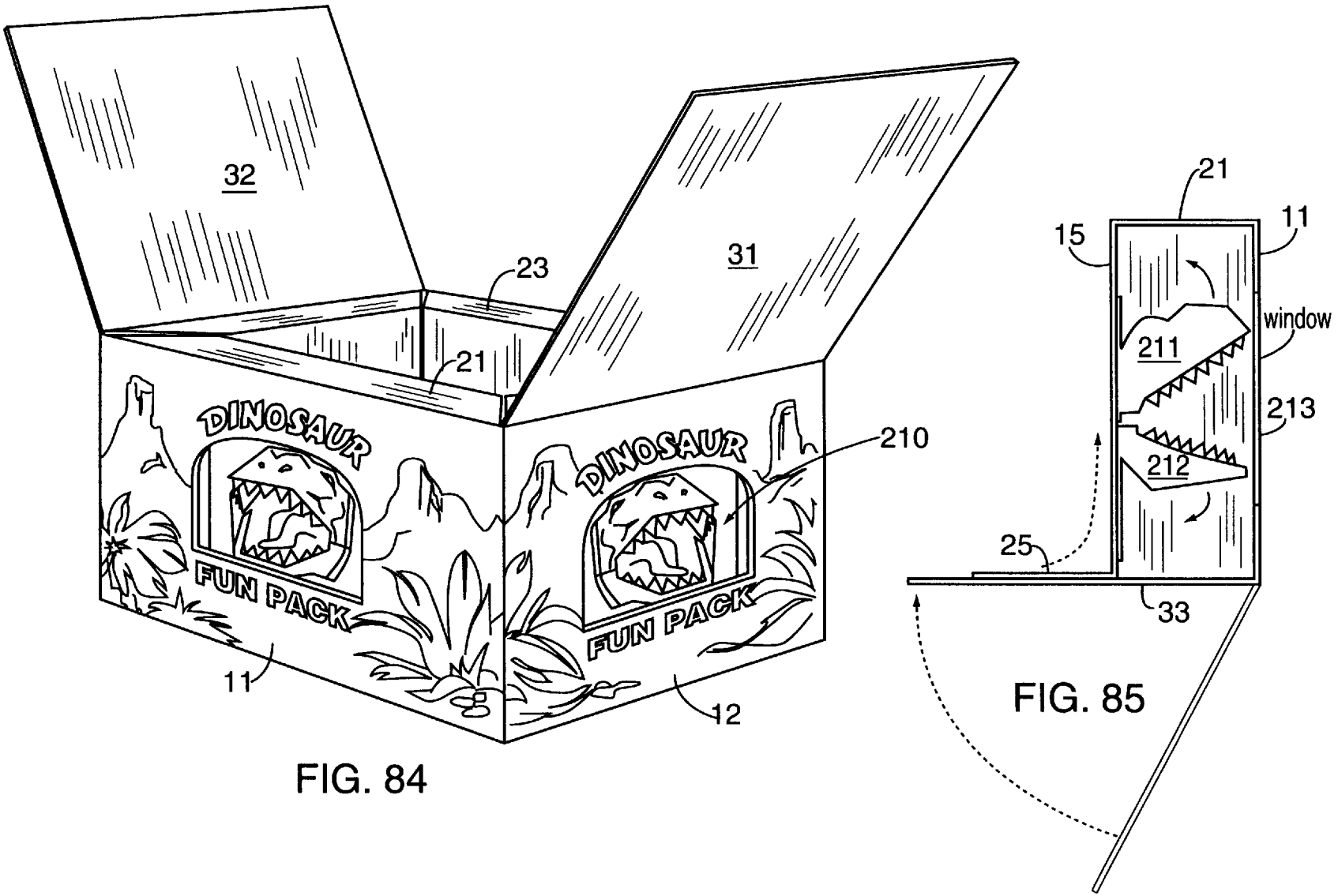
FIG. 84 is a front perspective view of another embodiment of a packaging box according to the present invention.
FIG. 85 is a side view of a display within the packaging box of FIG. 84.

It will be appreciated that the double panel construction of the invention may be utilized for a variety of purposes. For example, the internal space between an inner panel and an adjacent outer panel may provide a display space, visible through a cutout in one of the panels surrounding the display space. The cutout may be covered by a transparent plastic film. The action of the displacement of the inner panel away from the outer panel may assist in creating the display, for example by activating origami decoration. An example of such a box is illustrated in FIGS. 84 to 85, in which a decoration 210 in the form of a dinosaur mouth is visible through a window 213 and is automatically opened by the displacement of the inner side panels, which cause the upper jaw 211 and lower jaw 212 to move into the position shown in FIG. 85.

As another example, the internal space between an inner panel and an adjacent outer panel may form a compartment for containing goods. For such an application, as well as for other applications, the box may comprise only a single movable panel construction.

Figure 86:
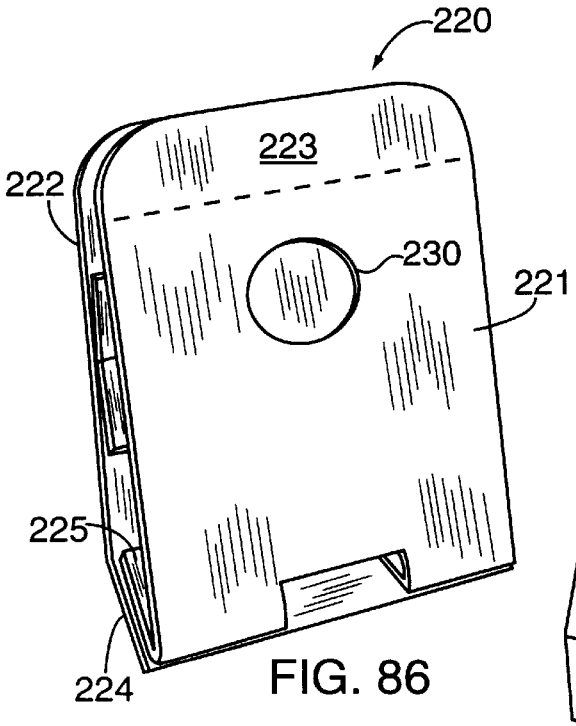
FIG. 86 is a front perspective view of an embodiment of a dispenser packaging box according to the present invention.
Figure 87:
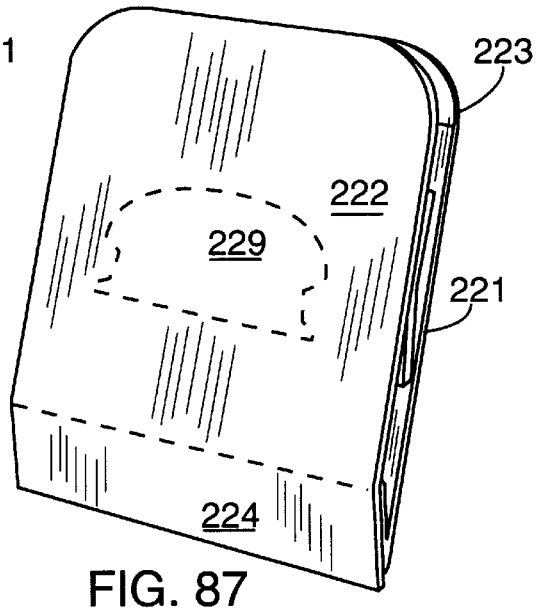
FIG. 87 is a rear perspective view of the dispenser packaging box of FIG. 86.
Figure 88:
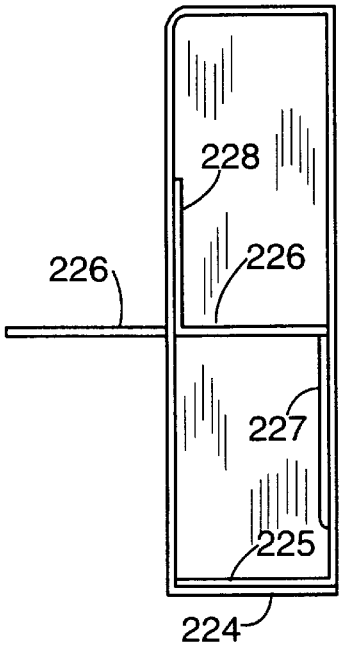
FIG. 88 is a side view of the dispenser packaging box of FIG. 86.
Figure 89:
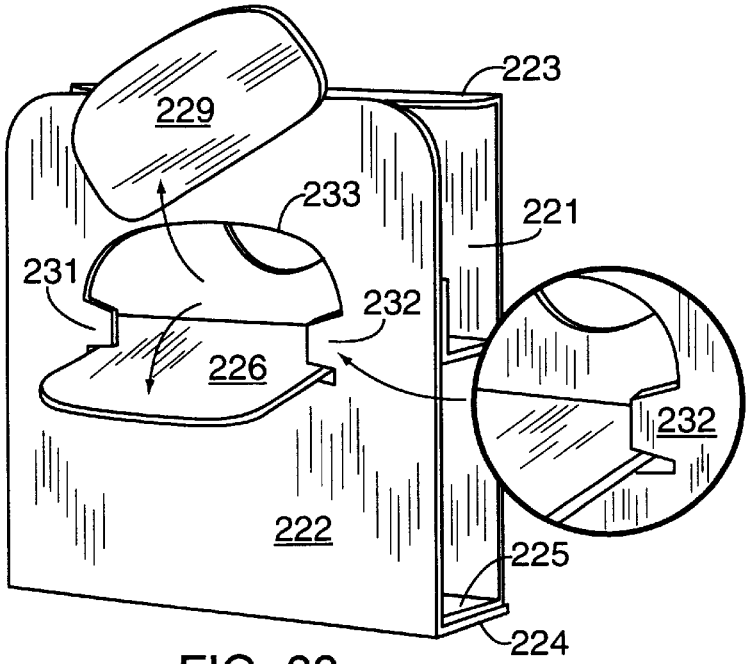
FIG. 89 is a rear perspective view of the dispenser packaging box of FIG. 86, with the box in a dispensing position.

A variant of such a box is a dispenser box as shown in FIGS. 86 to 92. The dispenser box has a front panel 221, a back panel 222, a top panel 223, and a bottom panel 224. The dispenser box can be moved from a collapsed flat position as shown in FIGS. 86 and 87 to an erected condition as shown in FIG. 89.

The dispenser box includes a dispensing panel 226 that extends when the box is moved into its erected condition. Tabs 225 join the front panel 221 to the bottom panel 224. Tabs 227 and 228 position the dispensing panel 226 and form the connection for its movement. The box includes a removable panel 229 and a front window 230. When the removable panel 229 is removed and the dispenser box is in its erected condition as shown in FIG. 89, the dispensing panel 226 extends through the open area 233. In the embodiment shown in FIGS. 86 to 89, locking tabs 231 and 232 hold the dispensing panel 226 in position.

Figure 91:
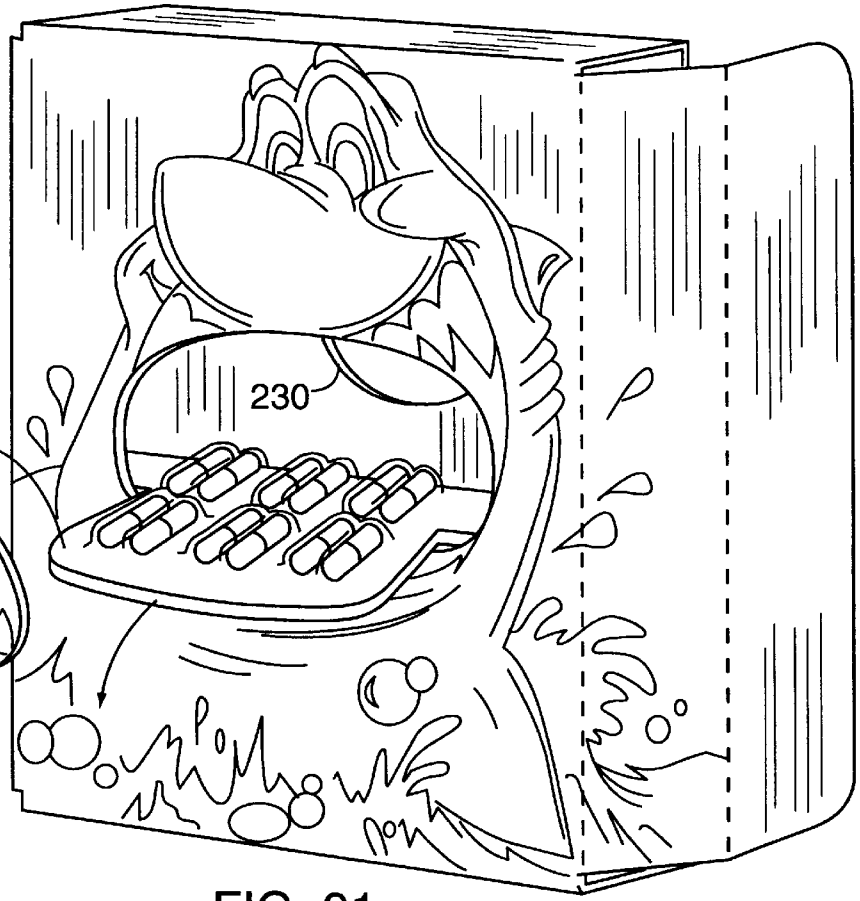
FIG. 91 is a rear perspective view of a dispenser packaging box similar to that shown in FIG. 90, with the box in a dispensing position.
Figure 90:
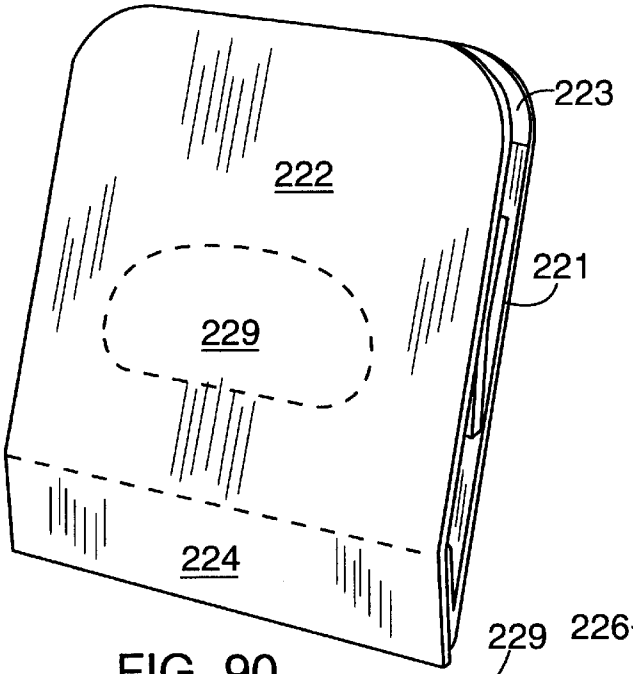
FIG. 90 is a rear perspective view of another embodiment of a dispenser packaging box according to the present invention.
Figure 92:
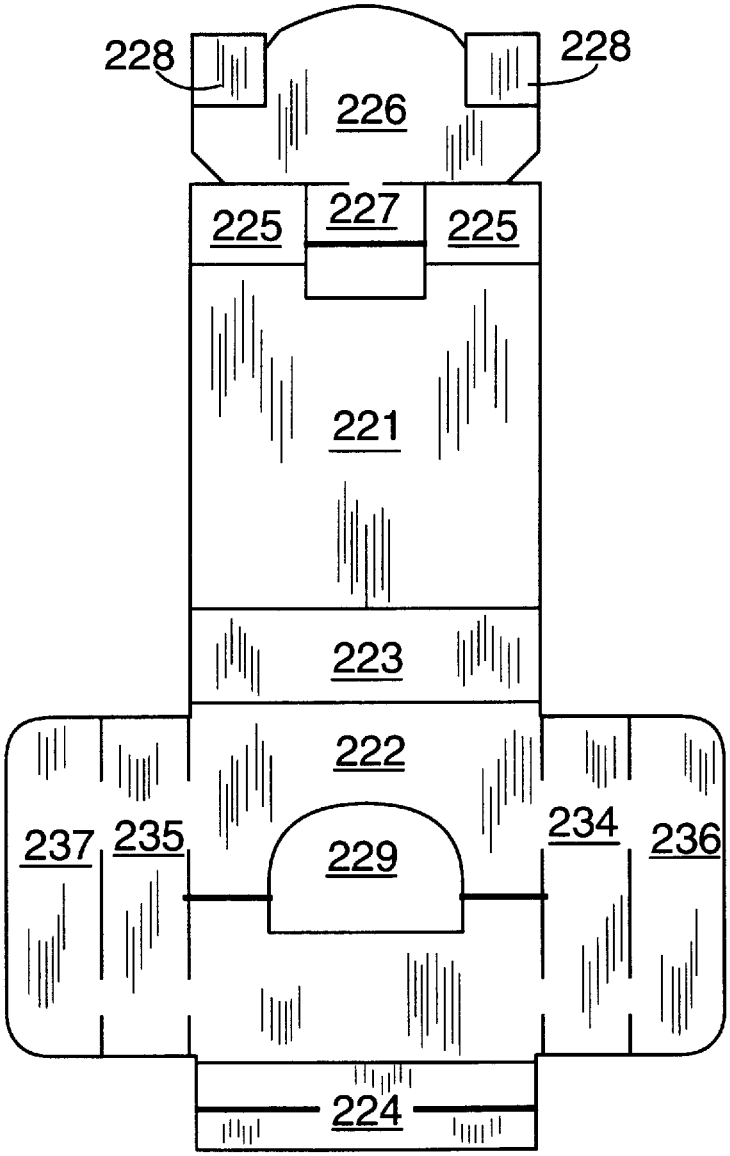
FIG. 92 is a view of a preform from which the packaging box of FIG. 91 can be formed by folding and connecting the respective associated portions thereof.
Figure 93:
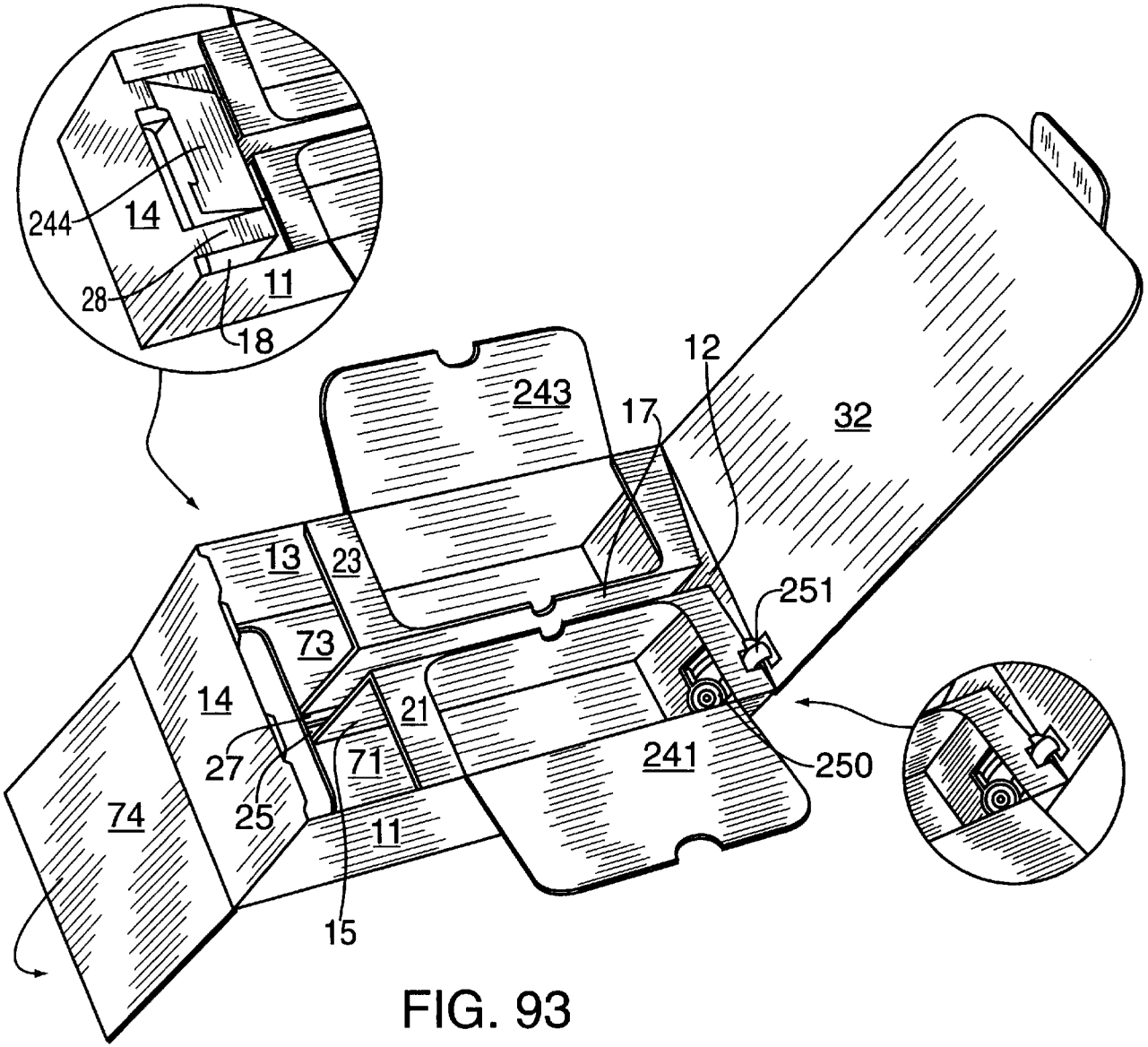
FIG. 93 is a front perspective view of another embodiment of a packaging box according to the present invention.
Figure 94:
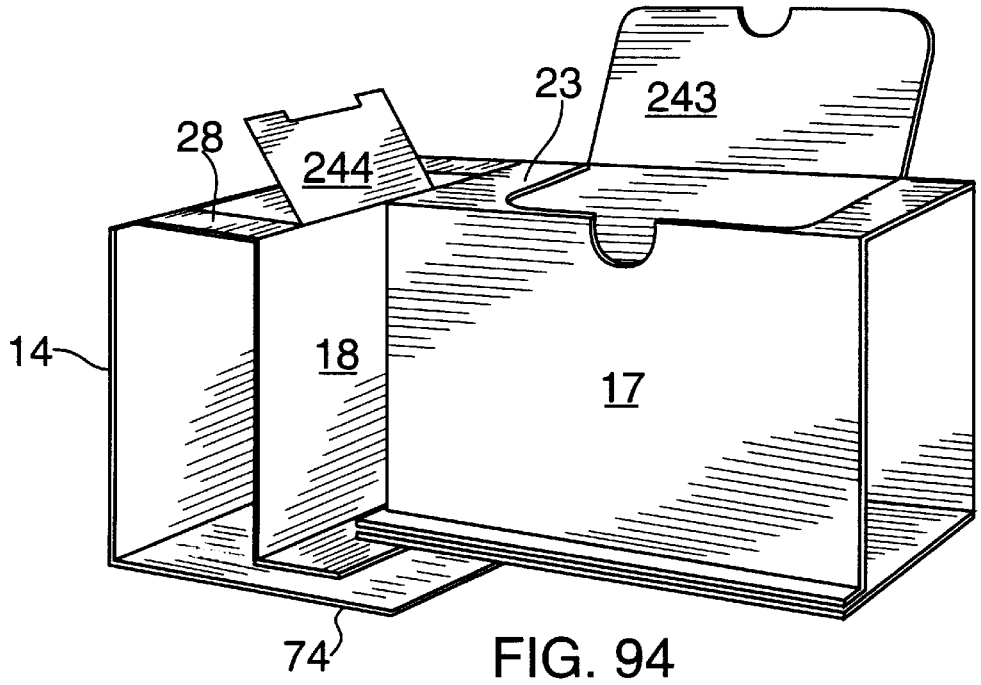
FIG. 94 is a perspective view of the packaging box of FIG. 93, with panels removed to show details of the inside of the box.
Figure 95:
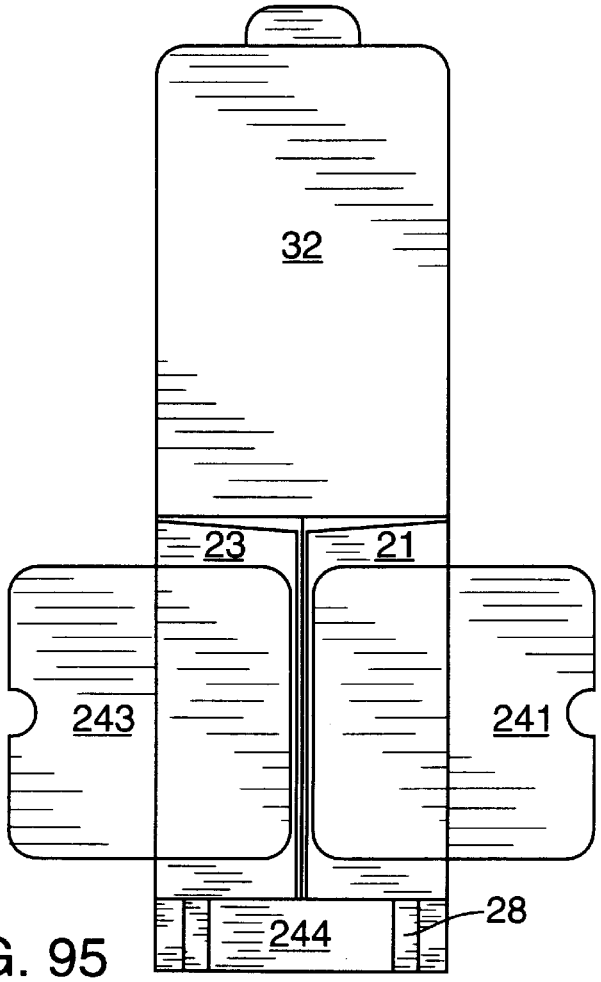
FIG. 95 is a top view of the packaging box of FIG. 93.
Figure 96:
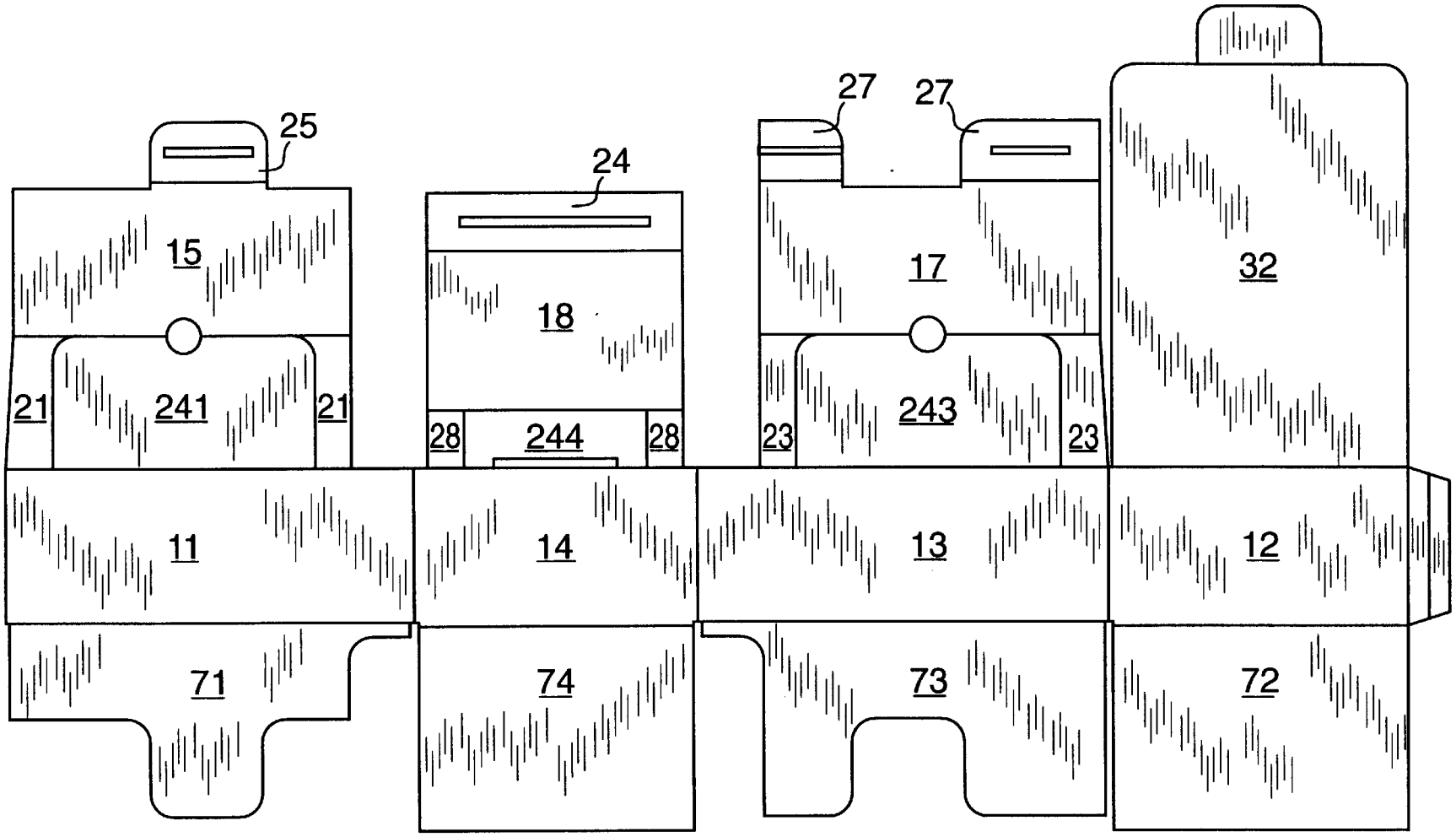
FIG. 96 is a view of a preform from which the packaging box of FIG. 93 can be formed by folding and connecting the respective associated portions thereof.

An example of the use of a dispenser box is shown in FIG. 91. The dispensing panel 226 may hold pills or tablets, for example vitamins. When the box is closed, the pills may be visible through the front window 230. When the box is opened, the pills may be popped out through the underside of the dispensing panel 226 in a known manner. In the illustrations of FIGS. 91 and 92, the box comprises side panels and flaps 234 to 237.

An example in which the internal space between an inner side panel and an adjacent outer side panel of a box form a compartment for containing goods is illustrated in FIGS. 93 to 96. In this embodiment, the box comprises a plurality of outer side panels 11 to 14 and inner side panels 15, 17 and 18 which may be put into position in the erected condition of the box as described above. Part of the associated distancing flaps 21, 23 and 28 are cut out to form opening panels 241, 243 and 244, respectively. Thus, for example, the space between outer side panel 11 and inner side panel 15 forms a compartment that may be accessed by opening the opening panel 241. Additional space in the box may also be used for compartments, such as, for example, the space between inner side panel 15 and inner side panel 17.

The compartments, for example, may contain separate parts of an item to be assembled. Instructions may be provided on the opening panels 241, 243 and 244 or elsewhere indicating an order in which the compartments are to be opened. Such instructions may take any number of forms, including, but not limited to, written words, pictures, signs or symbols, digital code, static or dynamic optical images and the like. The instructions need not be visually readable, but may require, e.g., a scanning, amplifying, magnifying, decoding, or interpretive device. Alternatively, the box may be provided with an electronic voice chip 250 that provides audible instructions when the box is opened. For example, when outer closing panel 32 is opened it pulls on pull tab 251, activating the voice chip 250.

Variations on the use of the voice chip are possible. For example, the voice chip may additionally or alternatively provide handling instructions, warnings, customer service information, marketing information, music, or any other desired sounds. It may be activated in other ways, too, that may be mechanical or non-mechanical. For example, a tab on the closing panel may be positioned such that when the closing panel is closed, the tab separates contacts of the voice device. When the closing panel is opened, the contacts are allowed to touch, thereby activating the voice chip. Voice chips may be useful in other boxes not limited to the double panel boxes described above.

In the above-described embodiments that include a voice chip, the voice chip may be considered a receiving system. The input to the voice chip in those examples comprises the movement of the closing panel and/or the pull tab and/or the other action that activates the voice chip. In response to that input, the receiving system (the voice chip) emits an output, in the form of audible sounds, into the surroundings.

The use of a receiving system in accordance with the invention, and the possible inputs to and responses by a receiving system, are not limited to those described above with respect to a voice chip. For example, moving an outer closing panel or some other action on or input received by a receiving system of the box may cause an environmental response, e.g., a release of moisture, light, desiccants, anti-corrosive materials, or a temperature change, that is desirable during shipment. As an example, the box may contain one or more organisms (e.g., plant seedlings) in an hospitable environment. The hospitable environment contains materials of sustenance (e.g., nutrients, moisture), energy (e.g., heat, light) and protection (e.g., insulation, cushioning) for the organisms. The box possesses thermal and light sensitive sensors (receiving systems) which detect, as input, environmental conditions. In response to those conditions, the sensors activate a heat and light source to emit heat and light (output) into the hospitable environment (output system). Thus, in transit, the host environment, or box, protects the growth and maturation of the guest organisms, and at the end of the journey, the organisms have thrived. For plant seedlings, e.g., lettuce seedlings, the plant grows in transit and arrives in a preferred condition (e.g., larger, tastier, fresher, more ripe). Similarly, the hospitable environment may be used to cause organisms to reproduce during shipment.

The input received by the receiving system which causes the response may be received from a variety of sources, for example, the environment in which the box is placed. Similarly, the input and the response may take a variety of forms. For example, a change in temperature on the outside of the box may be detected by the receiving system and the response may be an activation of a material or substrate, e.g., a polymer, foam or gel, inside the box which gives off or absorbs heat to control the temperature inside the box or which has an insulating effect to improve the thermal stability of the contents of the box. As other examples of the input and the response, a crushing force on the box or a vibration of the box or some other movement may be detected, causing a response of activation of a material or substrate, e.g., a polymer, foam or gel, within the box which changes properties to create a desired effect, e.g., a cushioning effect to cushion the goods within the box or a stiffening effect to strengthen the panels of the box. As another example, a polymer, coating, sealant, foam or gel may respond to a puncture in a panel of the box to seal the puncture. In the case of an environmental response such as the emission of moisture within the box, the box may collect the medium for the response from the outside environment, e.g., by collecting water from the air.

One possible response may be to make one or more portions, regions or compartments of the box lighter, by the injection of a less dense fluid, e.g., a less dense gas. This may be effected, for example, by inflating a helium balloon within the box. The balloon may have a defined shape, e.g., of a sphere, cube, cylinder or toroid, to assist in cushioning the goods to be shipped. The lighter box is easier to handle, uses less fuel when shipped, and costs less to ship. Additionally, if the less dense fluid is selectively positioned within only certain portions of the box, for example in compartments on only three sides of the box, it may be used to control the orientation of the box, for example, to control the position of the box when and if it falls.

Boxes may be configured to respond when stacked together. For example, wires may be embedded in the box with contact points appropriately arranged such that when boxes are stacked they form a circuit. A current may be input through the circuit and may cause a response, for example light or heat, from components within the box connected to the circuit. The current may cause magnetization, to assist in keeping the stacked boxes together, for example, for stability in stiff winds or during transportation. Numerous other variations are possible.

In addition, a voice or sound chip within the box has other uses beyond providing information when the box is opened. For example, it may be connected to a receiver, sensor, transducer or actuator such that it is activated from a distance, e.g., by remote control. This may be useful, for example, in searching for a lost box or for a particular box among a number of boxes. This latter function may be alternatively served by a light which is activated by remote control or by any number of sensors, transducers or actuators known in the art.

Just as the box may receive and respond to electromagnetic or sound signals from an outside source, it may also send such signals to be received by an outside receiver. Thus, for example, an emitter in a box may, continuously or intermittently, send sound waves at a pitch inaudible to humans, which can be detected by remote sensors. In this way, boxes of a particular origin can be traced.

It will be understood that each of the elements described above, or two or more together, may also find a useful application in other types of constructions differing from the type described above.

While the present invention has been described and illustrated herein as embodied in certain specific constructions of a box, it is not limited to the details of these particular constructions, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

What is claimed is:

1. A box comprising:

(a) a plurality of outer panels including (1) a plurality of outer side panels bounding an internal space, and (2) at least one outer closing panel connected to one of the outer side panels and foldable with respect to that outer side panel to a closed position; and (b) at least one inner side panel and side distancing flap, wherein the side distancing flap is connected to the inner side panel and to an adjacent outer side panel and the inner side panel is connected to the outer closing panel;

wherein when the outer side panels are moved to an erected condition, the outer closing panel is automatically moved outwardly from the inside of the internal space to a closed position, and the movement of the outer closing panel causes the inner side panel to be automatically moved toward the center of the box to a distanced position in which it is displaced from the adjacent outer side panel.

2. A box comprising:

(a) a plurality of outer panels including (1) a plurality of outer side panels bounding an internal space, and (2) at least one outer closing panel connected to one of the outer side panels and foldable with respect to that outer side panel to a closed position; and (b) at least one inner side panel and side distancing flap;

wherein material at an end of the outer closing panel is folded back against the outer closing panel in the form of a fold back panel, a first end of the fold back panel being adjacent said end of the outer closing panel, and wherein material at a second end of the fold back panel is further folded to form at least the inner side panel and side distancing flap, and wherein when the outer closing panel is folded to the closed position, the inner side panel is moved toward the center of the box to a distanced position in which it is displaced from the adjacent outer side panel.

3. A box according to claim 2 wherein the material at the second end of the fold back panel is folded to form first the inner side panel and then the side distancing flap.

4. A box according to claim 2 wherein the material at the second end of the fold back panel is folded to form first a side fold back panel adjacent the outer side panel, then the side distancing flap, and then the inner side panel.

5. A box comprising:

(a) a plurality of outer panels including (1) a plurality of outer side panels bounding an internal space, and (2) at least one outer closing panel connected to one of the outer side panels and foldable with respect to that outer side panel to a closed position;

(b) at least one inner panel and distancing flap, wherein the distancing flap is connected to the inner panel, one of the inner panel or distancing flap is connected to the outer closing panel, and wherein when the outer closing panel is folded to the closed position, the inner panel is moved toward the center of the box to a distanced position in which it is displaced from the adjacent outer panel; and (c) a set of partition panels, wherein when the outer side panels are moved to an erected condition, the partition panels are automatically moved into positions in which they partition the internal space of the box into compartments.

6. A box comprising:

(a) a plurality of outer panels;

(b) at least one inner panel adjacent to one of said outer panels and spaced at a distanced position from said one of said outer panels; and (c) at least one partition flap;

wherein said at least one inner panel has a cutout in it for receiving a portion of said partitioning flap.

7. A box comprising:

(a) a plurality of outer panels;

(b) at least one inner panel and at least one distancing flap, wherein the inner panel is adjacent to one of said outer panels and spaced by the distancing flap at a distanced position from said one of said outer panels; and (c) at least one partition flap;

wherein said at least one distancing flap has a cutout in it for receiving a portion of said partitioning flap.

8. A box comprising:

(a) a plurality of outer panels including (1) a plurality of outer side panels bounding an internal space; and (2) at least one outer closing panel connected to one of the outer side panels and foldable with respect to that outer side panel to a closed position; and (b) at least one inner panel and distancing flap, wherein the distancing flap is connected to the inner panel, one of the inner panel or distancing flap is connected to the outer closing panel, and wherein when the outer closing panel is folded to the closed position, the inner panel is moved toward the center of the box to a distanced position in which it is displaced from an adjacent outer panel;

wherein the box is constructed in the form of a box cap.

9. A box comprising:

(a) a plurality of outer panels including (1) a plurality of outer side panels bounding an internal space, and (2) at least two outer closing panels each of which is connected to one of the outer side panels and is foldable with respect to that outer side panel to a closed position; and (b) associated with each of the at least two outer closing panels, at least one inner side panel and side distancing flap, wherein the side distancing flap is connected to the inner side panel and to an adjacent outer side panel, the inner side panel is connected to the outer closing panel, and wherein when the outer closing panel is folded to the closed position, the associated inner side panel is moved toward the center of the box to a distanced position in which it is displaced from the adjacent outer side panel;

wherein the box is constructed in the form of a box cap.

10. A box comprising:

(a) a plurality of outer panels including (1) a plurality of outer side panels bounding an internal space, and (2) at least four outer closing panels each of which is connected to one of the outer side panels and is foldable with respect to that outer side panel to a closed position; and (b) associated with each of the at least four outer closing panels, at least one inner side panel and side distancing flap, wherein the side distancing flap is connected to the inner side panel and to an adjacent outer side panel, the inner side panel is connected to the outer closing panel, and wherein when the outer closing panel is folded to the closed position, the associated inner side panel is moved toward the center of the box to a distanced position in which it is displaced from the adjacent outer side panel;

wherein four outer closing panels with associated inner side panels are positioned at one end of the box.

11. A box according to claim 10 constructed in the form of a box cap.

12. A box according to claim 10 wherein each of at least two outer closing panels:

(a) is connected to one of the outer side panels and is foldable with respect to that outer side panel to a closed position, and (b) has associated with it at least one closing panel inner panel and closing panel distancing flap, wherein the closing panel distancing flap is connected to the closing panel inner panel and to the outer closing panel with which it is associated, and wherein when the outer closing panel is folded to the closed position, the associated closing panel inner panel is moved toward the center of the box to a distanced position in which it is displaced from the outer closing panel with which it is associated;

wherein at least two outer closing panels with associated closing panel inner panels are positioned at the same end of the box.

13. A box according to claim 12 constructed in the form of a box cap.

14. A box comprising:

(a) a plurality of outer panels including (1) a plurality of outer side panels bounding an internal space; and (2) at least one outer closing panel connected to one of the outer side panels and foldable with respect to that outer side panel to a closed position; and (b) at least one closing panel inner panel and closing panel distancing flap, wherein the closing panel distancing flap is connected to the closing panel inner panel and to an adjacent outer closing panel, and wherein when the outer closing panel is folded to the closed position, the closing panel inner panel is moved toward the center of the box to a distanced position in which it is displaced from the adjacent outer closing panel;

wherein the box is constructed in the form of a box cap.

15. A box comprising:

(a) a plurality of outer panels including (1) a plurality of outer side panels bounding an internal space; and (2) at least two outer closing panels each of which is connected to one of the outer side panels and is foldable with respect to that outer side panel to a closed position; and (b) associated with each of the at least two outer closing panels, at least one closing panel inner panel and closing panel distancing flap, wherein the closing panel distancing flap is connected to the closing panel inner panel and to the outer closing panel with which it is associated, and wherein when the outer closing panel is folded to the closed position, the associated closing panel inner panel is moved toward the center of the box to a distanced position in which it is displaced from the outer closing panel with which it is associated;

wherein at least two outer closing panels with associated closing panel inner panels are positioned at the same end of the box.

* * * * *